US010052886B2

(12) United States Patent
Reinsch et al.

(10) Patent No.: US 10,052,886 B2
(45) Date of Patent: Aug. 21, 2018

(54) METHOD AND APPARATUS FOR ARRANGING SHEETS IN A SHINGLED POSITION

(71) Applicant: KOENIG & BAUER AG, Würzburg (DE)

(72) Inventors: Carsten Reinsch, Radebeul (DE); Michael Koch, Dresden-Cossebaude (DE); Michael Beyer, Klipphausen (DE); Roger Püschel, Heidenau (DE); Christian Ziegenbalg, Weinböhla (DE); Bernd Patzelt, Meißen (DE); Hartmut Nickell, Dresden (DE); Martin Riese, Radebeul (DE); Stefan Singer, Radebeul (DE)

(73) Assignee: Koenig & Bauer AG, Wurzburg (DE)

( * ) Notice: Subject to any disclaimer, the term of this patent is extended or adjusted under 35 U.S.C. 154(b) by 0 days.

(21) Appl. No.: 15/569,175

(22) PCT Filed: Apr. 29, 2016

(86) PCT No.: PCT/EP2016/059645
§ 371 (c)(1),
(2) Date: Oct. 25, 2017

(87) PCT Pub. No.: WO2016/174223
PCT Pub. Date: Nov. 3, 2016

(65) Prior Publication Data

US 2018/0147860 A1 May 31, 2018

(30) Foreign Application Priority Data

Sep. 3, 2015 (DE) ..... 10 2015 216 874

(51) Int. Cl.
*B65H 29/24* (2006.01)
*B41F 21/00* (2006.01)
(Continued)

(52) U.S. Cl.
CPC ..... *B41J 3/546* (2013.01); *B41F 13/54* (2013.01); *B41F 19/007* (2013.01); *B41J 11/0085* (2013.01); *B65H 29/245* (2013.01)

(58) Field of Classification Search
CPC ..... B41J 11/0085; B41J 11/007; B41J 3/546; B65H 29/24; B65H 29/241; B65H 29/242;
(Continued)

(56) References Cited

U.S. PATENT DOCUMENTS 3,198,046 A 8/1965 Angelo
5,275,394 A 1/1994 Mank et al.
(Continued)

FOREIGN PATENT DOCUMENTS

DE 4413089 A1 10/1995
DE 004420186 A1 12/1995
(Continued)

OTHER PUBLICATIONS

International Search Report of PCT/EP2016/059645 dated Aug. 29, 2016.

*Primary Examiner* — Huan Tran
(74) *Attorney, Agent, or Firm* — Mattingly & Malur, PC

(57) ABSTRACT

The invention relates to a method and a device for arranging sheets in an overlapping position in a transfer unit arranged between a first processing station and a second processing station following the first processing station in a transport direction of the sheets. The sheets to be overlapped are transported from the first processing station to the transfer unit, in a transport plane and each individually lying behind one another. A respective rear, in the transport direction, edge of the sheets coming from the first processing station, is raised relative to the transport plane exclusively by the use
(Continued)

of blown air, and a second subsequent sheet is slid under the rear edge of the respective preceding first sheet.

15 Claims, 30 Drawing Sheets

(51) Int. Cl.

| | |
|---|---|
| ***B41J 3/54*** | (2006.01) |
| ***B41F 13/54*** | (2006.01) |
| ***B41J 11/00*** | (2006.01) |
| ***B41F 19/00*** | (2006.01) |

(58) Field of Classification Search
CPC ..... B65H 29/245; B65H 29/247; B65H 5/08; B41F 21/10; B41F 19/007; B41F 13/54
See application file for complete search history.

(56) References Cited

U.S. PATENT DOCUMENTS

| | | | | |
|---|---|---|---|---|
| 5,564,687 | A | 10/1996 | Heiler et al. | |
| 5,636,833 | A * | 6/1997 | Maier | B65H 5/228 271/105 |
| 6,016,747 | A | 1/2000 | Beduhn et al. | |
| 7,665,722 | B2 * | 2/2010 | Edinger | B65H 5/24 271/11 |
| 7,942,406 | B2 | 5/2011 | Ootaki | |
| 2008/0224384 | A1 | 9/2008 | Mohringer et al. | |
| 2009/0146360 | A1 * | 6/2009 | Fokos | B65H 29/12 270/58.3 |
| 2010/0044946 | A1 | 2/2010 | Ootaki | |
| 2013/0050376 | A1 * | 2/2013 | Houjou | B41J 11/002 347/104 |

FOREIGN PATENT DOCUMENTS

| | | | |
|---|---|---|---|
| DE | 010047040 | A1 | 4/2001 |
| DE | 202004006615 | U1 | 8/2004 |
| DE | 102004007404 | A1 | 9/2004 |
| DE | 102007012658 | A1 | 9/2008 |
| DE | 102009048928 | A1 | 4/2011 |
| DE | 010141589 | B4 | 3/2015 |
| EP | 000503531 | A1 | 9/1992 |
| EP | 0615941 | A1 | 9/1994 |
| EP | 001281647 | B2 | 6/2009 |
| EP | 002516168 | B1 | 4/2015 |
| GB | 1577158 | A | 10/1980 |
| WO | 02/48012 | A2 | 6/2002 |

* cited by examiner

METHOD AND APPARATUS FOR ARRANGING SHEETS IN A SHINGLED POSITION

CROSS-REFERENCE TO RELATED APPLICATIONS

This application is the U.S. national phase, under 35 U.S.C. § 371, of PCT/EP2016/059645, filed Apr. 29, 2016; published as WO 2016/174223A1 on Nov. 3, 2016 and claiming priority to DE 10 2015 208 047.1, filed Apr. 30, 2015; to DE 10 2015 213 431.8, filed Jul. 17, 2015; to DE 10 2015 215 003.8, filed Aug. 6, 2015; to DE 10 2015 216 874.3, filed Sep. 3, 2015 and to DE 10 2015 217 229.5, filed Sep. 9, 2015, the disclosures of which are expressly incorporated herein by reference in their entireties.

FIELD OF THE INVENTION

The present invention relates to a method for arranging sheets in a shingled position, and to an apparatus for arranging sheets in a shingled position. The method arranges sheets in a shingled position in a transfer unit which is located between a first processing station and a second processing station that is located downstream of the first processing station, in a transport direction of the sheets. The sheets to be shingled are transported from the first processing station to the transfer unit, in a transport plane and lying individually in succession. A trailing edge, in the transport direction of each of the sheets coming from the first processing station, is raised relative to the transport plane solely by the use of blown air. A subsequent sheet is pushed underneath the trailing edge of the sheet preceding it. An apparatus is a providing for arranging the sheets in the shingled position in the transfer unit located between the first processing station and the second processing station located downstream of the first processing station in the transport direction of the sheets. A transport belt for transporting the sheets to be shingled is provided. The transport belt transports the sheets to be shingled from the first processing station to the transfer unit, in the transport plane and lying individually in succession. Nozzles for emitting the blown air are provided. The nozzles are arranged so as to raise the trailing edge, in the transport direction of each of the sheets coming from the processing station relative to the transport plane, solely by the use of the blown air, and so as to push a subsequent sheet underneath the trailing edge fo the sheet preceding it in each case.

BACKGROUND OF THE INVENTION

From U.S. Pat. No. 3,198,046 A, it is known to stack printed sheets that are to be transported along a transport path in a shingled formation by blowing blown air underneath the trailing end of a leading printed sheet, and sliding a subsequent printed sheet underneath the raised trailing end of the printed sheet preceding it.

DE 10 2004 007404 A1 discloses a method and an apparatus for guiding sheets to a sheet-processing machine, wherein the adhesive force between two successive sheets in a shingled stream of sheets is diminished by raising the trailing edge of the first sheet.

DE 10 2009 048928 A1 discloses an inkjet printer for printing onto sheet-type substrates, wherein the printer includes the following components: a) a printing couple transport apparatus having at least one revolving printing couple transport belt, guided via rollers and having openings, and a suction chamber apparatus located below the printing couple transport belt, wherein the printing couple transport belt or printing couple transport belts include(s) an autonomous drive unit, which impress(es) a speed upon the transport belt or transport belts, b) an inkjet printing device located above the upper drum of the printing couple transport belt, which is guided approximately horizontally, c) a transport apparatus, located upstream of the printing couple transport apparatus in the transport direction of the printing sheets/substrates, having at least one revolving belt, wherein the transport belt or the transport belts include(s) an autonomous drive unit, which impress(es) a speed upon the transport belt or the transport belts, wherein the ratio of the speed of the printing couple transport belt or printing couple transport belts of the printing couple transport apparatus to the speed of the transport belt or the transport belts of the transport unit located upstream of the printing couple transport apparatus is selected such that the printed sheets or substrates for all sheet formats provided for the inkjet printer come to rest end to end or spaced from one another by a slight distance of up to 10 mm on the printing couple transport belt or printing couple transport belts.

EP 0615941 A1 discloses an apparatus and a method for continuously conducting individual sheets of corrugated cardboard through an aniline printing section and a punching section, while the alignment of each sheet is maintained in each processing section.

DE 10 047040 A1 discloses a modular printing press system for printing onto sheets, including a first printing press of satellite construction having a central first impression cylinder and at least four printing devices assigned thereto, a second printing press, and a coupling device for coupling the printing presses to one another for the inline operation thereof, wherein a non-impact printer is assigned to a transport unit of the printing press system for transporting the sheets. The transport unit is constructed for transporting the sheets along a linear transport path, for example. The transport unit has, e.g. at least one clamping gripper, which rests on the side of a sheet held in said clamping gripper for printing on said side by the non-impact printer, said clamping gripper having an ultra-flat construction so that, as the sheet is being transported past said non-impact printer, said clamping gripper can be guided collision-free through a narrow gap formed between said non-impact printer and the sheet.

DE 10 141589 B4 discloses a method for operating a sheet-processing machine, in which the sheets are displaced in the transport direction and are handled in a plurality of processing stations, wherein the displacement speed of one sheet can be adjusted independently of the others, wherein the speed of one sheet is adjusted in each case to match the processing step to be carried out in the respective processing station, and wherein the speed of a sheet is different in at least two of the processing stations. The processing capacity of the individual processing stations may be the same during a specific time period, or the processing capacity of a first processing station may be greater or less than the processing capacity of second processing station located upstream or downstream, during a specific time period.

WO 02/48012 A2 discloses devices for aligning sheets, which are fed to the device after being offset from one another in shingle form by a shingling device, and which can be transferred to a device that is located downstream after alignment of the front edge and one lateral edge of the sheet. At least part of a sheet can be brought to rest on the periphery of an alignment cylinder, which is used to align the front edge of the sheet by means of front lay marks located on the periphery of the alignment cylinder. At least one recess is provided on the periphery of the alignment cylinder, which, by the application of a negative pressure to said recess, allows at least part of the sheet to be fixed by friction on the periphery of the alignment cylinder, in such a way that in the contact zone, drive forces from the alignment cylinder can be transferred by friction to the sheet. A measuring device determines the offset of a lateral edge of the sheet in relation to a predetermined set alignment. A transverse displacement device is used to align a lateral edge of the sheet in accordance with the measurement result of the measuring device. The acceleration and/or speed and/or angle of rotation of the drive motor for driving the rotation of the alignment cylinder can be controlled or adjusted according to predetermined laws of motion, in particular in accordance with the angle of rotation of the alignment cylinder.

EP 2516168 B1 discloses an apparatus for holding and carrying along a printing substrate for a printing press, comprising a conveyor which includes an endless belt formed by a plurality of hollow box structures extending transversely and having a flat outer face, and including means for driving the belt and means for guiding the box structures, such that the flat outer faces of the box structures that circulate over a flat, longitudinal path form a flat upper surface for holding the printing substrate, the box structures having a plurality of external openings in their outer face and at least one internal passage in their inner face opposite their outer face; and a suction device which is suitable for cooperating with the internal passages in the box structures traveling over a longitudinal suction region that corresponds to at least a part of the flat, longitudinal path, so as to generate suction through said external openings in the box structures traveling over said longitudinal suction region.

SUMMARY OF THE INVENTION

The object of the present invention is to provide a method and an apparatus for arranging sheets in a shingled position, both of which are suitable for use in a press assembly for the production of packaging materials.

This object is achieved according to the invention wherein additional blown air is blown from above onto the sheets to be transported to the transfer unit, at an acute angle that is formed with the transport plane and in a direction opposite to the transport direction of the sheets. An operating width, directed orthogonally to the transport direction of the sheets, of the blown air and acting counter to the force of gravity in the direction of the transport plane, and an operating width of the additional blown air directed opposite to the transport direction of the sheets are each adjusted, based on the width of the sheet, directed orthogonally to the transport direction of the sheets. A guide surface, in which the additional nozzles are located, is provided. These additional nozzles blow the additional air, at the acute angle formed with the transport plane and opposite the transport direction of the sheets, from above onto the sheets to be transported to the transfer unit. One of the operating width, directed orthogonally to the transport direction of the sheets, of the blown air acting counter to the force of gravity in the direction of the transport plane and the operating width of the additional blown air directed opposite the transport direction of the sheets, are each adjusted based on the width of the sheet, directed orthogonally to the transport direction of the sheets.

The advantages to be achieved by the invention are, in particular, that the proposed method is suitable for use in a press assembly for the production of packaging materials. It is preferably used in a hybrid sheet-processing press assembly, preferably in a hybrid printing press, which makes variable use of the high productivity of a conventional printing unit that prints, e.g. in an offset printing process or in a flexographic printing process or in a screen printing process, or a coating unit, in particular a varnishing unit, combined with at least one non-impact printing unit for flexibly printing variable print images, embodied, e.g. as an inkjet printer, wherein both the conventional printing unit or the coating unit, and the non-impact printing unit are used for inline production at the optimum operating speed for each device. Such a hybrid press assembly is suitable in particular for producing packaging materials, e.g. sheets for the production of folding cartons, since the strengths of each of the printing devices are utilized, resulting in a flexible and efficient production of packaging materials. In this way, printing sheets embodied, in particular, as rigid can be imprinted advantageously in a planar state and a horizontal position in a non-impact printing unit. The length of a linear transport unit can be reduced with less effort to a different number of printing couples or printing stations (color separations) and (intermediate) dryer configurations, e.g. for water-based or UV-curing printing inks or inks, than is possible with a rotary transport unit via cylinders. In addition, a constant sheet gap can be achieved between sheets of variable format lengths that are transported in immediate succession and spaced from one another by means of a linear transport unit. At the same time, transporting printing sheets by means of rotary bodies, in particular cylinders and gripper strips or gripper carriages, ensures the highest possible register accuracy with each transfer of a sheet in a gripper closure to the next processing station downstream, as is known for sheet-fed offset printing presses. This level of register accuracy typically cannot be achieved with linear sheet transport, e.g. by means of suction belt conveyors. Further advantages will be apparent from the following discussion.

BRIEF DESCRIPTION OF THE DRAWINGS

Exemplary embodiments of the invention are illustrated in the set of drawings and will be detailed in the following.

The drawings show.

DESCRIPTION OF THE PREFERRED EMBODIMENTS

Figure 1:
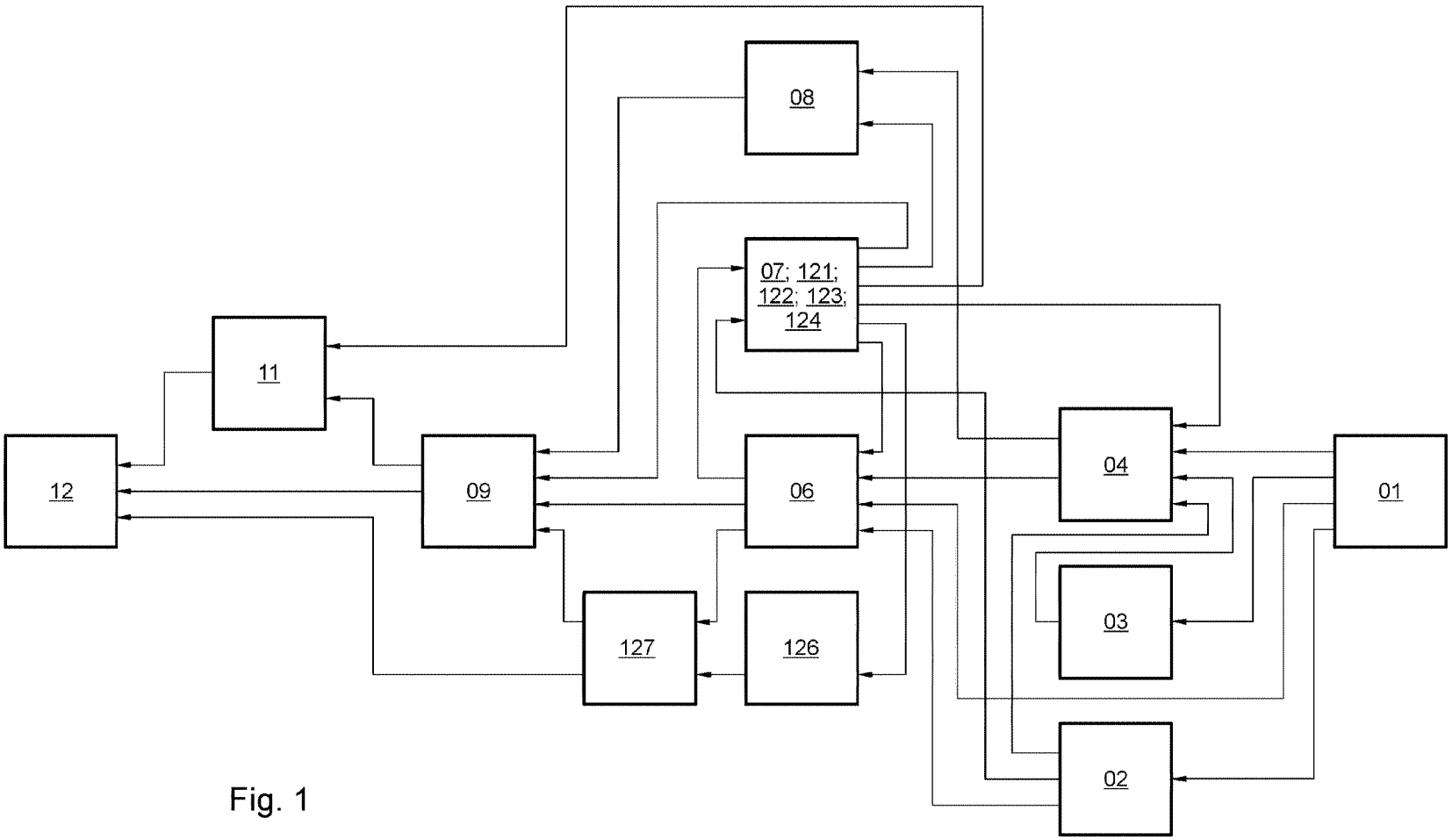
FIG. 1 a block diagram illustrating various production lines.

FIG. 1 is a block diagram of various production lines, each of which can be implemented with a press assembly having, in particular, a plurality of different processing stations 01; 02; 03; 04; 06; 07; 08; 09; 11; 12 for processing at least one sheet-type substrate, in particular a printing substrate, preferably a particularly rectangular printing sheet, or sheet for short, said at least one substrate being rigid or flexible depending on the material, the material thickness, and/or the base weight. Each of these processing stations 01; 02; 03; 04; 06; 07; 08; 09; 11; 12 is preferably configured, e.g. as an independently functional module, a module typically being understood as a separately produced or at least individually assembled press unit or functional assembly. Each processing station 01; 02; 03; 04; 06; 07; 08; 09; 11; 12 located in a given press assembly is thus preferably manufactured independently, and its functioning can be tested, e.g. individually in a preferred embodiment. The press assembly in question, which is produced by selecting and assembling at least three different sheet-processing stations 01; 02; 03; 04; 06; 07; 08; 09; 11; 12 for cooperating in a specific production run, in each case embodies a specific production line. Each of the production lines shown, which are each embodied by a specific press assembly having a plurality of processing stations 01; 02; 03; 04; 06; 07; 08; 09; 11; 12, is configured in particular for producing a packaging material made from the printing material, preferably from the printed sheet. Each of the packaging materials to be produced is, e.g. a folding carton, with each carton being produced from printed sheets. Thus, the different production lines are configured specifically for producing different packaging materials. The processing of the printing substrate that is necessary during a particular production run is carried out in each case inline, i.e. the processing stations 01; 02; 03; 04; 06; 07; 08; 09; 11; 12 that are involved in a specific production run are deployed successively in an ordered progression and in a coordinated manner as the printing substrate passes through the press assembly selected for the production run in question and including the respective processing stations 01; 02; 03; 04; 06; 07; 08; 09; 11; 12, without requiring the printing substrate, i.e. the processed sheets, to be placed in temporary storage during the production run being carried out by the press assembly in question.

A characteristic common to all the production lines shown in FIG. 1 is that each cooperates with a processing station 06 that includes at least one non-impact printing unit 06, preferably a plurality of non-impact printing units 06, e.g. four, five, six, or seven, each of which is individually controlled in particular, wherein these non-impact printing units 06 are preferably arranged one behind the other in the transport direction T of the printing substrate, and are configured such that each can print on the printing substrate at least nearly over its entire width, which is oriented transversely to the transport direction T. A non-impact printing unit 06 uses a printing method without a fixed printing forme and is capable, in principle, of printing, from one print run to the next, a print image that is different from the print image preceding it onto the printing substrate, e.g. the sheets that have just been fed to said printing device 06. Each non-impact printing unit 06 is embodied, in particular, as at least one inkjet printer or as at least one laser printer. Inkjet printers are matrix printers, in which a print image is produced by the targeted ejection or deflection of small ink droplets; inkjet printers are configured either as devices with a continuous ink jet (CIJ) or as devices that eject a single ink droplet (Drop On Demand—DOD). Laser printers generate the print image by an electrophotography process. Non-impact printing unit 06 is also referred to as a digital printing press, for example.

In the following, it is assumed by way of example that each press assembly having a plurality of processing stations 01; 02; 03; 04; 06; 07; 08; 09; 11; 12 processes a sequence of rigid sheets, in particular, e.g. composed of paper, single-ply or multi-ply paperboard, or cardboard, in particular to produce a packaging material. The substrates paper, paperboard, and cardboard differ from one another in terms of their respective grammage, i.e. the weight in grams of one square meter of said printing substrate. An aforementioned printing substrate having a grammage of between 7 $g/m^2$ and 150 $g/m^2$ is generally considered to be paper, printing substrate having a grammage of between 150 $g/m^2$ and 600 $g/m^2$ is generally considered to be paperboard, and printing substrate having a grammage of more than 600 $g/m^2$ is generally considered to be cardboard. For manufacturing folding cartons, paperboards that offer good printability and are suitable for subsequent enhancement or processing, e.g. for varnishing and punching, are used, in particular. The fibers used in these paperboards include, e.g. wood-free fibers, fibers that contain a low percentage of wood, woody fibers, and recycled paper fibers. In terms of their structure, multi-ply paperboards include a cover layer, an inner layer, and a backing layer on the back. In terms of surface finish, paperboards may be uncoated, pigmented, coated or cast-coated, for example. Sheets may be formatted, e.g. in the range of 340 mm×480 mm to 740 mm×1060 mm; in the format specifications, the first number generally indicates the length in the transport direction T of the sheets and the second number generally indicates the width of the sheets orthogonally to the transport direction T.

In the block diagram of FIG. 1, each production line that can be produced with a plurality of processing stations 01; 02; 03; 04; 06; 07; 08; 09; 11; 12 extends substantially from right to left, with each of the directional arrows that connect two processing stations 01; 02; 03; 04; 06; 07; 08; 09; 11; 12 to one another indicating a transport path to be traversed by the printing substrate and the associated transport direction T for traveling from one processing station 01; 02; 03; 04; 06; 07; 08; 09; 11; 12 to the next selected processing station 01; 02; 03; 04; 06; 07; 08; 09; 11; 12 in the press assembly specified for the production run in question. Each production run begins with sheets being provided in processing station 01, with processing station 01 being configured as a feeder device 01, e.g. as a sheet feeder 01 or as a magazine feeder 01. A sheet feeder 01 typically receives a stack of sheets, e.g. stacked on a pallet, whereas a magazine feeder 01 has a plurality of compartments into each of which sheets, in particular stacks of different types of sheets, for example, or sheets of different formats, are or at least can be inserted. Feeder 01 separates the stacked sheets, e.g. by means of a suction head 41, and guides them in a sequence of isolated sheets or in a shingle stream to the next processing station 02; 03; 04; 06 in the production run in question. The next processing station 02; 03; 04 is embodied, e.g. as a primer application unit 02 or as a cold foil application unit 03 or as an offset printing unit 04 or as a flexographic printing unit 04. The next processing station 06 may also be directly the at least one non-impact printing unit 06, for example. Offset printing unit 04 is preferably embodied as a sheet offset printing press, in particular as a sheet-fed printing press having a plurality of printing couples 86 according to the unit construction principle. Offset printing unit 04 provides the sheets with at least one static print image, i.e. a print image that is invariable during the printing process because it is bound to the printing forme used, whereas non-impact printing unit 06 provides the sheets with at least one changing or at least variable print image.

If the next processing station 03 following feeder 01 is the cold foil application unit 03, the sheet is then typically transported from there to the processing station 04 embodied as offset printing unit 04. In cold foil application unit 03, a metallized coating layer detached from a carrier film is transferred to the printing substrate. By overprinting this coating layer, e.g. by means of an offset printing unit 04, various metal effects can be achieved. Cold foil application unit 03 is advantageously integrated, e.g. into offset printing unit 04, in that two additional printing couples 87; 88 are provided in offset printing unit 04. In the first printing couple 87 in the transport direction T of the printing substrate, a special adhesive is applied to the printing substrate, i.e. the sheet, by means of a standard printing forme. A second printing couple 88 in the transport direction T of the printing substrate is equipped with a foil transfer device, which contains the coating layer to be transferred. The foil that bears the coating layer is guided from an unwinding station into a printing nip between a transfer cylinder and a printing cylinder cooperating with said transfer cylinder, and is brought into contact with the printing substrate. The coating layer is colored by an aluminum layer and a protective coating layer, the coloring of which influences the color effect. An adherent layer adheres to the imprinted layer of adhesive, and the transfer layers remain adhered to the substrate. The carrier film is then wound up again. Following the cold foil transfer, overprinting inline with conventional printing inks as well as with UV and hybrid inks is possible, in particular in offset printing unit 04, to produce different metallic color shades.

A printing substrate that is especially absorbent, for example, and/or is prepared for printing via a non-impact printing unit 06 is fed by feeder 01 to the next processing station 02, e.g. embodied as a primer application unit 02, where at least one surface of said printing substrate is coated, e.g. with a water-based primer, in particular sealing it, before it is imprinted or varnished. Priming creates an undercoat or first coat on the printing substrate, in particular to improve or enable the adhesion of the printing ink or ink that will later be applied to the printing substrate. Primer application unit 02 is associated, e.g. with a printing couple 86 of a rotary printing press and includes, e.g. a printing couple cylinder 82 that cooperates with an impression cylinder 119 and has a forme roller 83, preferably in the form of an anilox roller 83, which is or at least can be thrown onto said printing couple cylinder 82, and at least one doctor blade 84 extending in the axial direction of forme roller 83, in particular a chamber blade system 84 (FIGS. 3 to 5, 8, 27 and 28). Primer application unit 02 applies primer either to the entire surface of the printing substrate or only at specific, i.e. previously specified locations, i.e. to a portion of the substrate. The printing substrate, e.g. the sheet, processed in primer application unit 02 is then fed, e.g. to an offset printing unit 04 and/or, e.g. to a non-impact printing unit 06 as the next processing station.

The flexographic printing carried out by a processing station 04 embodied, e.g. as a flexographic printing device 04 is a direct letterpress process in which the raised areas of the printing forme are image-bearing; this process is often used for printing on packaging materials made of paper, paperboard, or cardboard, metallized foil, or plastic, such as PE, PET, PVC, PS, PP, or PC, for example. Flexographic printing uses low-viscosity printing inks and flexible printing plates made of photopolymer or rubber. In general, a flexographic printing unit 04 comprises a) an anilox roller, which inks up the printing forme, b) a printing cylinder, also called a forme cylinder, on which the printing forme is mounted, and c) an impression cylinder, which guides the printing substrate.

Processing station 04, which is embodied as a flexographic printing unit 04 or as an offset printing unit 04 that prints at least one static print image onto the sheets, preferably includes a plurality of printing couples 86, e.g. at least four, in each case, wherein each printing couple 86 preferably prints with a different printing ink, so that the printing substrate is imprinted with multiple colors, e.g. in a four-color printing process, as it passes through flexographic printing unit 04 or offset printing unit 04. The printing colors used are, in particular, the shades of yellow, magenta, cyan, and black. In an embodiment of printing device 04 that offers an alternative to the flexographic printing or offset printing method, processing station 04, which prints at least one static print image onto each of the sheets, is embodied as a printing unit 04 that prints by a screen printing method.

Once the printing substrate has been processed in the at least one non-impact printing unit 06, said printing substrate is fed, e.g. to a processing station 07 embodied as an intermediate dryer 07, wherein said intermediate dryer 07 is embodied for drying the printing substrate in question, e.g. by irradiating it with infrared or ultraviolet radiation, the type of radiation being dependent in particular on whether the printing ink or ink applied to the printing substrate is water-based or UV-curing. After intermediate drying, the printing substrate is fed to a processing station 08 embodied, e.g. as a varnishing unit 08. Varnishing unit 08 applies a dispersion varnish, for example, to the printing substrate, said dispersion varnishes consisting substantially of water and binders (resins), with surfactants as stabilizers. A varnishing unit 08 for applying a dispersion varnish to the printing substrate consists either of an anilox roller, a chamber blade, and a forme roller (similar to a flexographic printing unit), or of a dipping and forme roller. Varnishes, preferably based on photopolymerization, are applied by means of a printing forme, e.g. over the entire surface and/or a portion thereof. For full-surface varnishing, special varnishing plates made of rubber may also be used. In the transport path of the printing substrate, downstream of varnishing unit 08, a processing station 09 embodied, e.g. as a dryer 09 is provided, said dryer 09 being embodied for drying the printing substrate in question by irradiating it with infrared radiation or hot air. If the press assembly in question includes a plurality of dryers 07; 09 along the transport path of the printing substrate, the dryer labeled with reference sign 09 is preferably the last of this plurality of dryers 07; 09 in the transport direction T of the printing substrate, wherein the intermediate dryer(s) 07 and the (final) dryer 09 may be structurally identical, or may be differently configured. If a printing substrate that dries by means of ultraviolet radiation is fed to dryer 09, i.e. a printing substrate to which a printing ink or ink that cures under UV radiation or a varnish that cures under UV radiation, e.g. a gloss varnish, has been applied, said dryer 09 is equipped with a radiation source that produces ultraviolet radiation. With dispersion varnishes, more intense gloss and matt effects can be achieved than with classic oil-based varnishes. Special optical effects can be achieved by adding effect pigments to the varnish. primer application unit 02, cold foil application unit 03, and varnishing unit 08 can be combined under the term coating unit 02; 03; 08.

After drying, the printing substrate is fed, e.g. to a processing station 11 that performs further mechanical processing of the printing substrate, e.g. by stamping, creasing, and/or separating parts, in particular punching copies out of their attachment in the preferably printed sheet. Each of the aforementioned further processing operations is carried out in or by means of a processing unit 46. The mechanical further processing is preferably carried out in conjunction with a cylinder that transports the respective sheet. Afterward, or directly from dryer 09, the printing substrate reaches a delivery unit 12, which is the last processing station 12 in each of the production lines shown in FIG. 1, each of which is embodied as a specific assembly of processing stations 01; 02; 03; 04; 06; 07; 08; 09; 11; 12. In delivery unit 12, the previously processed sheets are preferably stacked, e.g. on a pallet.

The aforementioned sequence of processing stations 01; 02; 03; 04; 06; 07; 08; 09; 11; 12 arranged in the press assembly can be modified as shown in FIGS. 2 to 9 merely by way of example, in each case based on the printed product to be produced.

In the production lines shown by way of example in FIG. 1, which are used in particular for the production of packaging materials, each press assembly includes a selection from the set of processing stations 01; 02; 03; 04; 06; 07; 08; 09; 11; 12 described above. For example, the following production lines are or at least can be formed:

1. Sheet feeder 01; primer application unit 02; non-impact printing unit 06; intermediate dryer 07 with IR radiation source for dispersion varnish; varnishing unit 08; dryer 09 with IR radiation source or hot air; delivery unit 12
2. Sheet feeder 01; primer application unit 02; non-impact printing unit 06; dryer 09 with IR radiation source or hot air; delivery unit 12
3. Sheet feeder 01; primer application unit 02; non-impact printing unit 06; intermediate dryer 07 with IR radiation source; varnishing unit 08 for dispersion varnish and UV-curing varnish; dryer 09 with IR radiation source or hot air and with UV radiation source; delivery unit 12
4. Sheet feeder 01; cold foil application unit 03; offset printing unit 04; non-impact printing unit 06; dryer 09 with IR radiation source or hot air; delivery unit 12
5. Sheet feeder 01; primer application unit 02; non-impact printing unit 06; intermediate dryer 07 with IR radiation source for dispersion varnish; varnishing unit 08; dryer 09 with IR radiation source or hot air; mechanical further processing unit 11; delivery unit 12
6. Sheet feeder 01; offset printing unit 04; non-impact printing unit 06; intermediate dryer 07 with IR radiation source; mechanical further processing unit 11; delivery unit 12
7. Sheet feeder 01; non-impact printing unit 06; dryer 09 with IR radiation source or hot air; delivery unit 12
8. Sheet feeder 01; non-impact printing unit 06; intermediate dryer 07 with UV radiation source; dryer 09 with UV radiation source; delivery unit 12
9. Sheet feeder 01; non-impact printing unit 06; intermediate dryer 07 with UV radiation source; dryer 09 with UV radiation source; mechanical further processing unit 11; delivery unit 12
10. Sheet feeder 01; non-impact printing unit 06; intermediate dryer 07 with IR radiation source; offset printing unit 04; varnishing unit 08; dryer 09 with IR radiation source or hot air; delivery unit 12
11. Magazine feeder 01; primer application unit 02; non-impact printing unit 06; intermediate dryer 07 with IR radiation source; varnishing unit 08; dryer 09 with IR radiation source or hot air; delivery unit 12
12. Magazine feeder 01; primer application unit 02; non-impact printing unit 06; intermediate dryer 07 with IR radiation source; dryer 09 with IR radiation source or hot air; mechanical further processing unit 11; delivery unit 12
13. Magazine feeder 01; non-impact printing unit 06; intermediate dryer 07 with UV radiation source; varnishing unit 08; dryer 09 with UV radiation source; delivery unit 12

At least one of the processing stations 01; 02; 03; 04; 07; 08; 09; 11; 12 that cooperate with the at least one non-impact printing unit 06 is selected to participate in processing the sheets, dependent in each case upon whether the printing ink to be applied to the sheets in question, in particular by means of non-impact printing unit 06, is embodied as a water-based printing ink or ink, or as a printing ink or ink that cures under ultraviolet radiation. Each press assembly is thus configured for imprinting the sheets with a water-based printing ink or with a printing ink that cures under ultraviolet radiation.

Figure 27:
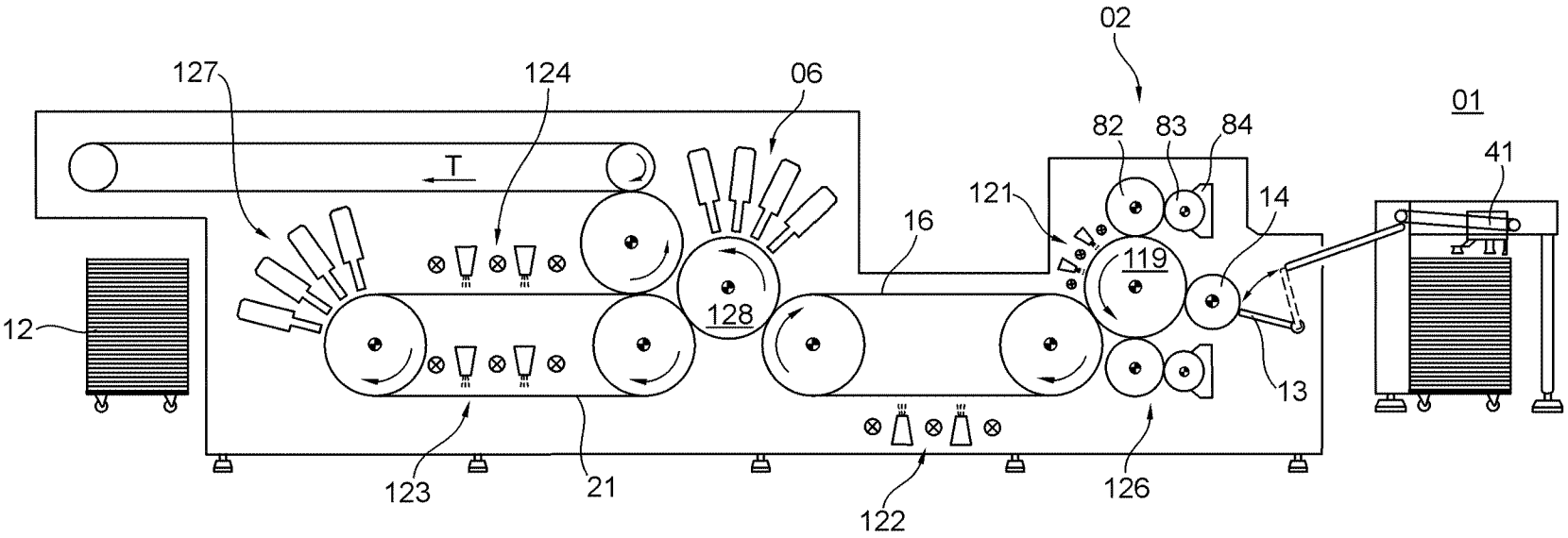
FIG. 27 a press assembly for the two-sided sequential processing of a plurality of sheet-type substrates.
Figure 28:
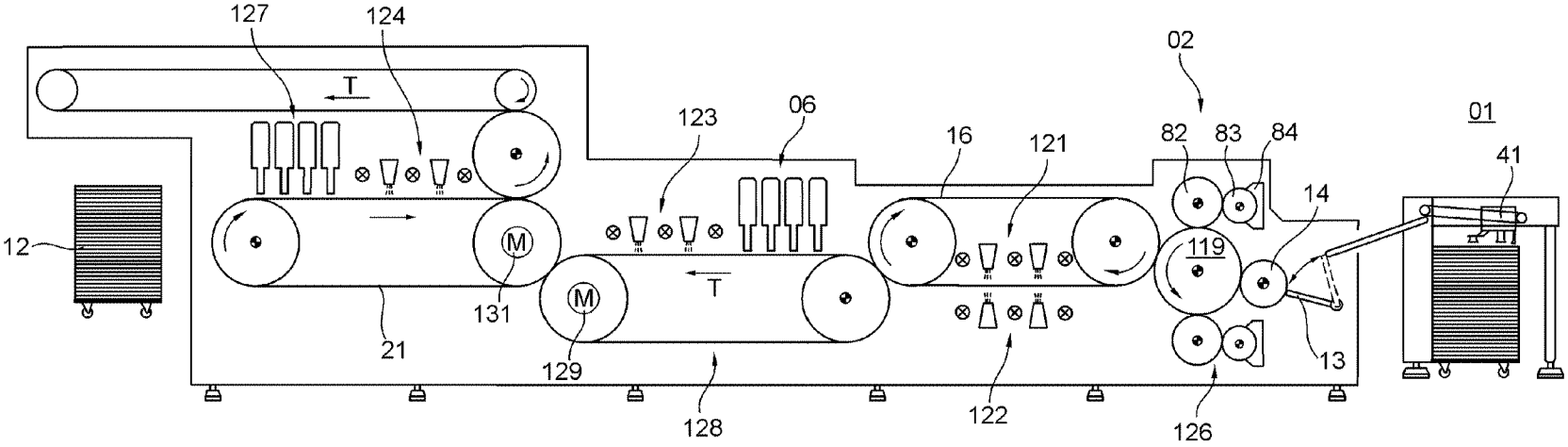
FIG. 28 a further press assembly for the two-sided sequential processing of a plurality of sheet-type substrates.

Additional press assemblies that will be detailed in reference to FIGS. 27 and 28 and that include a selection from the set of processing stations 01; 02; 03; 04; 06; 07; 08; 09; 11; 12 described above provide production lines, e.g. that include essentially the following processing stations: sheet feeder 01; first primer application unit 02; first dryer 121; first non-impact printing unit 06; second dryer 122; second primer application unit 126; third dryer 123; second non-impact printing unit 127; fourth dryer 124; delivery unit 12.

An advantageous press assembly mentioned here by way of example includes a plurality of processing stations for processing sheets, a plurality of processing stations 01; 02; 03; 04; 06; 07; 08; 09; 11; 12 being arranged one after the other in the transport direction T of the sheets for inline processing of these sheets, wherein at least one of these processing stations 06 is embodied as a non-impact printing unit 06, wherein a first processing station 01 situated upstream of non-impact printing unit 06 in the transport direction T of the sheets is embodied as a sheet feeder 01 or as a magazine feeder 01, wherein a processing station 08 located between first processing station 01 and non-impact printing unit 06 is embodied as a first coating unit 08 for applying a coating material to each of the sheets, wherein a first dryer 07 is located between first coating unit 08 and non-impact printing unit 06, wherein a first transport belt 17 is arranged so as to transport the sheets from first dryer 07 to non-impact printing unit 06, wherein a second dryer 07 is located downstream of non-impact printing unit 06 in the transport direction T of the sheets, wherein a device for transferring the sheets coming from non-impact printing unit 06 to a second coating unit 08 is provided, wherein a third dryer 09 is located downstream of second coating unit 08, and wherein a delivery unit 12 for the sheets is located downstream of third dryer 09 in the transport direction T the sheets. A further mechanical processing device 11 may additionally be located between third dryer 09 and delivery unit 12. Additionally, a coating unit 03 for applying, e.g. a cold foil is located upstream of non-impact printing unit 06 in the transport direction T of the sheets. Non-impact printing unit 06 preferably has a plurality of individually controlled inkjet printers along the transport path of the sheets. In the operating area of non-impact printing unit 06, the sheets are preferably each guided horizontally and lying flat on a transport unit 22, the transport unit 22 having a linear transport path or a curved transport path for the sheets, at least in the operating area of non-impact printing unit 06, wherein the curved transport path is formed by a concave or convex arcuate line lying in a vertical plane and having a radius of between 1 m and 10 m. In the transport direction T of the sheets, upstream of non-impact printing unit 06, a transfer unit is located, for example, wherein the transfer unit aligns each of the sheets, at least in terms of its axial register and/or circumferential register relative to the printing position of non-impact printing unit 06, wherein the transfer unit includes, e.g. a suction drum 32 that holds each of the sheets by means of suction air. This press assembly is configured in particular for imprinting the sheets with a water-based printing ink or with a printing ink that cures under ultraviolet radiation. This press assembly is configured in particular for producing various packaging materials. The device for transferring the sheets coming from non-impact printing unit 06 to second coating unit 08 is embodied, e.g. as a rocking gripper 19 and a transfer drum 31 that cooperates with rocking gripper 19.

Figure 2:
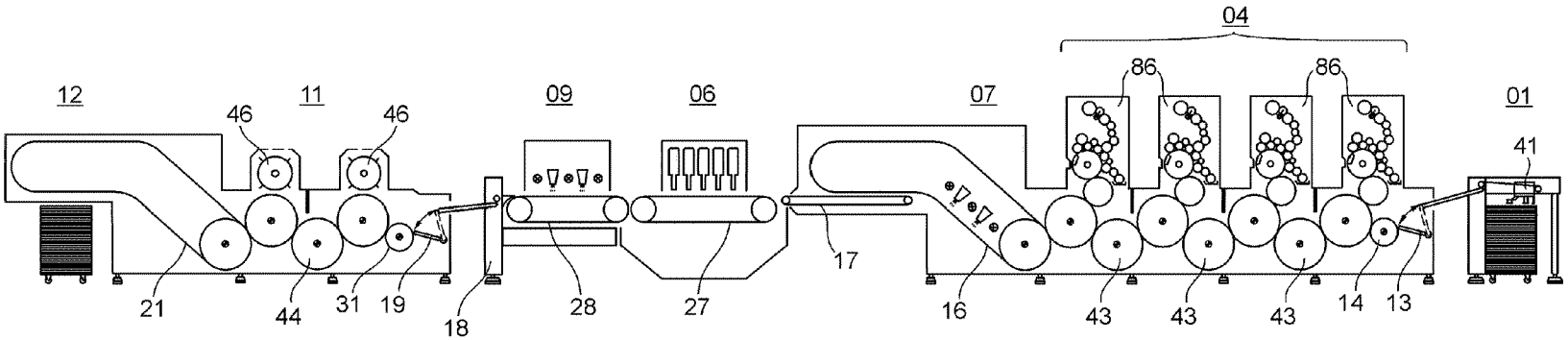
FIG. 2 a first press assembly having a plurality of different processing stations.

FIG. 2 shows, by way of example, a press assembly having a plurality of processing stations 01; 02; 03; 04; 06; 07; 08; 09; 11; 12 according to the aforementioned production line No. 6. Sheets are picked up one by one from a stack in a sheet feeder 01, e.g. by means of a suction head 41, and are transferred one after the other in a cycle of, e.g. 10,000 sheets per hour to an offset printing unit 04 having, e.g. four printing couples 86 arranged in a row. For transferring the sheets from one of the printing couples 86 arranged in a row to the next, each of the printing couples is equipped with a rotary body, in particular a cylinder, preferably a transfer drum 43, arranged in each case between two immediately adjacent printing couples 86. Using a first rocking gripper 13, for example, offset printing unit 04 takes over the sheets fed to it by sheet feeder 01 and forwards the sheets to a first transfer drum 14 of offset printing unit 04, after which the sheets are guided in a gripper closure from one printing couple 86 to the next in offset printing unit 04. In offset printing unit 04, the sheets are imprinted on at least one side. If a turning device is provided, the sheets can also be imprinted on both sides in offset printing unit 04, i.e. in a perfecting printing process. After passing through processing station 04, embodied here, e.g. as offset printing unit 04, the sheet in question, preferably imprinted in a four-color process, is transferred by means of a first gripper system 16, in particular a first chain conveyor 16 and at least a first transport belt 17, to a non-impact printing unit 06, wherein the first gripper system 16 and the first transport belt 17 cooperate in transferring the sheets to non-impact printing unit 06 in such a way that the first gripper system 16 delivers each of the sheets to the first transport belt 17, and the sheets are transferred from the first transport belt 17 to non-impact printing unit 06. Non-impact printing unit 06 preferably has a plurality of inkjet printers, e.g. five arranged linearly in a row, in particular each being individually controlled. The sheets that have been provided with at least one static print image in offset printing unit 04 and with at least one varied or at least variable print image in non-impact printing unit 06 are then dried in a dryer 07 or intermediate dryer 07, preferably with an IR radiation source. Once again, the sheets are then processed in a mechanical further processing unit 11, e.g. by stamping and/or creasing and/or punching copies out of the respective sheet. Finally, the sheets and/or the copies removed from the sheets are collected in a delivery unit 12, in particular stacked. In the operating area of the first gripper system 16 or of the first chain conveyor 16, a delivery unit 12, in particular a multi-stack delivery unit, can be provided in each case along the transport path provided for the sheets. A multi-stack delivery unit is likewise located, e.g. downstream of mechanical further processing device 11 in the transport direction T of the sheets.

Sheets that are picked up from a stack in feeder 01, in particular in sheet feeder 01, are transported individually and spaced from one another through offset printing unit 04 at a first transport speed. The sheets transferred from offset printing unit 04 to non-impact printing unit 06 are transported in said non-impact printing unit 06 at a second transport speed, with the second transport speed used in non-impact printing unit 06 generally being lower than the first transport speed used in offset printing unit 04. To adjust the first transport speed used in offset printing unit 04 to the generally lower, second transport speed used in non-impact printing unit 06, the sheet gap existing, e.g. between directly successive sheets, i.e. the spacing that results, e.g. from the gripper channel width for the sheets being transported in the gripper closure by offset printing unit 04, is preferably decreased as these sheets are transferred from offset printing unit 04 to non-impact printing unit 06, such a spacing decrease amounting, e.g. to between 1% and 98% in relation to the original spacing. Directly successive sheets are thus also transported spaced from one another in non-impact printing unit 06, but with a generally smaller sheet gap or with narrower spacing than in offset printing unit 04, and therefore also at a lower, second transport speed. This second transport speed is preferably maintained when sheets that have been imprinted in non-impact printing unit 06 are transported first to an intermediate dryer 07 or dryer 09, and from there, e.g. by means of a feed table 18, to a mechanical further processing device 11 and on to delivery unit 12. However, the sheets can also be brought from their second transport speed to a third transport speed if required, e.g. by mechanical further processing device 11, wherein the third transport speed is generally higher than the second transport speed and, e.g. again corresponds to the first transport speed that is used, in particular, in offset printing unit 04. In mechanical further processing device 11, a second rocking gripper 19 is provided, for example, which picks the sheets coming from intermediate dryer 07 or dryer 09 up from feed table 18, and transfers them, e.g. to a second transfer drum 31 located in the zone of mechanical further processing device 11, after which the sheets are transported, e.g. by means of a gripper closure, through the zone of mechanical further processing device 11. Also in the zone of mechanical further processing device 11, which has a plurality of processing units 46, for example, arranged in a row, a rotary body, in particular a cylinder, preferably a transfer drum 44, is provided for each of said processing units for the purpose of transferring the sheets from one of the processing units 46 to the next, each such rotary body being located between two adjacent processing units 46. One of processing units 46 is embodied, e.g. as a punching unit, and another processing unit 46 is embodied, e.g. as a creasing unit. Each of these processing units 46 is configured to further process the sheets mechanically, preferably in cooperation with a cylinder for transporting the respective sheets. After the sheets and/or the copies that have been removed from them have been further processed mechanically, they are transported, e.g. by means of a second chain conveyor 21, to delivery unit 12, where they are collected, preferably stacked.

Each of the sheets is transported from the output of offset printing unit 04 at least up to the output of intermediate dryer 07 or dryer 09, preferably up to the beginning of mechanical further processing device 11, by means of a multi-part transport unit 22, i.e. consisting of a plurality of assemblies, in particular transport units, arranged in succession in the transport direction T of the sheets, wherein transport unit 22 transports each sheet in a lengthwise orientation, preferably lying flat horizontally, in the transport direction T along a linear transport path, at least in the operating area of the non-impact printing unit 06 located between offset printing unit 04 and intermediate dryer 07 or dryer 09. The linear transport path and the horizontally flat transport are preferably also continued during transport of the sheets through intermediate dryer 07 or dryer 09, which are located downstream of non-impact printing unit 06. If necessary, an intermediate dryer 07 or a dryer 09 can also be arranged between offset printing unit 04 and non-impact printing unit 06.

FIGS. 3 to 8 show additional press assemblies, schematically and by way of example, each having a plurality of processing stations 01; 02; 03; 04; 06; 07; 08; 09; 11; 12, with the reference signs in each case indicating the processing stations 01; 02; 03; 04; 06; 07; 08; 09; 11; 12 detailed above and other stations in the respective units.

Figure 3:
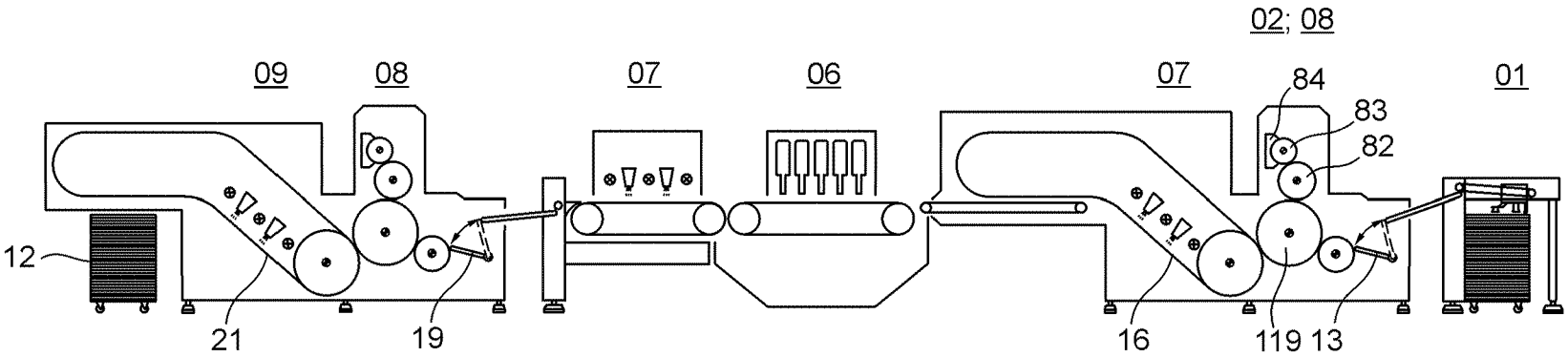
FIGS. 3 to 8 further press assemblies, each having a plurality of different processing stations.

FIG. 3 shows a press assembly having the following processing stations 01; 02; 03; 04; 06; 07; 08; 09; 11; 12 arranged one behind the other in the transport direction T of the printing substrate: sheet feeder 01; primer application unit 02 or varnishing unit 08; intermediate dryer 07; non-impact printing unit 06; intermediate dryer 07; varnishing unit 08; dryer 09; delivery unit 12.

Figure 4:
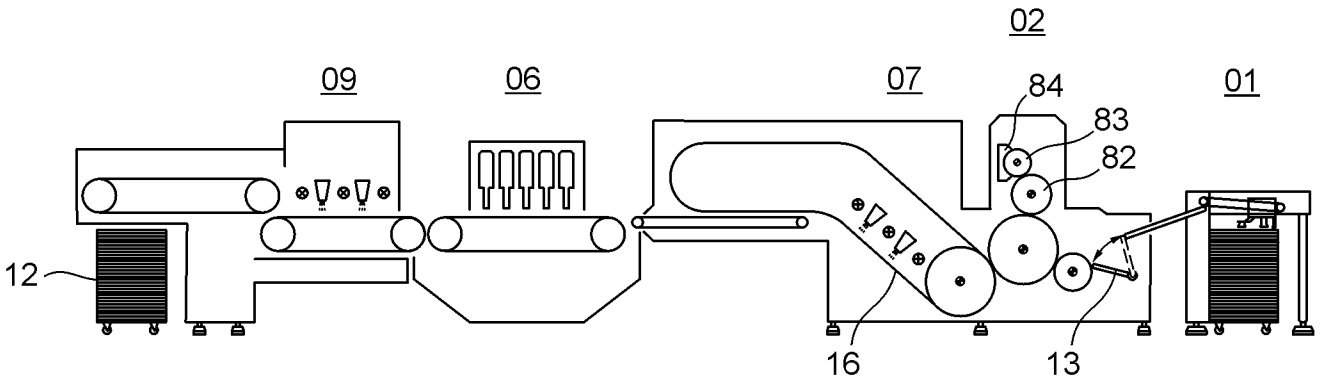

FIG. 4 shows a press assembly having the following processing stations 01; 02; 03; 04; 06; 07; 08; 09; 11; 12 arranged one behind the other in the transport direction T of the printing substrate: sheet feeder 01; primer application unit 02; intermediate dryer 07; non-impact printing unit 06; dryer 09; delivery unit 12.

Figure 5:
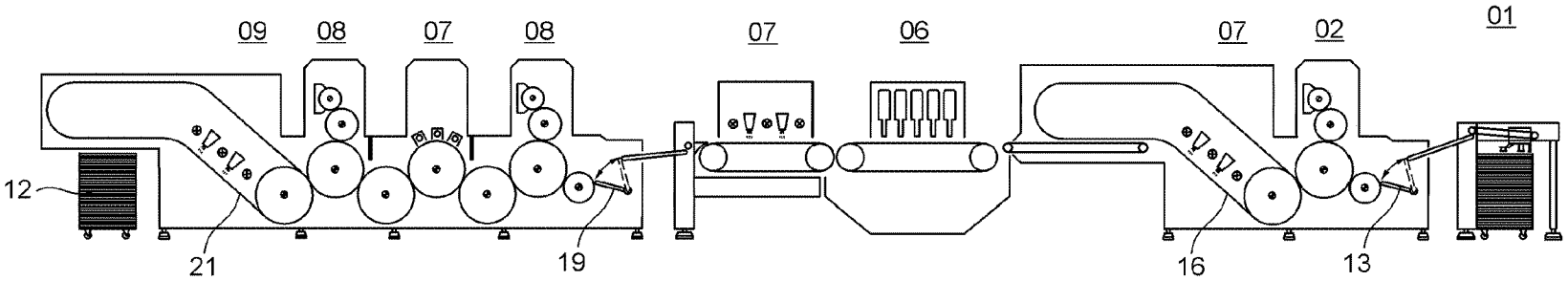

FIG. 5 shows a press assembly having the following processing stations 01; 02; 03; 04; 06; 07; 08; 09; 11; 12 arranged one behind the other in the transport direction T of the printing substrate: sheet feeder 01; primer application unit 02; intermediate dryer 07; non-impact printing unit 06; intermediate dryer 07; varnishing unit 08; intermediate dryer 07; varnishing unit 08; dryer 09; delivery unit 12.

Figure 6:
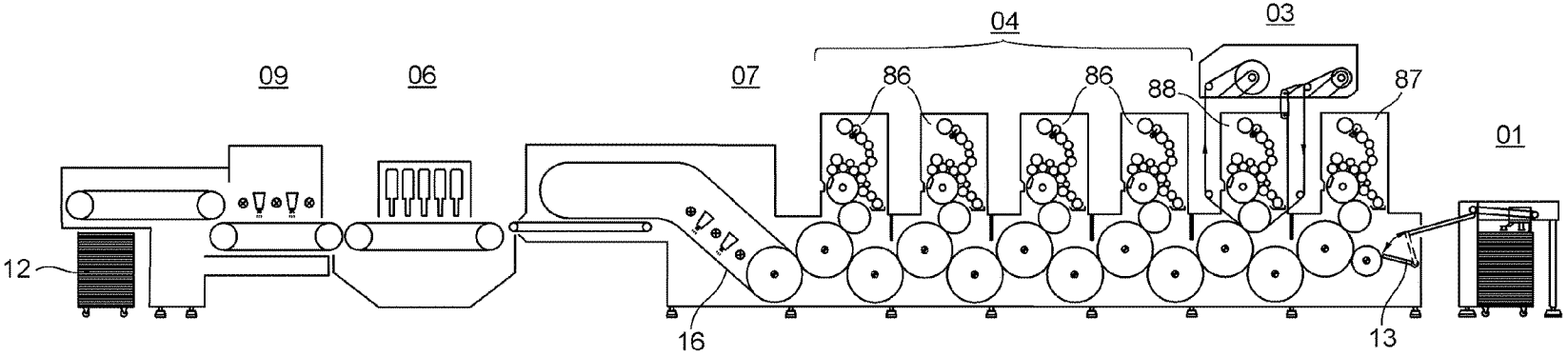

FIG. 6 shows a press assembly having the following processing stations 01; 02; 03; 04; 06; 07; 08; 09; 11; 12 arranged one behind the other in the transport direction T of the printing substrate: sheet feeder 01; a first offset printing unit 04; cold foil application unit 03; four additional offset printing units 04 according to the unit construction principle; intermediate dryer 07; non-impact printing unit 06; intermediate dryer 07; non-impact printing unit 06; dryer 09; delivery unit 12.

Figure 7:
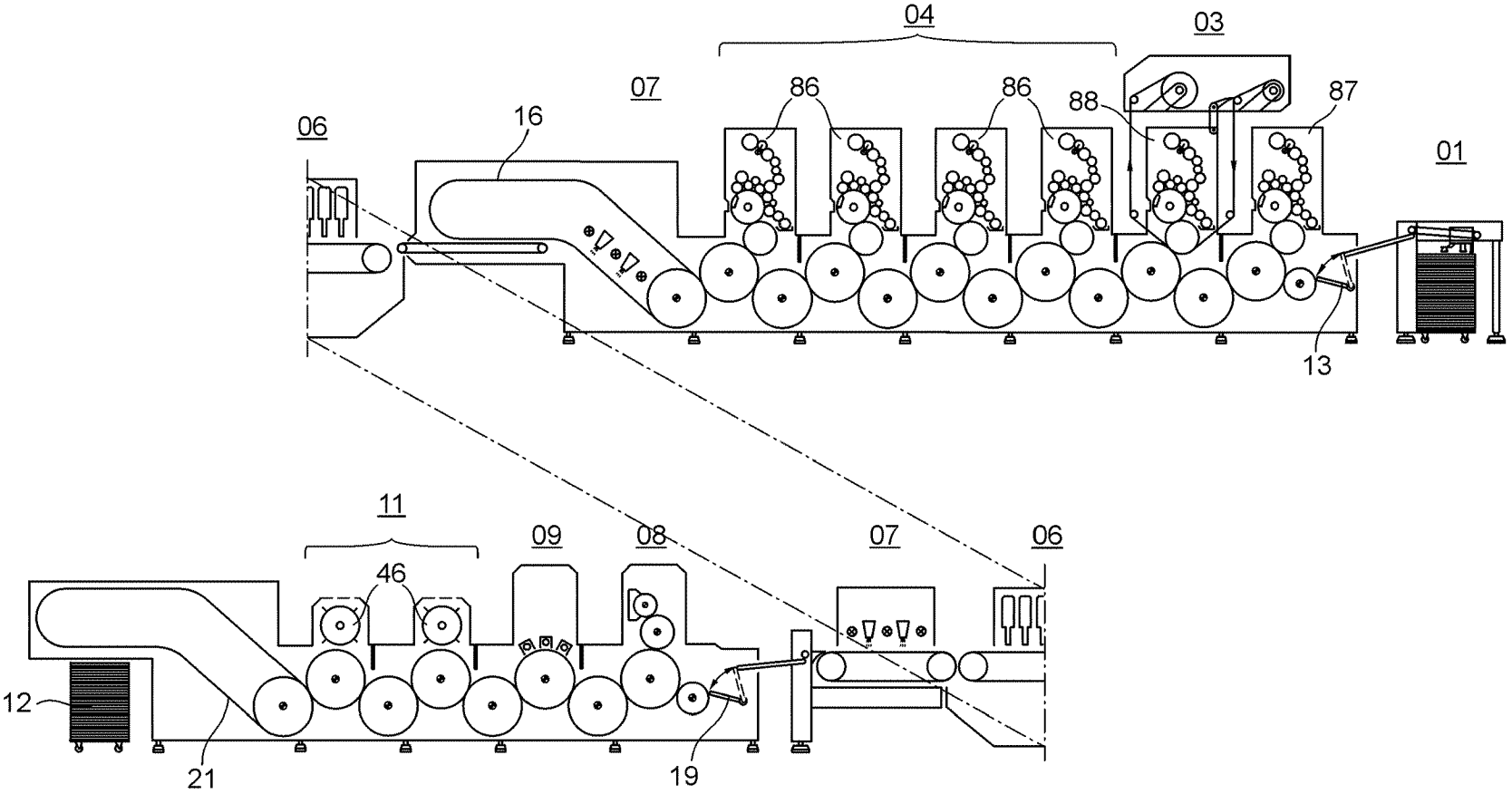

FIG. 7 shows a press assembly, represented offset in the diagram due to its length, having the following processing stations 01; 02; 03; 04; 06; 07; 08; 09; 11; 12 arranged one behind the other in the transport direction T of the printing substrate: sheet feeder 01; a first offset printing unit 04; cold foil application unit 03; four additional offset printing units 04 according to the unit construction principle; intermediate dryer 07; non-impact printing unit 06; intermediate dryer 07; varnishing unit 08; dryer 09; two mechanical further processing units 11 according to the unit construction principle; delivery unit 12.

Figure 8:
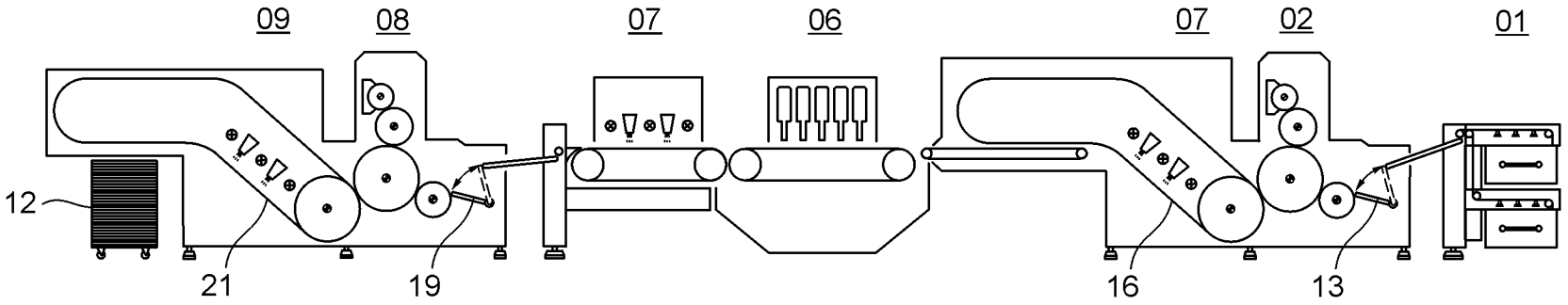
Figure 9:
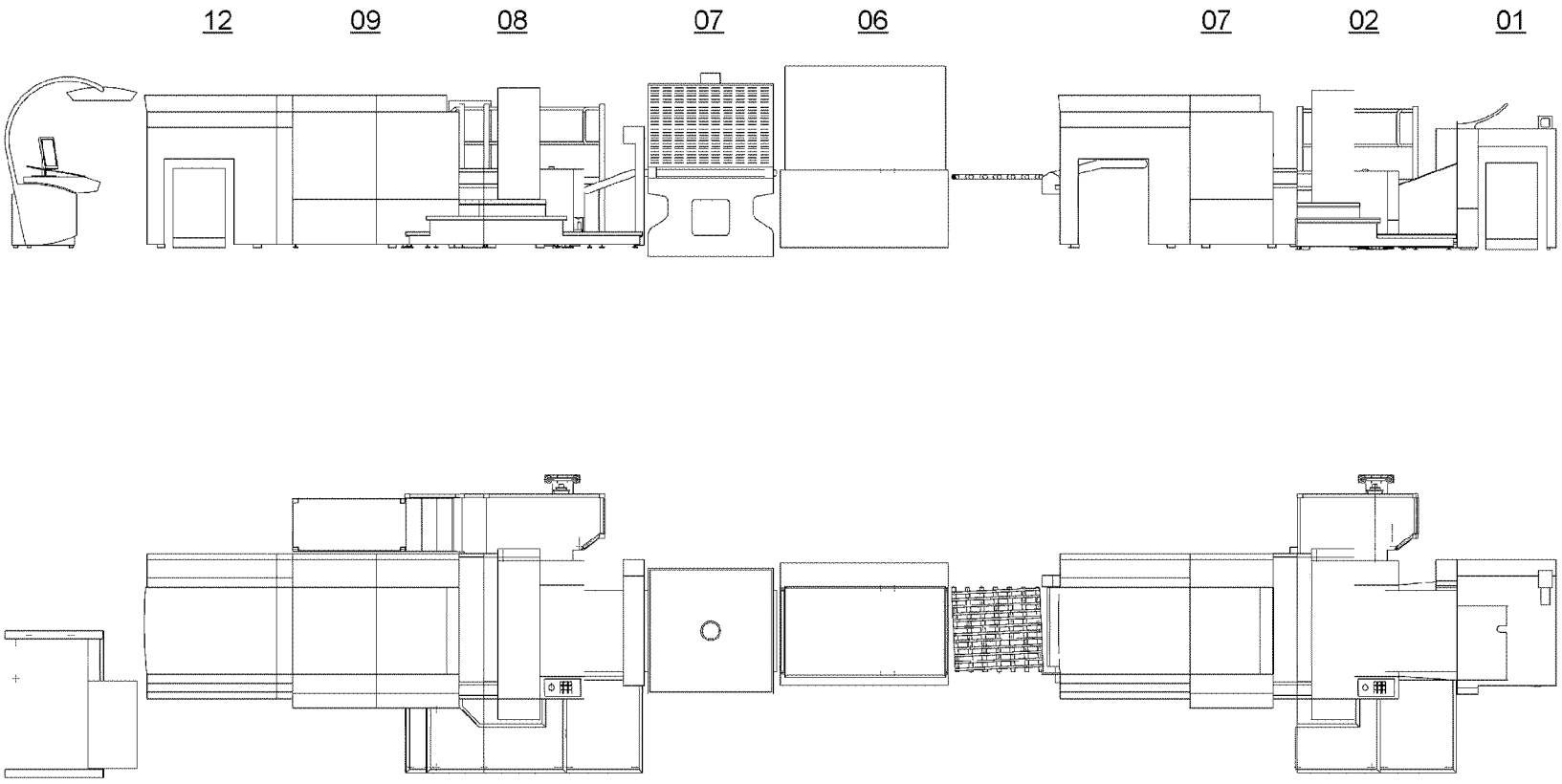
FIG. 9 the press assembly of FIG. 8 from a plan view and from a side view.

FIG. 8 shows a press assembly having the following processing stations 01; 02; 03; 04; 06; 07; 08; 09; 11; 12 arranged one behind the other in the transport direction T of the printing substrate: magazine feeder 01; primer application unit 02; intermediate dryer 07; non-impact printing unit 06; intermediate dryer 07; varnishing unit 08; dryer 09; delivery unit 12. FIG. 9 shows precisely this press assembly from a plan view and from a side view.

FIG. 10 shows, again in greater detail, the aforementioned multi-part transport unit 22, which is preferably provided for use in a press assembly having a plurality of processing stations 01; 02; 03; 04; 06; 07; 08; 09; 11; 12 for processing sheets. At the output of the processing station 04 embodied, e.g. as an offset printing unit 04, a gripper system 16, in particular a first chain conveyor 16 having at least one revolving chain, is provided, which has a plurality of gripper strips or preferably a plurality of gripper carriages 23, preferably spaced equidistant along its at least one revolving chain, wherein each of the sheets to be transported is preferably held at its leading edge in the transport direction T, i.e. at its leading edge, by one of the gripper carriages 23 and is transported along the transport path defined by the chain route. The gripper carriages 23 are each equipped with controlled or at least controllable holding means 79 for holding a sheet (FIG. 15), in particular with grippers, e.g. each in the form of a clamping device that is controllable in terms of its clamping force. The distance between successive gripper carriages 23 in the transport direction T of the sheets ranges, e.g. from 700 mm to 1,000 mm. The at least one chain of the first chain conveyor 16 turns in each case on a semicircular path, in particular, on a sprocket wheel 24 arranged at the output of offset printing unit 04. An area in which the first chain conveyor 16 receives sheets from a processing station 04 embodied, e.g. as an offset printing unit 04 forms a receiving area for this first chain conveyor 16, while an area in which the first chain conveyor 16 delivers sheets, e.g. to another transport apparatus, in particular for transport to a processing station 06 embodied as a non-impact printing unit 06, forms a transfer area for this first chain conveyor 16. A first sprocket wheel 81 located in the receiving area of the first chain conveyor 16 is preferably embodied as a drive wheel that sets the at least one chain in motion, whereas the second sprocket wheel 24 located at the output of offset printing unit 04, in particular in the transfer area of the first chain conveyor 16, is preferably embodied as a diverting wheel for diverting the at least one chain. In an area that extends approximately over the elongated length of one sheet, below the at least one sprocket wheel 24 located at the output of offset printing unit 04, in particular below the second sprocket wheel 24 located in the transfer area of the first chain conveyor 16, at least one suction chamber 26 is provided for holding a sheet that is being transported by one of the gripper carriages 23, i.e. a passing sheet. Preferably, a plurality of individually controlled or at least controllable suction chambers 26 are located there in the transport direction T of the sheet. As indicated in the reference to the above-mentioned other transport apparatus, in this area below the at least one sprocket wheel 24 located at the output of offset printing unit 04, e.g. at least one revolving first transport belt 17 in the transport direction T of the sheets is also provided for picking up and further transporting sheets that have been removed from the first chain conveyor 16, wherein the sheets that are received by this first transport belt 17 are further transported preferably in the direction of the non-impact printing unit 06.

A second revolving transport belt 27 is preferably provided in the zone of action of non-impact printing unit 06, which is arranged between offset printing unit 04 and intermediate dryer 07 or dryer 09, on which belt the sheets are transported in succession, each preferably lying flat horizontally, along a linear transport path. The transfer unit is arranged, in particular, between the first transport belt 17 and the second transport belt 27. A third revolving transport belt 28 is preferably also provided in the operating area of intermediate dryer 07 or dryer 09, on which belt the sheets received from non-impact printing unit 06 are transported in succession, each preferably lying flat horizontally, along a linear transport path. The third transport belt 28 transfers the sheets that have been transported through intermediate dryer 07 or dryer 09 to feed table 18, from which the sheets are transported, in succession, preferably to mechanical further processing device 11. First transport belt 17, second transport belt 27, and third transport belt 28 preferably transport the sheets in the same, e.g. horizontal transport plane 29, in particular embodied as a planar surface. Transport unit 22 for transporting sheets in a press assembly having processing stations, each configured for processing sheets, thus comprises at least three transport units, specifically first gripper system 16 or first chain conveyor 16, first transport belt 17, and second transport belt 27. First chain conveyor 16 and first conveyor belt 17 are arranged therein so as to cooperate with one another for transferring a sequence of sheets from a first processing station to a second processing station that preferably immediately follows the first processing station in the transport direction T of the sheets. The sequence of sheets is transferred from first transport belt 17 to second transport belt 27, which belongs to the next processing station. Preferably, a third transport belt 28 is also provided, wherein the sequence of sheets is transferred from second transport belt 27 to third transport belt 28, which belongs to a third processing station that preferably immediately follows the second processing station in the transport direction T of the sheets. If the respective transport paths of first transport belt 17 and/or of second transport belt 27, and where appropriate, of third transport belt 28 are non-linear and/or not oriented horizontally, the transport belts 17; 27; 28 of transport unit 22 each transport the sheets along a curved transport path, in particular along a concave or convex arcuate line lying in a vertical plane and having a radius of at least 1 m, preferably having a radius of between 2 m and 10 m, in particular having a radius of between 3 m and 5 m. Each of transport belts 17; 27; 28 is preferably embodied as a suction belt conveyor, i.e. as a transport belt having at least one suction chamber 26 that applies suction to each sheet during its transport. In the case of transport belts 17; 27; 28 having a plurality of suction chambers 26 along the transport path provided for the sheets, these suction chambers 26 are preferably controllable individually and/or preferably independently of one another with respect to the effect of their suction air. A plurality of individually controlled non-impact printing units 06 are preferably arranged along the curved transport path, each of the plurality of non-impact printing units 06 being embodied, e.g. as an inkjet printer. Transport belts 17; 27; 28 of transport unit 22 each consist, e.g. of a plurality of parallel individual belts arranged side by side, orthogonally to the transport path provided for the sheets, and thus each extending longitudinally along the transport path provided for the sheets. In contrast to gripper system 16, each of transport belts 17; 27; 28 is understood as a gripper-less transport apparatus, with each transport belt 17; 27; 28 being embodied as revolving endlessly between at least two diverting devices.

Figure 10:
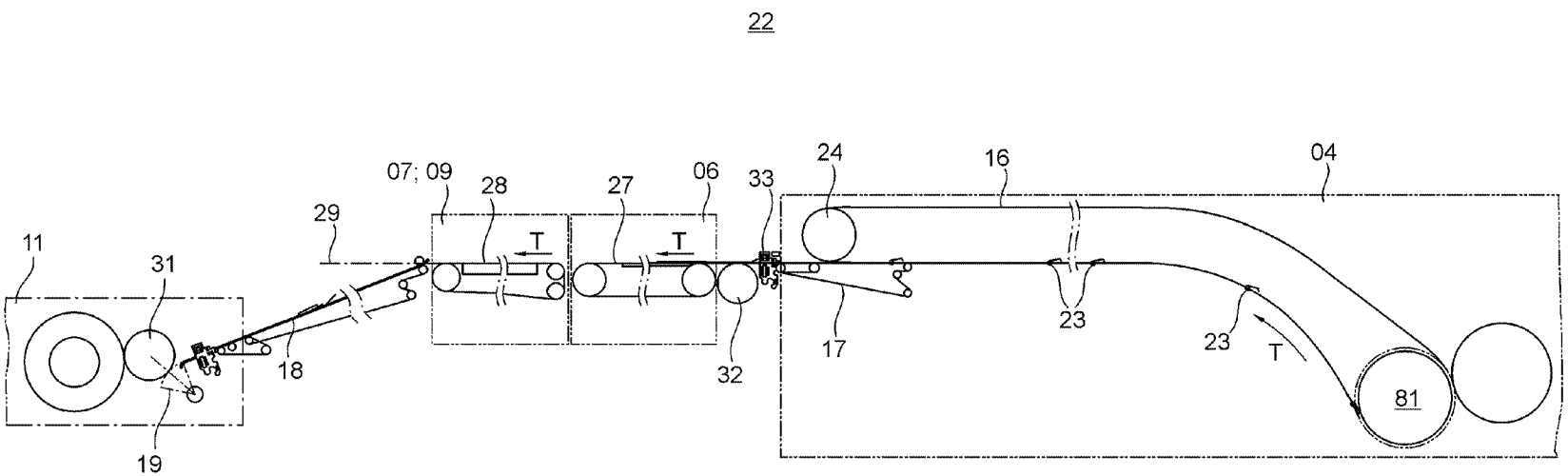
FIG. 10 a multi-part transport unit.

FIG. 11 again shows, in a detail enlargement, a number of details of transport unit 22, already described in reference to FIG. 10. In a particularly advantageous embodiment, in the area where the sheets are transferred from first transport belt 17 to second transport belt 27, a transfer unit, preferably having a suction drum 32, is provided orthogonally to the transport direction T of the sheets. Suction drum 32 preferably consists of a plurality of suction rings 76, e.g. six, arranged parallel to one another on a common shaft 89. In a preferred embodiment of suction drum 32, each of its suction rings 76 is or at least can be acted on individually by suction air, which has the advantage that the operating width of this suction drum 32 oriented in the axial direction of suction drum 32 can be or is adjusted as needed based on the sheet format that is used. On its circumference, suction drum 32 preferably has at least one stop 34 that protrudes into the transport plane 29 of the sheets, wherein a stop surface of the stop 34 in question extends in each case axially relative to suction drum 32 and preferably vertically relative to the preferably horizontal transport plane 29. Suction drum 32 has either one stop 34 that is continuous in its axial direction, or preferably two stops 34 that are spaced from one another in their axial direction. To enable the same suction drum 32 to be used for sheets of multiple different format widths, at least one stop 34 is preferably located on each suction ring 76 of a suction drum 32 having a plurality of suction rings 76. Suction drum 32 is mounted so as to be rotationally and axially movable. Suction drum 32 includes a first drive for its circumferential movement and a second drive for its axial movement, the circumferential movement and the axial movement being controlled independently of one another by a control unit. The circumferential movement and/or the axial movement of suction drum 32 are controlled by the control unit based on a position signal, which is generated by a first sensor 33, located upstream of suction drum 32 in the transport direction T of the sheets, by detecting the position of the sheet that will be next to reach suction drum 32, and is forwarded to the control unit. The job of suction drum 32 is to align the sheets that are fed to it in the proper register, and to feed these sheets in their aligned state to a further processing station, in particular to non-impact printing unit 06, so that the sheets can be further processed there. In the preferred embodiment, suction drum 32 thus aligns the respective sheets to be fed to the operating area of non-impact printing unit 06, e.g. by means of the at least one stop 34 that protrudes into the transport plane 29 of the sheet in question, and/or by means of an axial displacement of said suction drum 32 that is holding the sheets in question, to a position true to register relative to the printing position of non-impact printing unit 06. A sheet that has been gripped by suction drum 32, preferably by means of suction air, i.e. by means of negative pressure, is aligned by the axial movement of said suction drum 32, in particular laterally to its transport direction T, said movement being controlled based on the position signal generated by first sensor 33. Suction drum 32 grips an aligned sheet, in particular by means of pulsed suction air, i.e. the suction air is switched on and off again rapidly, e.g. in specific angular positions of the suction drum 32 that are preferably dependent on the transport speed and/or position of the sheets, by the control unit. The leading edge of the sheet in question is preferably aligned perpendicular to the transport direction T in the transport plane 29 by this edge striking against the at least one stop 34 of suction drum 32. Optionally, at least one lateral stop is also provided, e.g. in the transfer unit, against which stop a sheet to be aligned is pushed with an edge extending parallel to its transport direction T. First sensor 33 is embodied, e.g. as an optical sensor, in particular as a line sensor, preferably as a CCD line sensor. To generate the position signal, first sensor 33 preferably detects an edge of the sheet in question that extends lengthwise in the direction of transport T of the sheet, or detects marks located on the sheet, the marks being located within the print image on said sheet or outside of the print image in question. A second sensor 36, which is preferably located upstream of first sensor 33 in the transport direction T of the sheets, and which is preferably likewise connected to the control unit, detects, e.g. the leading edge and, where appropriate, also the number of sheets transported from first transport belt 17 to second transport belt 27. Second sensor 36 preferably detects the leading edge of each sheet in the transport direction T of the sheets and is used primarily for monitoring sheet arrival. Second sensor 36 is embodied, e.g. as an optical sensor, in particular as a reflex scanner or as a light sensor. In cooperation with suction drum 32, for example, at least one guide element 37 is provided, extending preferably linearly, in particular longitudinally along the transport path of the sheets toward the active zone of non-impact printing unit 06, i.e. toward second transport belt 27, wherein the guide element 37 in question joins with the lateral surface of suction drum 32 to form a gap into which the sheets coming from the first transport belt 17 are introduced. In the area of first transport belt 17 and where appropriate also in the area of second transport belt 27, e.g. one or more suction chambers 26 that are controllable, e.g. via the control unit are provided. Suction chambers 26 may optionally be part of transport unit 22. Incorporating at least one suction chamber 26 of first transport belt 17, in a preferred embodiment the sheet is aligned laterally by displacing suction drum 32 axially, in particular once the sheet in question has been aligned on the at least one stop 34, and the suction air in the last suction chamber 26 in the transport direction T of the sheet in question has been shut off. This lateral alignment of the sheet is overlapped temporally by the rotational movement of suction drum 32. Thus, the sheet to be transferred from suction drum 32 to a processing station 06; 07; 08; 09; 11; 12 downstream is not stationary at any time in this transfer unit. Suction drum 32 therefore aligns each of the sheets, at least in terms of its axial register and/or its circumferential register, true to register relative to a processing position of the processing station 01; 02; 03; 04; 06; 07; 08; 09; 11; 12 downstream of suction drum 32.

In a press assembly having a plurality of processing stations for processing sheets, in which a plurality of processing stations 01; 02; 03; 04; 06; 07; 08; 09; 11; 12, at least one of said processing stations 06 being embodied as a non-impact printing unit 06, are arranged in succession in the transport direction T of the sheets for the inline processing of these sheets, e.g. a first alignment unit in the transport direction T of the sheets is located upstream of the first processing station 01; 02; 03; 04; 06; 07; 08; 09; 11; 12, this first alignment unit aligning each of the sheets, at least in terms of its axial register and/or its circumferential register, true to register relative to a processing position of the first processing station 01; 02; 03; 04; 06; 07; 08; 09; 11; 12. An additional alignment unit, for example, is also located between non-impact printing unit 06 and a processing station 01; 02; 03; 04; 07; 08; 09; 11; 12 situated downstream of non-impact printing unit 06 in the transport direction T of the sheets, wherein this additional alignment unit aligns each of the sheets, at least in terms of its axial register and/or its circumferential register, true to register relative to a processing position of the processing station 01; 02; 03; 04; 07; 08; 09; 11; 12 downstream of non-impact printing unit 06.

Suction drum 32, which is located in particular in the transfer unit, is also used, e.g. for adjusting the transport speed of each of the sheets to be transferred from offset printing unit 04 to non-impact printing unit 06. Since the second transport speed used in non-impact printing unit 06 is generally slower than the first transport speed used in offset printing unit 04, suction drum 32 slows each of the sheets that are fed to it in succession at the first transport speed by offset printing unit 04 by the leading edge of the sheet striking the at least one stop 34; if necessary, suction drum 32, which is holding the sheet in question, then aligns each of the suctioned sheets at least laterally by means of an axial movement of the suction drum, i.e. in response to a corresponding position signal from the first sensor 33 indicating a need for correction, and then accelerates or decelerates the gripped sheet by rotating said suction drum 32 at the second transport speed required in non-impact printing unit 06, wherein the sheet in question, e.g. upon reaching the second transport speed, is released from suction drum 32, after which suction drum 32 is moved to its rotational and/or axial operating position that is required for gripping the next sheet. Suction drum 32 therefore preferably rotates in a non-uniform manner, e.g. in each of its revolutions. Information regarding the position of the leading edge of the sheets, required for controlling the rotational position of suction drum 32, is provided, e.g. by an angular position sensor 47 located on a sprocket wheel 24, or alternatively by an angular position sensor of offset printing unit 04, in particular of the printing press.

As mentioned above, sheets of different formats, i.e. of different lengths and/or widths, can be processed using the above-described press assemblies, each of which includes a plurality of processing stations 01; 02; 03; 04; 06; 07; 08; 09; 11; 12 for processing sheets and at least one transport apparatus for transporting these sheets. The sheets, which are generally rectangular, therefore differ, e.g. in terms of their respective length, this length extending in each case in the transport direction T of these sheets. When a processing station 02; 03; 04; 06; 07; 08; 09; 11; 12 embodied, in particular, as a non-impact printing unit 06 to which the sheets are fed sequentially is used, to avoid decreasing the productivity of the respective press assembly with relatively shorter sheets, i.e. for sheets of smaller format as compared with the otherwise larger-format sheets that are processed in said press assembly, a method having the following method steps is proposed:

A method for operating a transport apparatus that feeds a plurality of sheets sequentially to a processing station 02; 03; 04; 06; 07; 08; 09; 11; 12, in which, for processing by means of the same processing station 02; 03; 04; 06; 07; 08; 09; 11; 12, sheets of different lengths are used, each extending in the direction of transport T of said sheets, wherein each of the sheets to be fed in succession to processing station 02; 03; 04; 06; 07; 08; 09; 11; 12 is transported with spacing by the transport apparatus, wherein the transport apparatus impresses a transport speed on each of the sheets to be transported, wherein the spacing between immediately successive sheets is held constant for sheets of different lengths, each extending in the transport direction T of these sheets, by varying the transport speed that is impressed by the transport apparatus onto the sheet in question, wherein the transport speed of the subsequent sheet in the transport direction T is varied in relation to the transport speed of the sheet immediately preceding it. The sheets to be fed in succession to the processing station 02; 03; 04; 06; 07; 08; 09; 11; 12 in question are transported in each case by the transport apparatus preferably with minimal spacing, although generally not with zero spacing, in order to achieve and/or maintain a high productivity of the processing station 02; 03; 04; 06; 07; 08; 09; 11; 12. The distance between successive sheets in transport direction T, i.e. between the trailing edge of a preceding sheet, extending transversely to transport direction T, and the leading edge of the sheet immediately following said sheet, extending transversely to transport direction T, ranges, e.g. from 0.5 mm to 50 mm, and is preferably less than 10 mm. If a shorter sheet will be processed after a longer sheet in a given processing station 02; 03; 04; 06; 07; 08; 09; 11; 12, the transport apparatus will accelerate the shorter sheet by increasing its transport speed. Conversely, the transport apparatus will slow a longer sheet down by reducing its transport speed if the longer sheet will be processed after a shorter sheet in the processing station 02; 03; 04; 06; 07; 08; 09; 11; 12 in question. As the processing station 02; 03; 04; 06; 07; 08; 09; 11; 12, a non-impact printing unit 06 is preferably used, the productivity of which is generally greatest when the sheets to be printed by it are fed to it successively at a constant minimum distance, regardless of their respective format. If a processing station 04 embodied e.g. as an offset printing unit 04 is located upstream of non-impact printing unit 06 in the press assembly in question, sheets that have been printed in offset printing unit 04 are fed to the transport apparatus at a transport speed that corresponds to the production speed of said offset printing unit 04, regardless of their respective format, wherein this transport speed of said sheets defined by offset printing unit 04 is adapted during its transport by the transport apparatus to the transport speed corresponding to a processing speed of non-impact printing unit 06. If these sheets will additionally be fed spaced a constant distance from one another, regardless of their respective format, to non-impact printing unit 06, longer sheets will be slowed down less than shorter sheets, although a reduction in their respective transport speed may be necessary in any case, since the processing speed of non-impact printing unit 06 is generally lower than the production speed of offset printing unit 04.

Each sheet is held in a force-fitting manner, e.g. by suction air, as it is transported by the transport apparatus. The transport speed of each sheet is preferably applied to it in each case by suction rings 76 of a suction drum 32 acting on it or by at least one endlessly revolving suction belt 52; 78. In the preferred embodiment, the transport speed to be applied to the sheet in question is adjusted by a preferably electronic control unit, wherein the control unit performs the adjustment of the transport speed, in particular for maintaining a constant distance between successive sheets, in a control loop, as described above, e.g. in conjunction with the rotary position control of suction drum 32 or, e.g. in conjunction with a control device that will be explained in detail in the following and, e.g. optical sensors 33; 36 that are connected to said control device and will also be described.

If, with the press assemblies described above, each of which includes a plurality of processing stations 01; 02; 03; 04; 06; 07; 08; 09; 11; 12 for processing sheets and at least two transport apparatuses for transporting these sheets, flexible sheets will be transported and processed, i.e. sheets of low rigidity, in particular thin sheets that are unable to transfer pushing forces, so that pushing forces acting on such a sheet will form waves in said sheet, then it is difficult to feed such sheets to the processing station 02; 03; 04; 06; 07; 08; 09; 11; 12 in question in a set position intended for said processing station 02; 03; 04; 06; 07; 08; 09; 11; 12.

A method for sequentially feeding a plurality of sheets to a processing station 02; 03; 04; 06; 07; 08; 09; 11; 12 for processing each of these sheets is therefore proposed, in which a first transport apparatus located upstream of the processing station 02; 03; 04; 06; 07; 08; 09; 11; 12 in transport direction T of the sheets feeds each of the sheets to the processing station 02; 03; 04; 06; 07; 08; 09; 11; 12 at a first transport speed in a pushing movement, wherein the first transport apparatus holds each of the sheets being fed to the processing station 02; 03; 04; 06; 07; 08; 09; 11; 12 during the pushing movement by means of at least one holding element, wherein the sheet in question being fed to the processing station 02; 03; 04; 06; 07; 08; 09; 11; 12 is gripped by a second transport apparatus assigned to said processing station 02; 03; 04; 06; 07; 08; 09; 11; 12 and is transported in the gripped state at a second transport speed, wherein the first transport speed of the first transport apparatus is lower than the second transport speed of the second transport apparatus, wherein the holding element in question of the first transport apparatus releases the sheet in question being fed to the processing station 02; 03; 04; 06; 07; 08; 09; 11; 12 only after the second transport apparatus has gripped said sheet that has been fed to processing station 02; 03; 04; 06; 07; 08; 09; 11; 12 and has begun to transport said sheet. A non-impact printing unit 06 is preferably used as processing station 02; 03; 04; 06; 07; 08; 09; 11; 12. Each of the sheets is transported in the first transport apparatus and/or in the second transport apparatus, in particular in the same transport plane 29. A first, in particular endlessly revolving transport belt 17, for example, is used as the first transport apparatus, and/or a second, in particular endlessly revolving transport belt 27 is used as the second transport apparatus, each of these transport belts 17; 27 being embodied, e.g. as a suction belt. In an alternative embodiment of the holding elements, each of said elements is embodied as a suction ring 76 of a suction drum 32. The holding element of the first transport apparatus in question exerts a holding force on the respective sheets being fed to the processing stations 02; 03; 04; 06; 07; 08; 09; 11; 12, wherein this holding force is greater, at least briefly, than a tensile force simultaneously acting on said sheet, exerted by the second transport apparatus. The first transport apparatus preferably holds each of the sheets being fed to the processing station 02; 03; 04; 06; 07; 08; 09; 11; 12 by means of the at least one holding element, in each case preferably by a force closure, e.g. by means of suction air. By means of the proposed method, the sheet to be fed to the processing station 02; 03; 04; 06; 07; 08; 09; 11; 12 is subjected to tensile stress and is thereby straightened in spite of the pushing movement carried out by the first transport apparatus. After the actual position of each sheet in transport plane 29 has been checked and, if the actual position deviates from a set position specified for the sheet in question in the processing station 02; 03; 04; 06; 07; 08; 09; 11; 12, after a position correction to the specified set position has been performed, each of the sheets is preferably transferred to the second transport apparatus.

Figure 12:
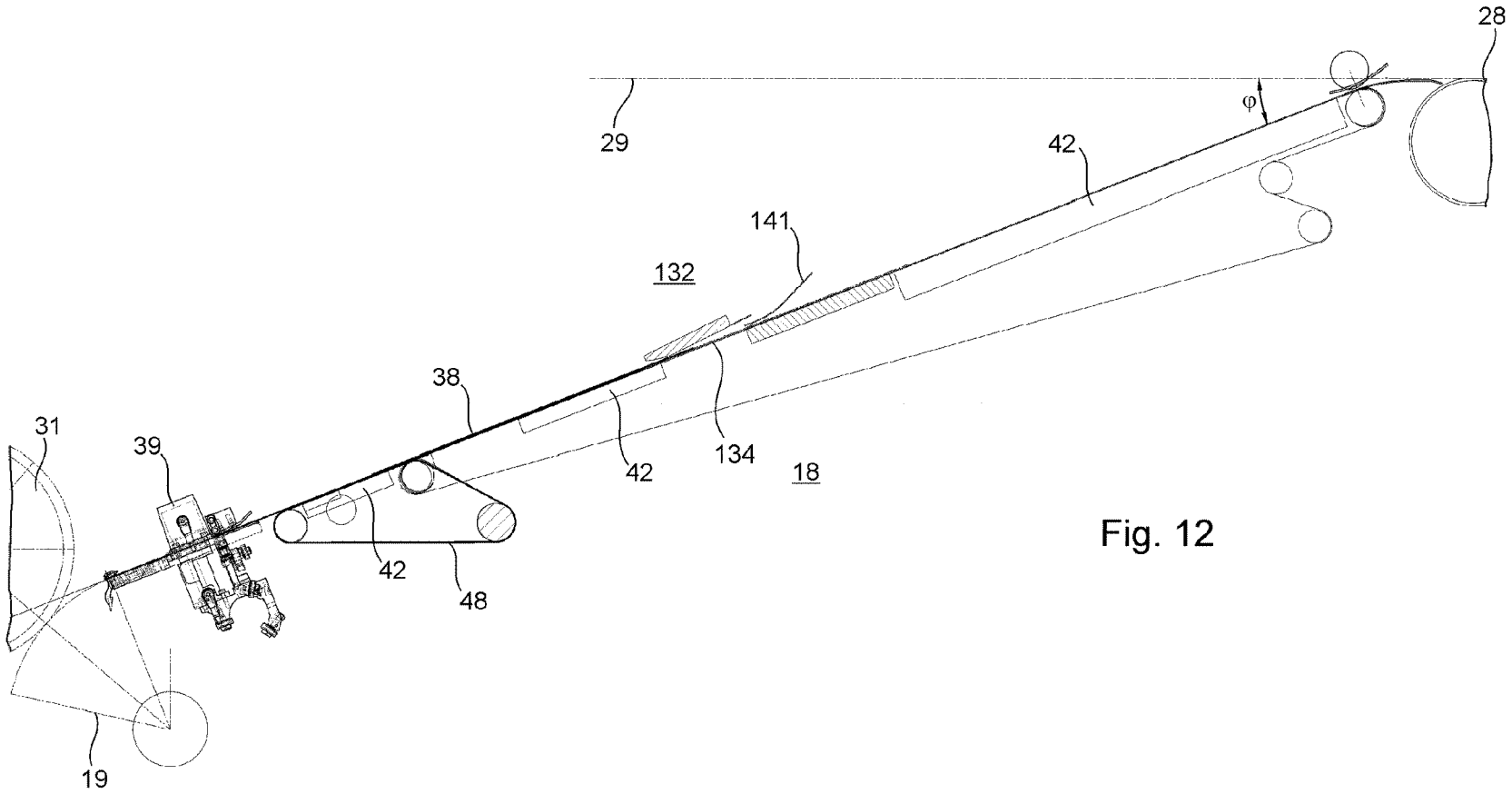
FIG. 12 an enlarged view of a second detail from FIG. 10.

FIG. 12 shows an enlarged detail from FIG. 10 illustrating the transfer of the sheets on feed table 18, in particular from third transport belt 28 in the operating area of intermediate dryer 07 or dryer 09 to the operating area of mechanical further processing device 11. Feed table 18 includes, e.g. at least one fourth transport belt 38, which is preferably inclined at an acute angle φ from the preferably horizontal transport plane 29. Connected to the fourth transport belt 38, e.g. a third sensor 39 is also provided, which generates a position signal for each of the sheets being transported by means of the fourth conveyor belt 38 and forwards it to the control unit. It can be provided, e.g. that a sheet to be fed to mechanical further processing device 11 is brought from the second transport speed to the third transport speed by second rocking gripper 19 and second transfer drum 31, which means that the sheet in question is accelerated in particular by the rotation of second transfer drum 31, which is controlled by the control unit. Also provided in the area of fourth transport belt 38 are, e.g. one or more preferably controllable suction chambers 42. In a preferred embodiment, on the unit for transferring the sheets, e.g. to mechanical further processing device 11, the sheets are shingled. In said shingling, the rear area of a sheet being transported by fourth transport belt 38 is raised by means of pulsed blown air and is decelerated by fourth transport belt 38 in conjunction with suction chamber 42. A subsequent sheet is then drawn underneath the sheet preceding it by belt conveyor 48, which is traveling at a faster speed.

At the unit for transferring the sheets, e.g. to mechanical further processing device 11, a method for arranging sheets in a shingled position is therefore carried out in a transfer unit located between a first processing station 01; 02; 03; 04; 06; 07; 08; 09; 11; 12 and a second processing station 01; 02; 03; 04; 06; 07; 08; 09; 11; 12 that follows the first processing station in the transport direction T of the sheets, in which the sheets to be shingled are transported in succession, each lying individually in a transport plane 29, from the first processing station 01; 02; 03; 04; 06; 07; 08; 09; 11; 12 to the transfer unit, in which a trailing edge in the transport direction T of each of the sheets coming from the first processing station 01; 02; 03; 04; 06; 07; 08; 09; 11; 12 is raised relative to transport plane 29 solely by means of blown air, and a subsequent sheet is pushed underneath the trailing edge of the sheet preceding it in each case. In said process, the blown air preferably acts with at least 50% of its intensity counter to the force of gravity, in a plane perpendicular to transport plane 29. Advantageously, it is provided that additional air is blown counter to the transport direction T of the sheets, substantially tangentially, at an acute angle formed with the transport plane 29, in the range of, e.g. 0° to 45°, from above, i.e. onto the surface of the sheets facing away from transport plane 29, onto the sheets being transported to the transfer unit. The additional blown air directed opposite the transport direction T of the sheets comes from a guide surface that forms an acute angle with the convergent transport plane 29 ranging, e.g. from 0° to 45°, wherein, in particular, nozzles for emitting the blown air are arranged in the guide surface. The blown air acting counter to gravity in the direction of transport plane 29 is preferably pulsed by the control unit. Each sheet to be transported from the first processing station 01; 02; 03; 04; 06; 07; 08; 09; 11; 12 to the subsequent second processing station 01; 02; 03; 04; 06; 07; 08; 09; 11; 12 is held in transport plane 29 by means of suction air, preferably acting on the leading half of the sheet in transport direction T. The suction air holding the sheet being transported in transport plane 29 from the first processing station 01; 02; 03; 04; 06; 07; 08; 09; 11; 12 to the second processing station 01; 02; 03; 04; 06; 07; 08; 09; 11; 12 downstream is preferably pulsed by the control unit. In the preferred embodiment, the control unit is used to adjust the operating width, directed orthogonally to transport direction T of the sheets, of the blown air acting counter to gravity in the direction of transport plane 29 and/or the operating width of the additional blown air directed opposite transport direction T of the sheets, and/or the operating width of the suction air holding the sheet to be transported in transport plane 29 from the first processing station 01; 02; 03; 04; 06; 07; 08; 09; 11; 12 to the second processing station 01; 02; 03; 04; 06; 07; 08; 09; 11; 12 downstream, in each case based upon the width of the sheet oriented orthogonally to transport direction T of the sheet. In that case, the adjustment of the operating width of the blown air acting in the direction of transport plane 29 counter to the force of gravity, and of the additional blown air directed opposite the transport T of the sheets, and of the suction air holding the sheet to be transported in transport plane 29 from the first processing station 01; 02; 03; 04; 06; 07; 08; 09; 11; 12 to the second processing station 01; 02; 03; 04; 06; 07; 08; 09; 11; 12 downstream, is carried out, coupled mechanically or electrically in each case, e.g. by a gearing mechanism, by means of a single displacement device. This displacement device is controlled by the control unit, e.g. automatically, in each case based on the format of the sheets to be transported from the first processing station 01; 02; 03; 04; 06; 07; 08; 09; 11; 12 to the second processing station 01; 02; 03; 04; 06; 07; 08; 09; 11; 12 downstream.

For shingling the sheet-type substrates, in particular the sheets 51, each preferably embodied as a printed sheet, an apparatus for shingling sheets 51, also referred to in the following as shingling unit 132, is provided in the area, i.e. the operating area, of the transfer unit provided, in particular, in one of the above-described press assemblies (FIGS. 1 to 9), on which sheets 51 coming, in particular, from an offset, flexographic, or non-impact printing unit 04; 06 are forwarded, e.g. to mechanical further processing unit 11. A plurality of sheets 51 are fed to shingling unit 132 individually in succession, i.e. spaced from one another, on a feed table 134, the feed table 134 being embodied, e.g. as feed table 18 located upstream of delivery unit 12 for sheets 51 in transport direction T of sheets 51 (FIG. 12), wherein feed table 18 feeds the sheets 51, e.g. by means of transport belt 38, in succession to shingling unit 132, and/or wherein the sheets 51 that have been shingled by shingling unit 132 are transferred from delivery table 18, e.g. by means of a rocking gripper 19, e.g. to a transfer drum 31. Feed table 134 has, e.g. a suction chamber 42, or a plurality of suction chambers 42 one behind the other in transport direction T of sheets 51, the pressure of which can be controlled individually and independently of the others, as is also shown, e.g. in FIG. 12.

Figure 30:
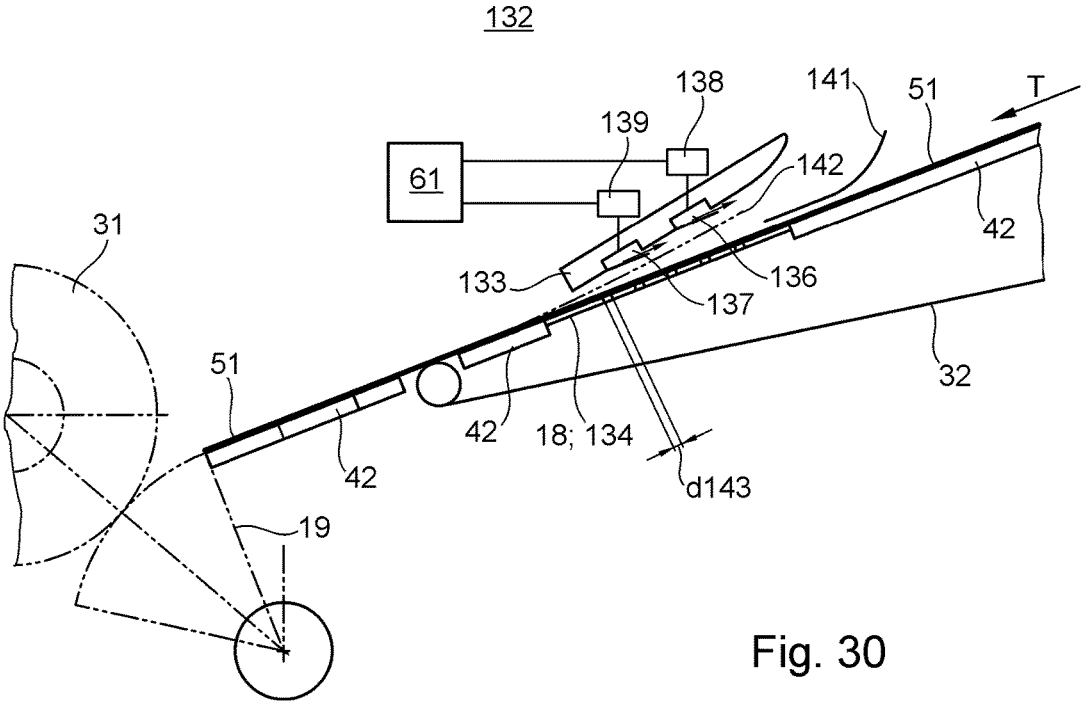
FIG. 30 a shingling device.
Figure 31:
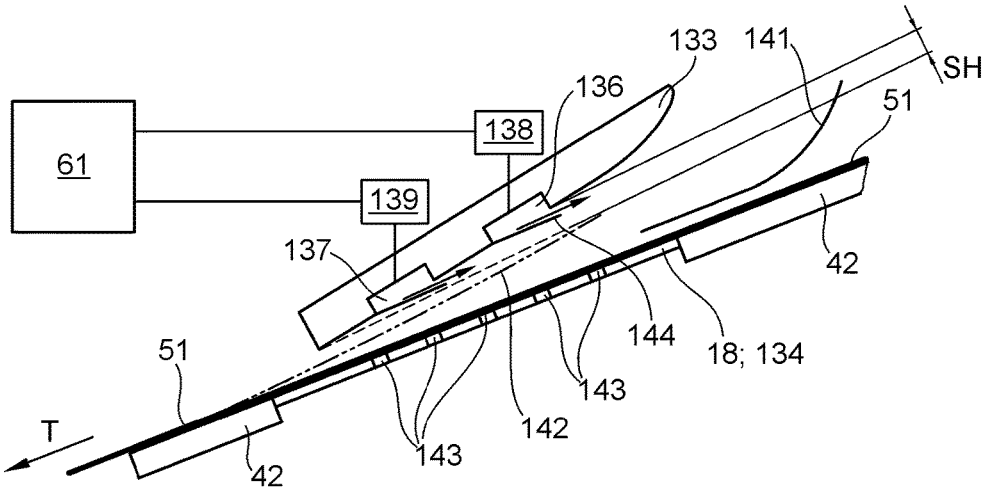
FIG. 31 a detail enlargement from FIG. 30.

Shingling unit 132 is shown by way of example in FIGS. 30 and 31. Above feed table 134, shingling unit 132 has a box-shaped housing, the so-called blower chamber 133, that preferably extends over the entire width b51 of sheets 51, wherein in the blower chamber 133, on the side thereof that faces feed table 134, a plurality of blow nozzles 136; 137 are arranged one after the other in transport direction T of the sheets 51 that are fed individually to shingling unit 132. In the preferred embodiment, at least two rows of a plurality of blow nozzles 136; 137 arranged side by side, i.e. blow nozzle rows, are arranged one behind the other in transport direction T of the sheets 51, and each transversely to transport direction T of the sheets 51. A blowing direction of each of blowing nozzles 136; 137 is directed substantially parallel to feed table 134 opposite the transport direction T of the sheets 51, and is indicated in FIGS. 30 and 31 by directional arrows. The blowing direction of each of blowing nozzles 136; 137 is determined, e.g. by means of at least one guide surface 144, which channels the flow of the blown air and is located and/or formed on each of the blow nozzles 136; 137 in question. The guide surface 144 in question is formed on the side of blower chamber 133 that faces the feed table 18; 134, e.g. as a ramp protruding from said blower chamber 133. Blown air flowing out of each of blow nozzles 136; 137 is preferably controlled, e.g. in terms of time and/or intensity, by adjustable valves 138; 139, wherein valves 138; 139 are or will be controlled, e.g. by a preferably digital control unit 61 that processes a program. Valves 138; 139 are switched, e.g. by control unit 61 in particular in a cycle, wherein the duration of one cycle and/or the frequency of one cycle preferably is or are adjusted on the basis of the feed rate of sheets 51 being fed to shingling unit 132.

In transport direction T of sheets 51, in an area between feed table 18; 134 and the side of blowing chamber 133 that faces said feed table 18; 134, upstream of the first blowing nozzle 136 or the first row of blowing nozzles, a baffle plate 141 is located, wherein the baffle plate 141 shields the leading edge of a sheet 51 directly following a sheet 51 that has been raised by the blown air from at least one of the blowing nozzles 136; 137, against the suction generated by the blowing nozzles 136; 137 located in the blowing chamber 133. The sheet 51 that is raised off of feed table 18; 134 by at least one of blowing nozzles 136; 137 or rows of blowing nozzles channels the blown air flowing from the at least one blowing nozzle 136; 137 and conducts this blown air over the surface of baffle plate 141 that faces blowing chamber 133. At its end located in the blowing direction, baffle plate 141 preferably has a concave curvature, and this curvature gives the blown air a flow direction away from feed table 18; 134, i.e. directed outward. As a result of baffle plate 141, the leading edge of sheet 51, which directly follows a sheet 51 that has been raised by the blown air from at least one of blowing nozzles 136; 137, remains unaffected until the trailing end of raised sheet 51 has passed over the blowing nozzle 136 or row of blowing nozzles first reached by said sheet 51 by way of its own forward advancement or feed directed in transport direction T. To prevent the leading edge of the sheet 51 that directly follows a sheet 51 that has been raised by the blown air from at least one of blowing nozzles 136; 137 from being raised prematurely by the action of the blowing nozzle 136; 137 or row of blowing nozzles that has been uncovered by the trailing end of the preceding sheet 51, the blown air of the blowing nozzle 136; 137 or row of blowing nozzles in question is switched off by means of the respectively associated valve 138; 139, on the basis of the forward advancement or feed of the sheet 51 that is currently raised off of feed table 18; 134, and that directly precedes a sheet 51 that is located between baffle plate 141 and feed table 18; 134. A sheet 51 that has been raised by the blowing nozzles 136; 137 or rows of blowing nozzles is raised by the suction (Venturi effect) generated by the blown air in question to a certain float height SH above feed table 18; 134, e.g. by a distance from the side of blowing chamber 133 that faces feed table 18; 134, the float height SH being dependent on the intensity of the blown air in each case and/or on the mass of the sheet 51 in question and/or on the transport speed of sheet 51 in question. To prevent sheets 51, e.g. of great mass and/or high transport speed, from vibrating and fluttering as they are transported over feed table 18; 134, a support plate 142 for supporting the raised sheet 51 is preferably provided in the area between feed table 18; 134 and the side of blowing chamber 133 that faces said feed table 18; 134, wherein the support plate 142 located, e.g. at an acute angle in relation to the side of blowing chamber 133 that faces feed table 18; 134 is embodied, e.g. in the form of an air-permeable grate. Sheet 51, which has been raised by the suction of the blown air and has been placed on support plate 142, is guided there in its transport direction T along this support plate 142 in a smooth movement, i.e. without fluttering. In feed table 18; 134, at least in an area opposite blowing chamber 133, a plurality of holes 143 or openings are preferably provided, through which air flows beneath the currently raised sheet 51 for the purpose of pressure equalization. These holes 143 are embodied, e.g. as circular, having a diameter d143 in the range of a few millimeters.

Figure 13:
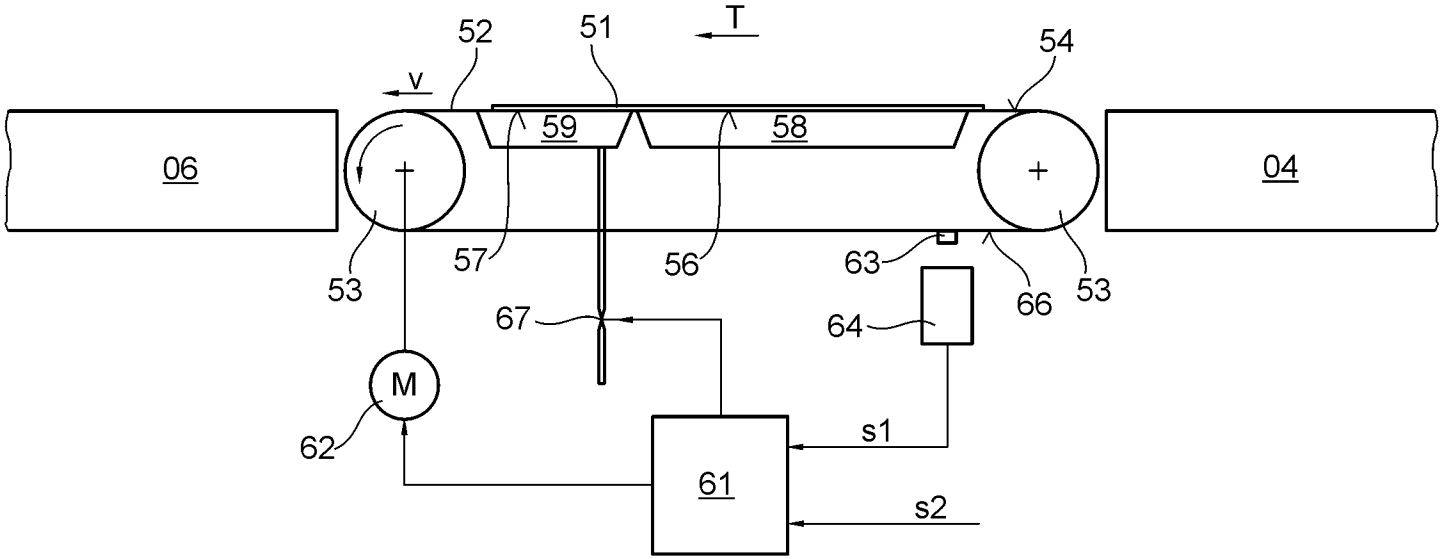
FIG. 13 a schematic diagram of a transport apparatus for the sequential transport of individual sheet-type substrates.

FIG. 13 schematically shows, in a simplified illustration and by way of example, a transport apparatus for the sequential transport of individual sheet-type substrates, each of these substrates preferably being embodied as a sheet 51, in particular a printed sheet. This transport apparatus is preferably located between two successive processing stations 01; 02; 03; 04; 06; 07; 08; 09; 11; 12 of a press for processing sheets 51, one of these processing stations 01; 02; 03; 04; 06; 07; 08; 09; 11; 12, e.g. the second processing station in transport direction T of sheet 51 in question, being embodied, in particular, as a non-impact printing unit 06, preferably as at least one inkjet printing unit. The transport apparatus described in reference to FIG. 13 is embodied as an assembly for transporting sheets 51, e.g. within one of the above-described production lines, and corresponds, e.g. with the above-described transport belt having position number 17 or 27.

The transport apparatus described in reference to FIG. 13 for the sequential transport of individual sheet-type substrates includes at least one endlessly revolving suction belt 52, the at least one suction belt 52 being located, e.g. between at least two deflection rollers 53 arranged spaced from one another. The at least one suction belt 52 includes, in the transport direction T of sheet 51 indicated by an arrow in FIG. 13, two surface areas configured differently from one another and arranged one in front of the other, wherein surface 56 of one of these surface areas is embodied as closed, and surface 57 of the other of these surface areas is embodied as perforated. These two surface areas alternate along the periphery of suction belt 52, i.e. they are arranged alternating in the direction of rotation of suction belt 52 in question, and thus in transport direction T of sheet 51. During its transport, sheet 51 to be transported is arranged lying flat, partly on the closed surface 56 of suction belt 52 in question and partly on the perforated surface 07 of the same suction belt 52. In transport direction T of the sheet 51 to be transported by the at least one suction belt 52, at least two suction chambers 58; 59 are located one behind the other, wherein the at least one suction belt 52 is moved relative to these at least two suction chambers 58; 59, which are arranged stationary in relation to the transport apparatus. The at least one suction belt 52 slides, e.g. over a preferably table-shaped surface 69 of at least one of these suction chambers 58; 59. The first suction chamber 58 in transport direction T of sheet 51 to be transported is located in the area of a tight span 54 of the suction belt 52 in question, whereas the second suction chamber 59, in transport direction T of the sheet 51 to be transported, is located either also in the area of tight span 54 of the suction belt 52 in question, downstream of the first suction chamber 58 in the transport direction T of sheet 51 to be transported, or downstream of the area of tight span 54 of the suction belt 52 in question in the transport direction T of the sheet 51 to be transported, i.e. downstream of suction belt 52 in question in the transport direction T of the sheet 51 to be transported. A span is a free, unsupported section of a running, preferably endlessly revolving pulling element, wherein the pulling element is embodied, e.g. as a chain, cable, strip, or belt, in particular as a toothed belt. If the pulling element is embodied as a chain, the at least one chain is guided, e.g. in a chain track. The tight span is the side of the pulling element that is pulled on and is taut, whereas the slack span is the loose span that is not pulled on and sags.

FIG. 13 shows by way of example the first variant of the location of the second suction chamber 59. In this case, the first suction chamber 58 in the transport direction T of sheet 51 generally has a very much larger volume than the second suction chamber 59 in the transport direction T of sheet 51, in particular at least twice as large. As sheet 51 is being transported, a negative pressure prevailing in the first suction chamber 58 in transport direction T of sheet 51 to be transported is permanently present, and a negative pressure prevailing in the second suction chamber 59 in the transport direction T of sheet 51 in question is pulsed, i.e. this negative pressure is switched on and off alternatingly, each for an adjustable period of time. The second suction chamber 59 in transport direction T of sheet 51 therefore has a relatively small volume, to allow a negative pressure to be built up in it more quickly in light of the applicable transport speed for the sheets 51 of, in particular, several thousand, e.g. 10,000 to 18,000 sheets 51 per hour, and to allow a higher pulse rate to be achieved in the second suction chamber 59 in terms of the build-up and reduction of pressure. During its transport, this sheet 51 is then suctioned onto the at least one revolving suction belt 52 when the perforated surface 57 of the suction belt 52 in question is functionally connected to at least one of the suction chambers 58; 59 to which negative pressure is applied. In a highly advantageous embodiment of this transport apparatus, a pulsation of the negative pressure of the second suction chamber 59 in transport direction T of the sheet 51 is synchronized with a passage over the perforated surface 57 of suction belt 52 in question by sheet 51 to be transported.

A revolution speed v of suction belt 52 in question is adjusted by the preferably digital control unit 61 for processing a program with a drive 62 that sets this suction belt 52 into motion. This control unit 61 preferably also controls or adjusts the aforementioned synchronization of the negative pressure in the second suction chamber 59 in transport direction T of sheet 51 with the passage over perforated surface 57 of this suction belt 52 by the sheet 51, e.g. by means of a valve 67. The preferably controllable valve 67 is located, e.g. in a line that connects second suction chamber 59 to a pump (not shown), which is controlled, e.g. by control unit 61. Drive 62, which is preferably embodied as an electric motor, acts, e.g. on at least one of deflecting rollers 53. Drive 62, which sets the revolution speed v of the suction belt 52 in question, is preferably controlled by control unit 61. Control unit 61 preferably sets a discontinuous revolution speed v of the suction belt 52 in question, i.e. the revolution speed v of the suction belt 52 in question is accelerated or decelerated in phase, deviating from an otherwise uniform speed, based on the control of drive 62.

At least one register mark 63 is located in at least one position on the suction belt 52 in question. A sensor 54 that detects the register mark 53 in question is provided in conjunction with the transport apparatus and is connected to control unit 61. The revolution speed v of the suction belt 52 in question is thereby preferably adjusted by control unit 61 on the basis of a difference, determined, e.g. by control unit 61, between a first signal s1, generated by sensor 64, that corresponds to an actual revolution speed, and a second signal s2 that corresponds to a set revolution speed. The second signal s2, which indicates the set revolution speed of the revolving suction belt 52 in question, is picked up, e.g. by a higher-level machine controller (not shown). Sensor 64, which detects the register mark 63 in question, is located, in particular, in the area of a slack span 66 of the suction belt 52 in question. Sensor 64, which detects the register mark 63 in question, is embodied as a sensor 64 that detects the register mark 63 in question, e.g. optically or inductively or capacitively or electromagnetically or by ultrasound. Register mark 63 is embodied, corresponding to the embodiment of sensor 64 in each case, e.g. as an optical signal surface applied to the relevant suction belt 52, or as a magnetic strip on the relevant suction belt 52, or as a recess or perforation in the relevant suction belt 52, or as a body that transmits a signal and is located in the relevant suction belt 52. The timing of the adjustment of the revolution speed v of the suction belt 52 in question, which is implemented by control unit 61, is preferably synchronized with the passage over the perforated surface 57 of the suction belt 52 in question by the sheet 51 to be transported.

In a further variant, for the sequential transport of individual sheet-type substrates or sheets 51, the transport apparatus includes at least one fixedly arranged suction chamber 58; 59 having a preferably table-shaped surface 69 in the area of tight span 54, wherein the preferably sole endlessly revolving suction belt 52, in particular perforated at least in sections, is arranged so as to move, in particular slide, over this surface 69 during transport of the sheet-type substrate in question, i.e. preferably a sheet 51, wherein the suction chamber 58; 59 in question is covered in the area of tight span 54 of suction belt 52 by the table-shaped surface 69. This table-shaped surface 69 is implemented, e.g. as a table panel. This suction belt 52 that holds sheet 51 in question during its transport is located in particular centered with respect to the width b51 of sheets 51, which is oriented orthogonally to transport direction T, and/or also centered with respect to the width b69 of table-shaped surface 69, which is oriented orthogonally to transport direction T. The width b52 of suction belt 52 oriented orthogonally to transport direction T is narrower than the width b51 of sheets 51 in question to be transported, which is oriented orthogonally to transport direction T, and is also narrower than the width b69 of the table-shaped surface 69 oriented orthogonally to transport direction T. The width b52 of suction belt 52 oriented orthogonally to transport direction T is, e.g. only 5% to 50% of the width b51, oriented orthogonally to transport direction T, of sheets 51 and/or the width b69, oriented orthogonally to transport direction T, of the table-shaped surface 69, so that during transport, the sheet 51 in question does not rest with its entire surface on suction belt 52, in particular not with its two side regions that extend orthogonally to transport direction T resting thereon.

Figure 11:
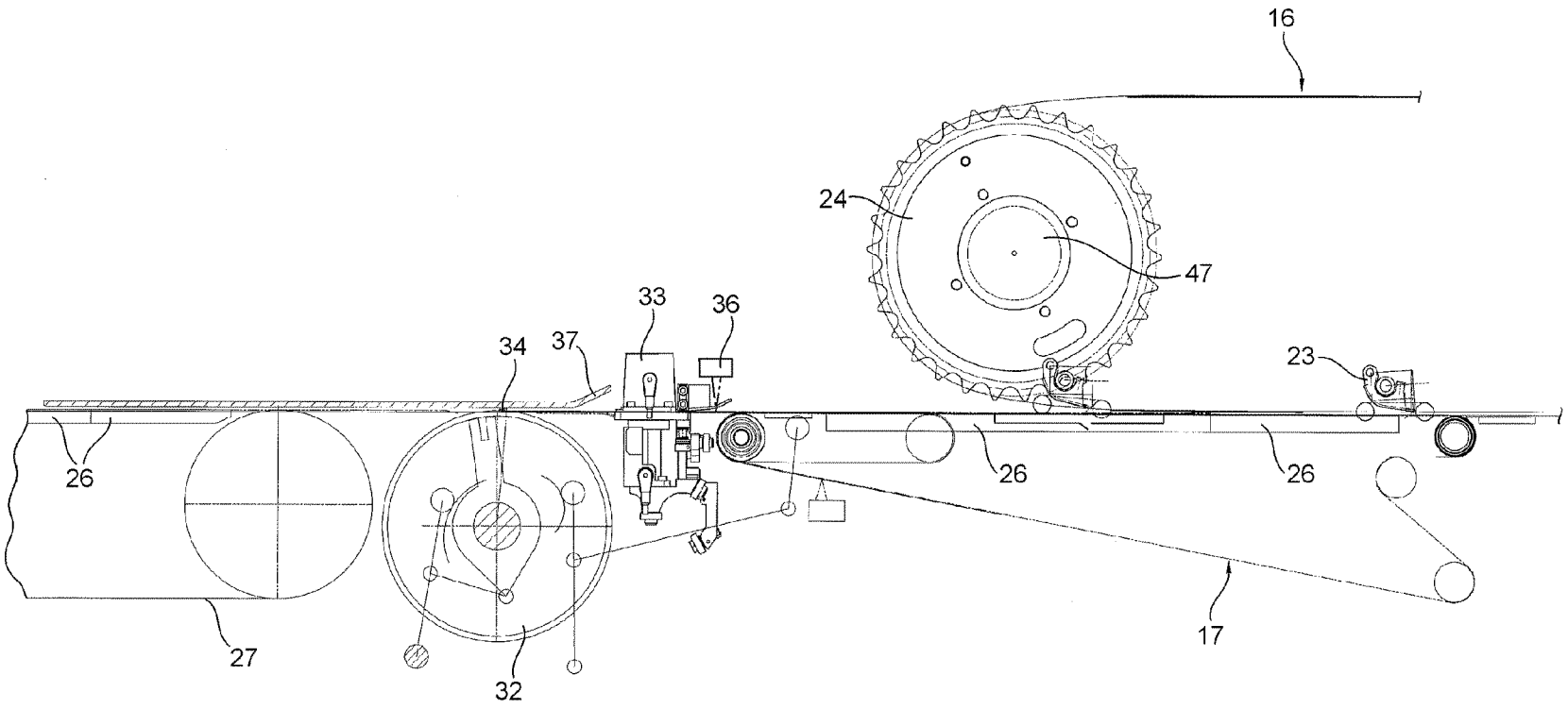
FIG. 11 an enlarged view of a first detail from FIG. 10.
Figure 14:
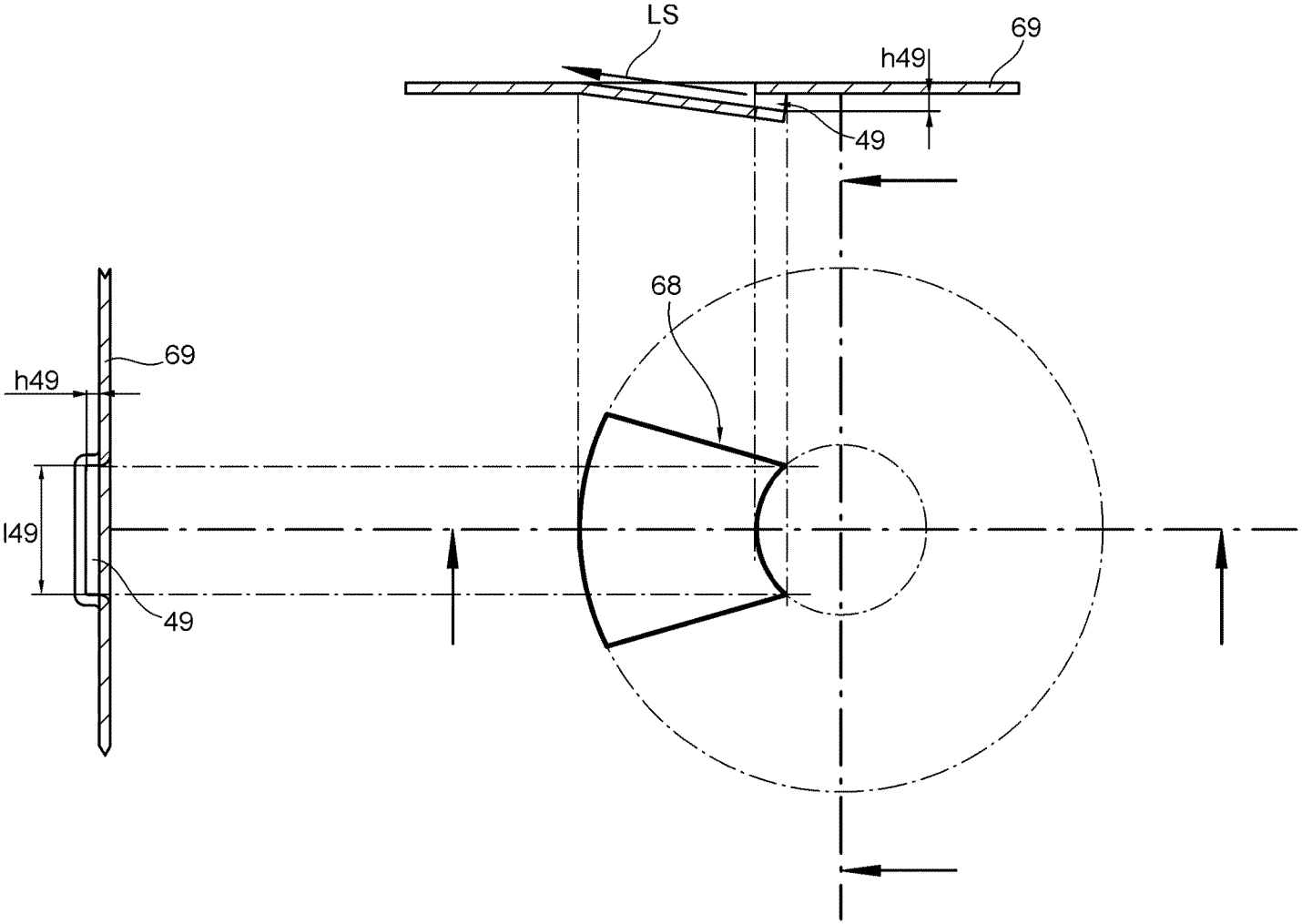
FIG. 14 a plan view of an individual blow-suction nozzle.
Figure 15:
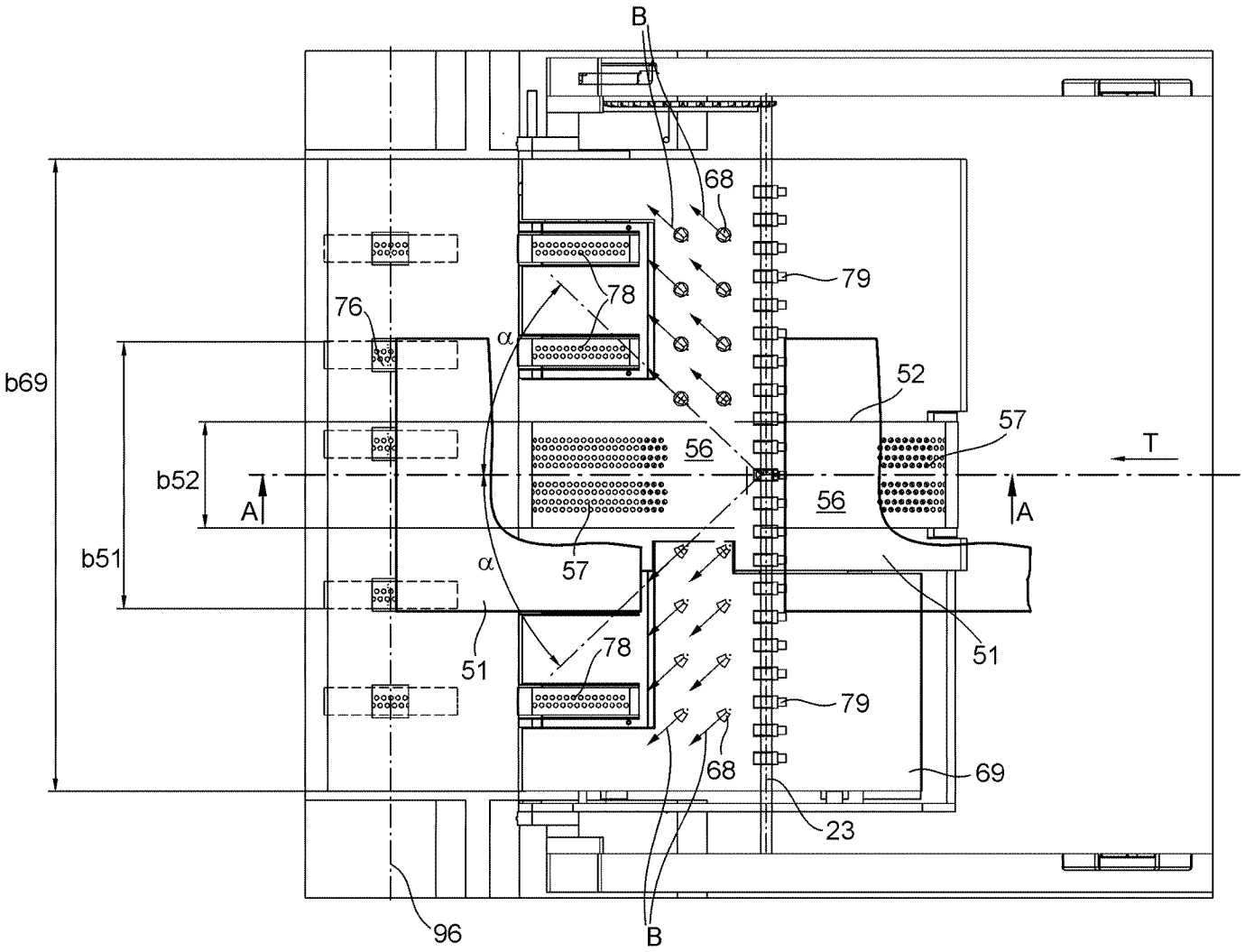
FIG. 15 a plan view of a transport apparatus according to FIG. 11 or FIG. 13.
Figure 16:
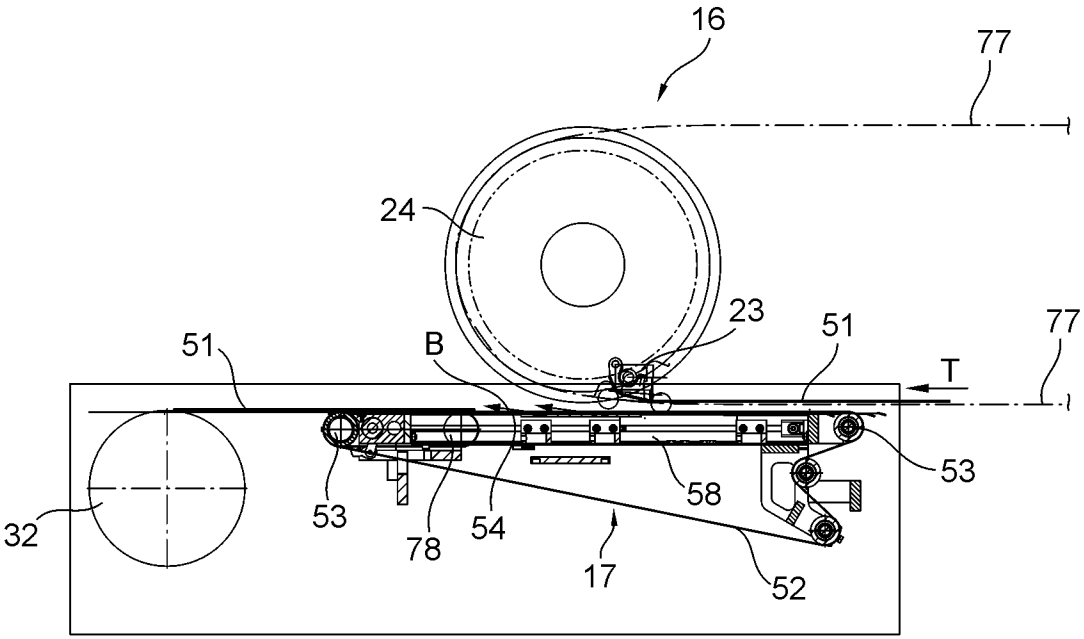
FIG. 16 a side view of the transport apparatus shown in FIG. 15.

To allow the sheet 51 in question to slide during its transport with as little friction as possible over the table-shaped surface 69 covering the at least one suction chamber 58; 59, at least one blow/suction nozzle 68 is located in at least two of the areas of table-shaped surface 69 that are not covered by suction belt 52. The air flow emerging from a respective blow/suction nozzle 68 preferably is or at least can be controlled, e.g. in terms of its intensity (i.e. its pressure and/or its flow velocity) and/or its duration, wherein the blow/suction nozzle 68 in question allows air to flow against the underside of sheet 51 in question during the transport thereof, whereby an air cushion is or at least can be formed between the underside of sheet 51 in question to be transported and table-shaped surface 69. In the preferred embodiment, each of blow/suction nozzles 68 is embodied as a Venturi nozzle, wherein the Venturi nozzle applies suction to a side region of the relevant sheet 51 to be transported by applying negative pressure in the direction of table-shaped surface 69. Blow/suction nozzles 68 are preferably each arranged in the table-shaped surface 69. One embodiment example of blow/suction nozzles 68 is shown in FIG. 14 in a plan view with two corresponding side views, in which the illustrated blow/suction nozzle 68 is configured, e.g. as a slot-shaped nozzle, wherein the opening 49 in this slot-shaped nozzle is preferably configured as a portion of a preferably cylindrical or conical lateral surface, said portion being, e.g. rectangular in cross-section, wherein the length 149 of this portion running in or parallel to the table-shaped surface 69 is at least three times, preferably ten times greater than its height h49 standing perpendicular to the table-shaped surface 69, the length 149 of this opening 49 in the preferred embodiment extending along an arcuate portion of an inner circumferential line of a circular ring. For example, the height h49 of this opening 49 formed along an arcuate line is approximately 1 mm, and the length 149 is more than 10 mm. A flow of air LS emerging from the blow/suction nozzles 68 in question is preferably aimed in a direction determined, in particular, by the ramp-like shaping of a guide surface, for example, this guide surface being formed, e.g. by a section of the aforementioned circular ring that widens outward. A blowing direction B of blow/suction nozzles 68 is preferably directed obliquely outward in transport direction T of sheet 51 in question to be transported, at an angle $\alpha$ proceeding from transport direction T, ranging from 30° to 60°, preferably at an angle $\alpha$ of 45°, as indicated by way of example in FIG. 15 by directional arrows. In the preferred embodiment, in particular in the table-shaped surface 69 that covers the at least one suction chamber 58; 59, a plurality of rows of blow/suction nozzles 68, in particular two, e.g. each aligned parallel to one another, are arranged on each side of suction belt 52 directed orthogonally to transport direction T, wherein the blow/suction nozzles 68 are arranged spaced uniformly or unevenly from one another to obtain a symmetrical or asymmetrical flow profile of the air flowing out of the blow/suction nozzles 68. Blow/suction nozzles 68 are arranged, e.g. in a transport apparatus 17 that receives sheets 51 in each case from a chain conveyor 16, in particular in a transfer area below the at least one sprocket wheel 24 of chain conveyor 16 and upstream of a further transport apparatus, e.g. a suction drum 32, that follows downstream in transport direction T of sheets 51 to be transported (FIG. 11). FIGS. 15 and 16 each show a preferred arrangement of blow/suction nozzles 68 in the table-shaped surface 69, in each case in relation to the position of a gripper carriage 23 that is moved by chain conveyor 16, wherein this position is the one, in particular, in which the gripper carriage 23 in question delivers or transfers a sheet 51 transported by it to suction belt 52 for further transport.

The transport apparatus having central suction belt 52 and, in its peripheral area, blow/suction nozzles 68 for the sequential transport of individual sheet-type substrates is advantageously usable when the surfaces of sheets 51 to be transported are varnished and when these surface-varnished sheets 51 are received by the above-described transport apparatus, e.g. by a chain conveyor 16, while still in their moist state. The proposed solution not only enables additional suction belts 78 arranged parallel to the centrally located suction belt 52 to be dispensed with, but also avoids those problems that would have to be solved by synchronizing these additional suction belts 78 with the centrally arranged suction belt 52.

Moreover, once the leading edge of each of sheets 51 has been released by the gripper carriage 23 in question, it is moved by means of blow/suction nozzles 68 from the level of a gripper stop plane to a float level that is just above the table-shaped surface 69, i.e. a few millimeters above, and the leading edge of each of sheets 51 in question that has been released by the gripper is kept at the level of the table-shaped surface 69 by said blow/suction nozzles. Without blow/suction nozzles 68, when sheets 51 are transported at high speeds of, e.g. more than 10,000 sheets per hour, there is a risk of the released leading edge of each sheet, or in the case of sheets 51 that are transported in a shingled state, a risk of the leading edge of sheet 51 in question that has been pushed free, being raised upward and lifted off again by an air wedge. In addition, in the case of flexible sheets 51 or substrates, with which the transmission of inner transverse forces from the center belt to the outer edge regions of the substrate in question is limited, these outer edge regions are supported in terms of the conveying component of each by the air friction caused by the air flow LS.

Figure 17:
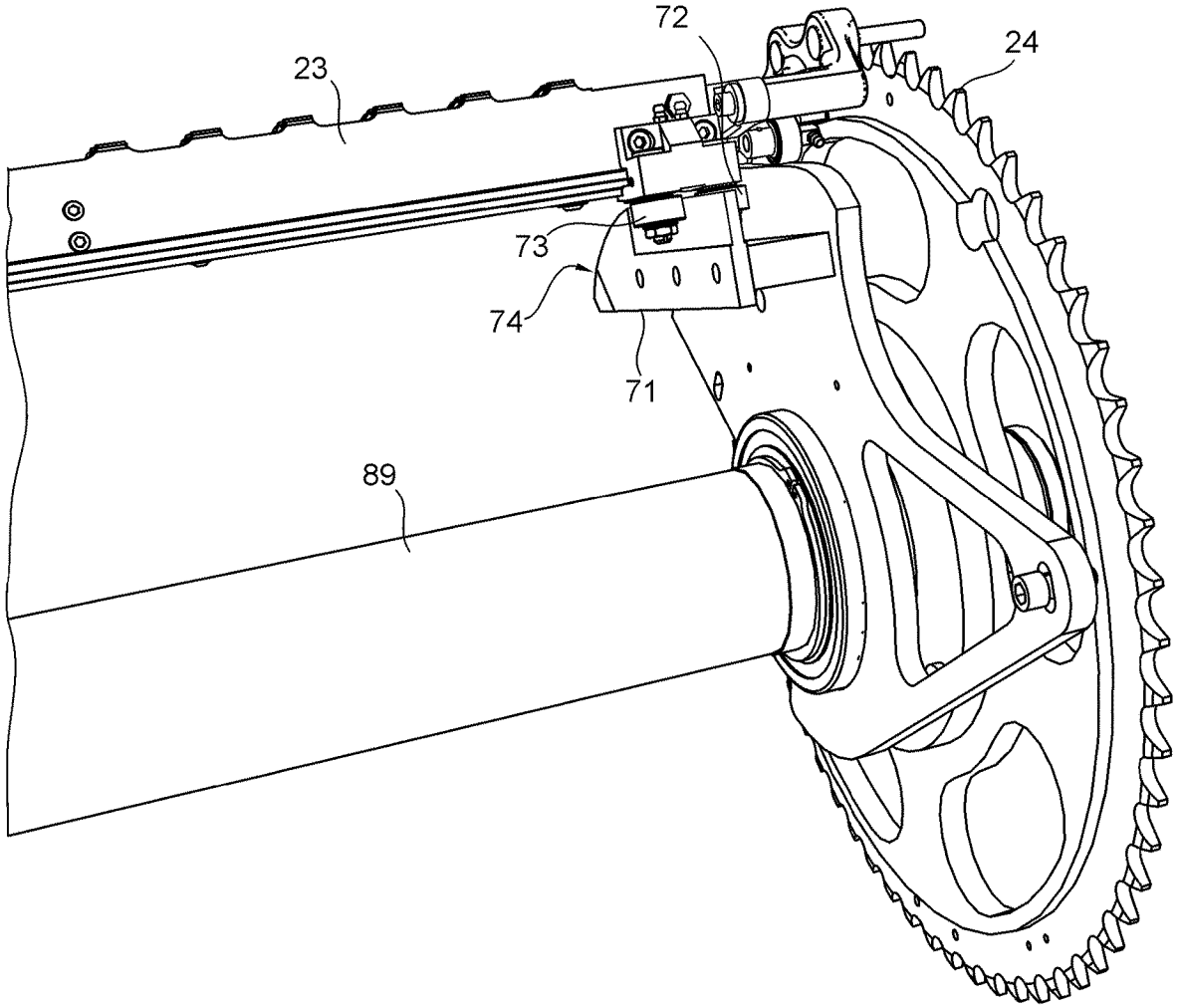
FIG. 17 a detail of the diagram of a chain conveyor.

FIG. 17 shows a detail of a perspective view of a chain conveyor 16. This chain conveyor 16 is located, e.g. in a press assembly having a plurality of processing stations 01; 02; 03; 04; 06; 07; 08; 09; 11; 12, each for processing sheet-type substrates 51, preferably at the downstream end, in transport direction T of the sheet-type substrates 51 guided through press assembly, of a processing station 02; 04 embodied as a primer application unit 02 or as an offset printing unit 04, wherein the chain conveyor 16 transports sheet-type substrates 51 that have been processed in the preceding processing station 02; 04, individually in sequential transport, to a subsequent processing station 06, said subsequent processing station 06 being embodied, e.g. as a non-impact printing unit 06, wherein the sheet-type substrates 51 processed in the preceding processing station 02; 04 are or can be subjected to further processing in the subsequent processing station 06. Said offset printing unit 04 is preferably embodied as a sheet offset printing press and/or non-impact printing unit 06 is preferably embodied, e.g. as at least one inkjet printing unit. In such a press assembly, the problem exists that sheet-type substrates 51 that have been processed in the preceding processing station 02; 04, embodied, e.g. as an offset printing unit 04, must be fed with high positional precision to the next processing station 06, embodied, e.g. as a non-impact printing unit 06, for further processing true to register, which cannot be achieved with a conventional chain conveyor 16 due to the necessary chain play and due to potential fluctuations in the elongation of the at least one chain. One of the production lines described, e.g. in reference to FIG. 1 can be achieved with this press assembly.

Figure 18:
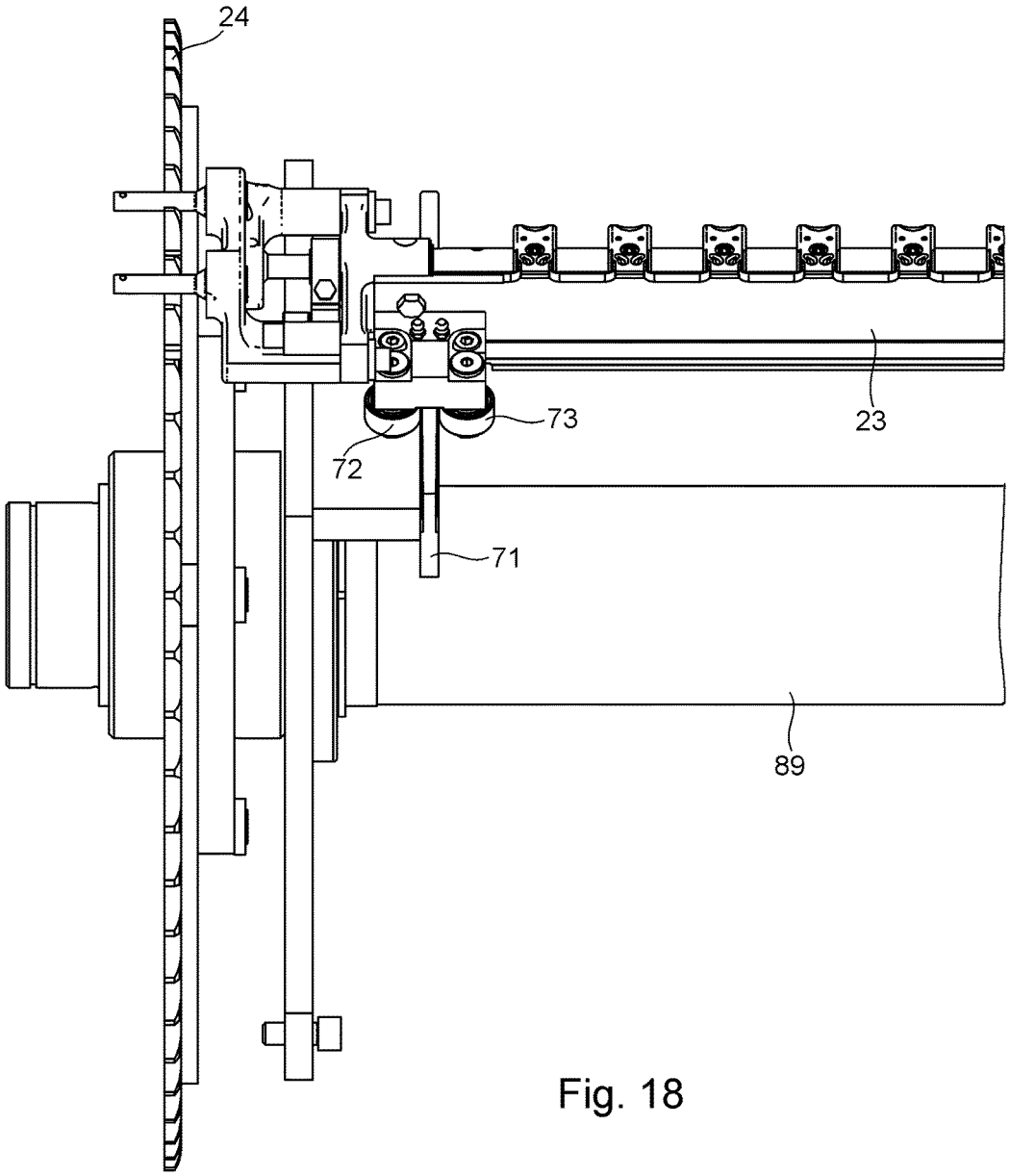
FIG. 18 a plan view of the assembly shown in FIG. 15.
Figure 19:
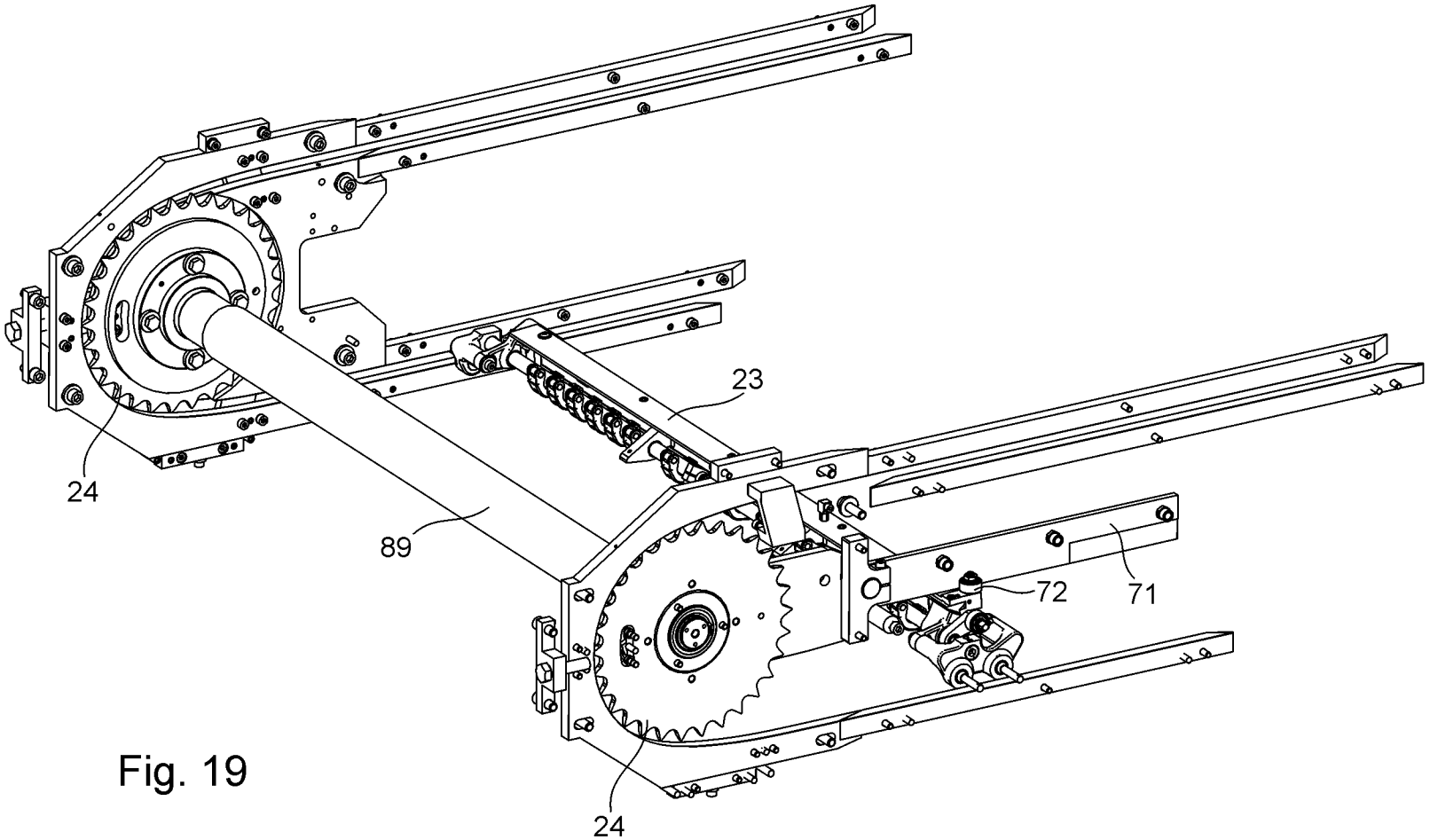
FIG. 19 a further perspective view of the chain conveyor shown in FIGS. 15 and 16.

In the case of a chain conveyor 16, the sheet-type substrates 51 are each transported individually by means of a gripper carriage 23 that is moved along a movement path (FIGS. 10 and 11), wherein the gripper carriage 23 in each case is generally guided along two chain tracks 77 spaced from one another and extending parallel to one another along the path of movement of said carriage. In that case, the substrate 51 to be transported is held, in particular at an edge that extends along the gripper carriage 23 in question, i.e. at the leading edge of said substrate 51, by at least one holding means 79 arranged on said gripper carriage 23, i.e. by the at least one gripper. The gripper carriage 23 in question is guided, in the receiving area located at a certain position of its movement path in which the gripper carriage 23 in question receives the respective substrate 51 to be transported in each case, and/or in the transfer area located at a certain position of its movement path in which the gripper carriage 23 in question delivers the transported substrate 51 in particular to the other transport apparatus, e.g. by means of at least one guide element 71 located between the spaced-apart chain tracks 77, along the movement path of the gripper carriage 23 in question, wherein the other transport apparatus that cooperates with chain conveyor 16 is embodied in particular as a transport belt 17 (FIG. 11). As gripper carriage 23 moves along its movement path, it is proposed for the purpose of stabilizing said gripper carriage transversely to this movement that the at least one guide element 71 in question be arranged fixedly in the receiving area or in the transfer area, in each case between the spaced-apart chain tracks 77, and that the gripper carriage 23 that is guided along the spaced-apart chain tracks 77 be fixed transversely to the movement path by means of the guide element 71 in question. This fixation is preferably effected by locating a roller pair having two rollers 72; 73, the running surfaces of which are engaged against one another, on each gripper carriage 23, wherein the guide element 71 in question is guided in each case, at least in the receiving area or in the transfer area, by a gap between the respective running surfaces of the two rollers 72; 73 of the roller pair in question. The at least one guide element 71 is preferably embodied as a rigid rail and/or has a wedge-shaped run-up 74. The guide element 71 in question is embodied, e.g. as integral, and extends, e.g. from the receiving area to the transfer area of chain conveyor 16. The running surfaces of each of rollers 72; 73 of the roller pair in question, which are engaged against one another, roll, e.g. on both sides of guide element 71 in question, which is embodied, e.g. as a rail (FIGS. 17 to 19). Along chain tracks 77, endlessly revolving conveyor chains are provided, in particular, each of these conveyor chains being driven by at least one sprocket wheel 81. The sprocket wheel 24; 81 of the one chain track 77, which is preferably located at one end of chain conveyor 16 either in the receiving area or in the transfer area, and the sprocket wheel 24; 81 of the other chain track 77, which is located at the same end of chain conveyor 16 in the same area, are preferably connected to one another, in particular rigidly, by means of a common shaft 89. The guide element 71 in question, preferably in cooperation with the roller pair, laterally fixes the respective gripper carriage 23 that is guided along the spaced-apart chain tracks 77, i.e. it blocks the freedom of movement thereof transversely to the movement path. The lateral positioning of substrates 51 is improved in that, both in the receiving area, in which each of the substrates 51 is received by one of the gripper carriages 23, and in the transfer area, in which the substrates 51 transported by chain conveyor 16 are transferred by the respective gripper carriage 23 to transfer belt 17, the respective gripper carriage 23 is aligned in each case by a guide element 71 (FIG. 10). These guide elements 71 are embodied either as two separate, individual guide elements 71 or as a single, integral guide element 71.

In conjunction with the above-described press assemblies, the following method for operating a transport apparatus that feeds individual sheet-type substrates 51 sequentially to a processing station 02; 03; 04; 06; 07; 08; 09; 11; 12 can be advantageously embodied, in which the actual position of each substrate 51 in its transport plane 29 before it reaches the processing station 02; 03; 04; 06; 07; 08; 09; 11; 12 is determined mechanically by means of a control device that cooperates with the transport apparatus, and is automatically compared with a set position provided for the substrate 51 in question in said processing station 02; 03; 04; 06; 07; 08; 09; 11; 12. In the event of a deviation of the actual position from the set position, the substrate 51 in question is aligned by a transport element of the transport apparatus, the movement of which is controlled by the control device, in such a way that before the substrate 51 in question reaches processing station 02; 03; 04; 06; 07; 08; 09; 11; 12, it assumes its set position specified for said processing station 02; 03; 04; 06; 07; 08; 09; 11; 12. In a highly advantageous variant of this embodiment, the substrate 51 in question is aligned in transport plane 29 in each case solely by the transport element, both in transport direction T and transversely thereto, as well as around a pivot point located in transport plane 29. This means that in this variant of the operation of the transport apparatus, mechanical stops in particular are not involved in the alignment of the substrate 51 in question. The processing station 02; 03; 04; 06; 07; 08; 09; 11; 12 to which the substrate 51 in question is fed and the set position of which is aligned is preferably embodied as a non-impact printing unit. The substrate 51 in question is preferably held by the transport element in a force-locking manner, e.g. by suction air or by means of clamping, and in this operating state, which is held by the transport element, is aligned with respect to the set position specified for this substrate 51 in the processing station 02; 03; 04; 06; 07; 08; 09; 11; 12. In particular, a suction drum 32 or a suction belt 52; 78 is used as the transport element. The transport element transports each of the substrates 51 individually. The control device includes, e.g. the control unit and at least one of the, e.g. optical sensors 33; 36 connected thereto, the sensors 33; 36 being embodied with respect to the detection of the actual position of the substrate 51 in question, e.g. as a lateral edge sensor and/or as a leading edge sensor. The set position, with regard to which the substrate 51 in question is to be aligned, is or will be saved in the control unit and/or is or will be stored preferably such that it can be modified, e.g. by means of a program. The transport element is driven by a first drive that moves the substrate 51 in question in its transport direction T, and by a second drive that moves the substrate 51 in question transversely to its transport direction T, and by a third drive that rotates the substrate 51 in question about the pivot point located in transport plane 29, wherein these drives, each embodied, e.g. as a motor, in particular as a preferably electric servomotor, can be controlled by the control device, i.e. by the control unit thereof. In that case, the transport element is driven by its three drives, in particular simultaneously. The substrate 51 in question is fed by the transport apparatus to the processing station 02; 03; 04; 06; 07; 08; 09; 11; 12 at a transport speed greater than zero, and in the event of a deviation of the actual position from the set position, said substrate is aligned, preferably while maintaining this transport speed. If the transport element is embodied as a suction belt 52; 78, the transport speed at which the substrate 51 in question is fed to the processing station 02; 03; 04; 06; 07; 08; 09; 11; 12 in question corresponds, e.g. to the revolution speed v of said suction belt 52; 78.

Figure 20:
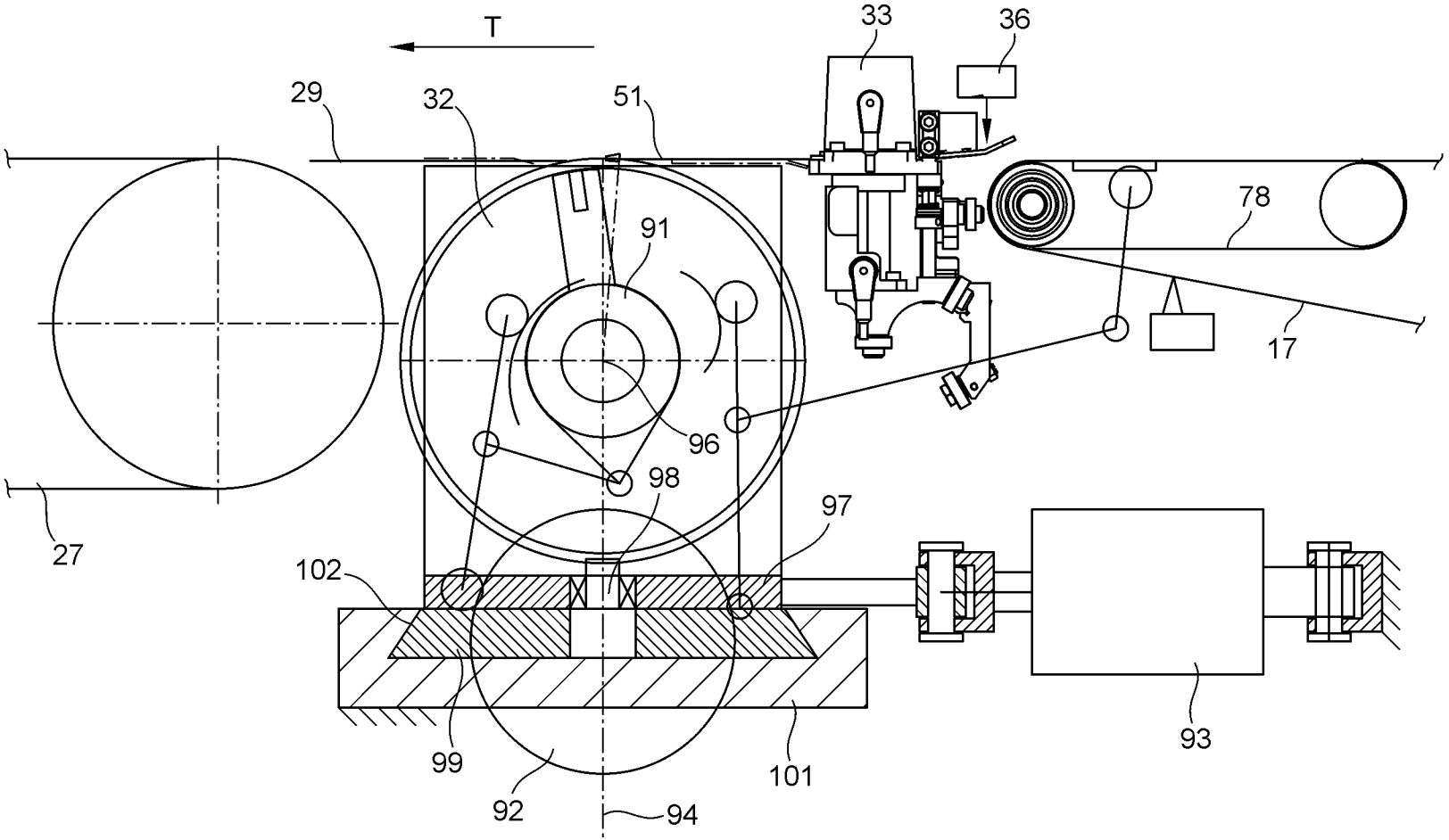
FIG. 20 a further embodiment of the transport apparatus shown in a detail enlargement from FIG. 11.
Figure 21:
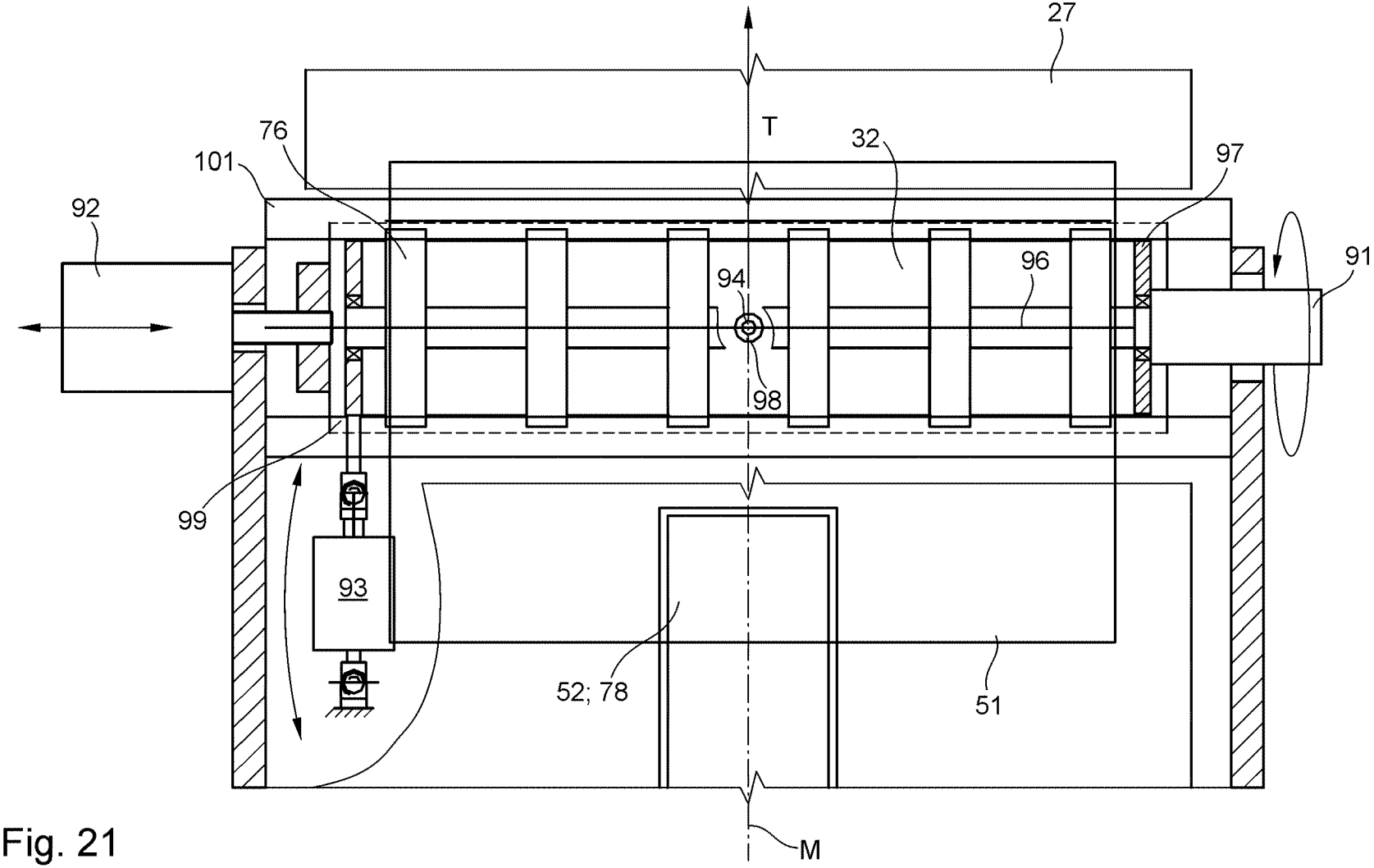
FIG. 21 a plan view of the transport apparatus of FIG. 20.

An exemplary embodiment for carrying out the aforementioned method for operating a transport apparatus for feeding individual sheet-type substrates 51 sequentially to a processing station 02; 03; 04; 06; 07; 08; 09; 11; 12 is illustrated in FIGS. 20 and 21, wherein in this example, a suction drum 32 is used as the transport element. FIG. 20 shows a detail enlargement from FIG. 11, however in this additional exemplary embodiment of the transport apparatus, in contrast to the embodiment of the transport apparatus of FIG. 11, a stop 34 formed on suction drum 32 is not provided. Individually transported substrates 51, in particular sheets, are guided first to suction drum 32 by means of a suction belt 78 arranged upstream of suction drum 32 in the transport direction T, and are guided from suction drum 32 to an additional transport belt 27, said transport belt 27 feeding the substrate 51 in question, in particular to a non-impact printing unit 06. In each case, substrate 51, which is held by suction drum 32 in a force-locking manner by means of suction air, is aligned in transport plane 29 solely by this suction drum 32, both in transport direction T and transversely thereto, as well as about a pivot point located in transport plane 29, with respect to the set position that is specified in non-impact printing unit 06 for the substrate 51 in question. For this purpose, suction drum 32 has a first drive 91 for its circumferential movement and a second drive 92 for its axial movement, and a third drive 93 for a pivoting movement of rotation axis 96 of suction drum 32 that is or at least can be executed about a pivot axis 94 that is perpendicular to transport plane 29, wherein each of these three drives 91; 92; 93 is embodied, e.g. as a preferably electric servomotor. Suction drum 32 is mounted with its first drive 91, e.g. in a first frame 97, this first frame 97 in turn being positioned rotatably, e.g. on a pivot joint 98 located at the machine center M, and said pivot joint 98 being connected to a second frame 99. The rotary movement or pivoting movement of rotation axis 96 of suction drum 32, executed about pivot axis 94 which is perpendicular to transport plane 29, is carried out by means of the third drive 93, which, when activated, acts on the first frame 97 at a distance from the machine center M and in this way effects a diagonal alignment of the substrate 51 that is held by suction drum 32. The second frame 99 that supports the first frame 97 is in turn located in or on a third frame 101, wherein the second frame 99 is movable, in particular displaceable, in or on the third frame 101 when the second drive 92 is actuated transversely to transport direction T of the substrate 51 in question. For this purpose, the second frame 99 is guided linearly in or on the third frame 101 in a guide element 102 configured, e.g. in a prism shape. FIG. 21 shows the transport apparatus illustrated in FIG. 20 from a plan view, wherein the alignment of substrate 51 in transport direction T thereof and also transversely thereto, as well as about an angle of rotation located in transport plane 29, which is or at least can be carried out in each case with suction drum 32, is indicated in each case by a double arrow.

A further method for operating an apparatus for transporting sheet-type substrates 51 likewise uses a transport element for conveying the substrate 51 in question in its transport plane 29, wherein the transport element feeds the substrate 51 in question true to register to a processing station 02; 03; 04; 06; 07; 08; 09; 11; 12 located downstream of the transport element in transport direction T of the substrate 51 in question, wherein this processing station 02; 03; 04; 06; 07; 08; 09; 11; 12 is embodied, e.g. as a non-impact printing unit 06. A suction drum 32 having a plurality of suction rings 76, each embodied as a holding element, arranged axially side by side, or an arrangement of a plurality of suction belts 52; 78, each revolving along transport direction T of the substrate 51 in question, arranged side by side, transversely to the transport direction T of the substrate 51 in question, is preferably used as the transport element. The transport element for transporting the substrate 51 in question therefore always uses a plurality of holding elements arranged spaced from one another transversely to transport direction T thereof, wherein the substrate 51 in question is held in a force-locking manner by at least two of these holding elements, in each case up to an output position in relation to transport plane 29. The respective output positions of all the holding elements holding the substrate 51 in a force-locking manner are located on the same straight line 103. The transport element is used to adjust the diagonal register of the substrate 51 in question.

The diagonal register of the substrate 51 in question is adjusted by adjusting the angle of rotation β of this straight line 103 about a pivot axis 94 perpendicular to transport plane 29, wherein the angle of rotation β of this straight line 103 is adjusted in accordance with the diagonal register of the substrate 51 in question to be adjusted, by actuating, triggered by a control unit, a single mechanical coupling element that acts simultaneously on all the holding elements holding the substrate 51 in question in a force-locking manner; the mechanical coupling element acting on the holding element in question thereby changes the output position of at least one of the holding elements holding the substrate in question in a force-locking manner. The holding elements holding the substrate 51 in question in a force-locking manner impress a transport speed that differs from holding element to holding element upon the substrate 51 in question, wherein the transport speed that is impressed upon the substrate 51 in question by the respective holding element is dependent in each case on the output position set for the respective holding element. As the mechanical coupling element, e.g. a linear transmission element including rocker arms and/or geared mechanical linkages is used, wherein either a rocker arm or a geared mechanical linkage is assigned to each holding element holding the substrate 51 in question in a force-locking manner.

The proposed method for operating an apparatus for transporting sheet-type substrates has the advantage that the transport element in question is not placed in an oblique position for adjusting the diagonal register in the transport apparatus, and as a result, if the lateral register and/or axial register of the substrate in question has already been adjusted, for example, this register cannot be adversely affected by the adjustment of the diagonal register. Instead, a differential speed, which is dependent on the respective position of the holding element in question, is set between the holding elements of the transport element involved in the adjustment of the diagonal register by actuating a single servo drive, thereby aligning the substrate in question in accordance with the desired diagonal register. The advantage of using only a single servo drive for adjusting the diagonal register is that it is unnecessary to coordinate different drives, each acting on one of the holding elements, or to synchronize these with one another, and as a result, a source of error is eliminated and a very precise adjustment of the diagonal register is made possible.

In a preferred embodiment of this method, by means of a control device connected to the control unit, the actual position in transport plane 29 of substrate 51 to be fed true to register to the processing station 02; 03; 04; 06; 07; 08; 09; 11; 12 is determined before the substrate reaches the transport element, and is compared with a set position specified for substrate 51 in question in the processing station 02; 03; 04; 06; 07; 08; 09; 11; 12, wherein in the event of a deviation of the actual position from the set position, the control unit controls a drive 93 for adjusting the mechanical coupling element such that when the substrate 51 in question reaches the respective output positions of all the holding elements that hold the substrate in question in a force-locking manner, the substrate assumes its set position in terms of diagonal register that is specified in processing station 02; 03; 04; 06; 07; 08; 09; 11; 12.

Figure 22:
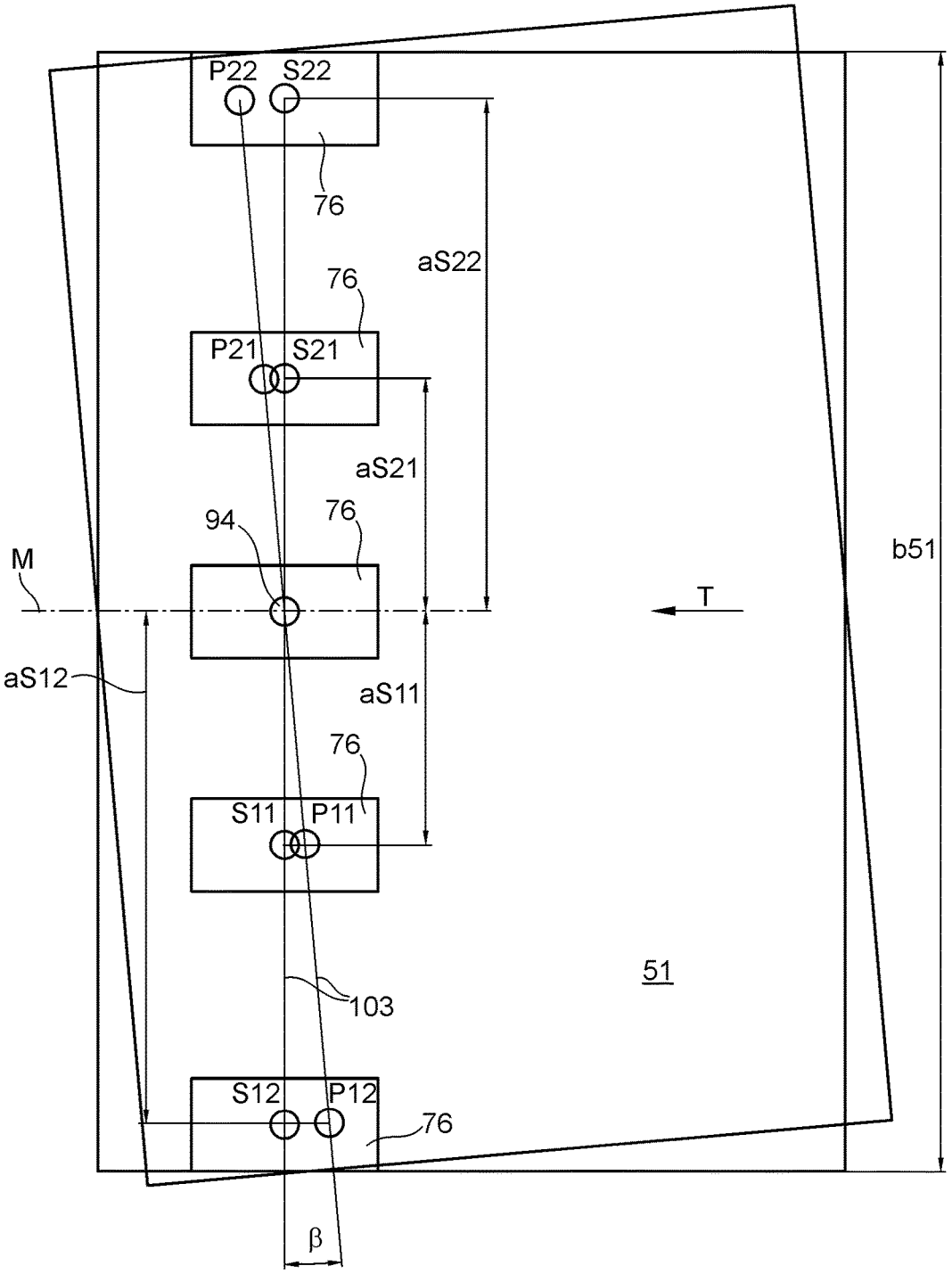
FIG. 22 a sheet-type substrate to be aligned in the diagonal register.

An exemplary embodiment for carrying out the latter method for operating an apparatus for transporting sheet-type substrates 51 will now be described with reference to FIGS. 22 to 26. FIG. 22 shows a plan view of a sheet-type substrate 51, in particular a sheet 51, having a width b51 oriented transversely to its transport direction T. Also provided transversely to its transport direction T are a plurality of holding elements, e.g. five, e.g. in the form of suction rings 76 of a suction drum 32, arranged side by side, these holding elements holding the substrate 51 in question in its transport plane 29 in a force-locking manner, in particular by negative pressure. One of this plurality of holding elements is located, e.g. at the machine center M, and in the example shown here, two additional holding elements are located to the right and two to the left of the machine center M. On the left side in transport direction T of the substrate 51 in question, a holding element that is closer to machine center M is located at a distance aS11 therefrom, and a holding element that is farther from machine center M is located at a distance aS12 therefrom, and on the right side in transport direction T of the substrate 51 in question, a holding element that is closer to machine center M is located at a distance aS21 therefrom, and a holding element that is farther from machine center M is located at a distance aS22 therefrom. The respective rotational planes of all the holding elements holding the substrate 51 in question in a force-locking manner are arranged parallel to one another and each case lengthwise along transport direction T of the substrate 51 in question. The substrate 51 in question is held during its transport in a force-locking manner by at least two of these holding elements, in each case up to an output position in relation to transport plane 29, wherein the respective output positions of all the holding elements holding the substrate 51 in question in a force-locking manner are located on the same straight line 103. In the actual position of the substrate 51 in question, the respective output positions of the holding elements holding this substrate 51 in a force-locking manner are labeled in the present example by reference signs P11; P12; P21; P22, whereas in the set position of the substrate 51 in question, the respective output positions of the holding elements holding this substrate 51 in a force-locking manner are labeled in the present example by reference signs S11; S12; S21; S22. To adjust the diagonal register of the substrate 51 in question and thereby bring the substrate 51 in question from its actual position to its set position, at least with respect to its angular position, the substrate 51 in question is rotated by angle of rotation β about a pivot axis 94 that is perpendicular to transport plane 29, which results when straight line 103 rotates about this angle of rotation β, which in turn results when the respective output position of at least one of the holding elements that holds substrate 51 in a force-locking manner is changed by the mechanical coupling element acting on the holding element in question. Angle of rotation β is typically within the range of only a few degrees, e.g. between greater than zero and less than 30°, in particular less than 10°. Pivot axis 94, which is perpendicular to transport plane 29, is preferably located at machine center M. In this case, the output position of the holding element located at machine center M remains unchanged, whereas the mechanical coupling element acting jointly on the respective holding elements causes the output positions of the concerned holding elements that are located to the right of machine center M in the example shown to accelerate in terms of their revolution speed v, and causes the output positions of the concerned holding elements that are located to the left of machine center M to be decelerated in terms of their revolution speed v. The holding elements that hold the substrate 51 in question in a force-locking manner and that are adjusted in terms of their respective revolution speed v each impress a transport speed that differs from holding element to holding element upon the substrate 51 in question during the implementation of the position correction, wherein each transport speed that is impressed upon the substrate 51 in question by the respective holding element is dependent upon the output position S11; S12; S21; S22 that is set for the respective holding element, i.e. the output position that corresponds to the set position for the substrate 51 in question.

Figure 23:
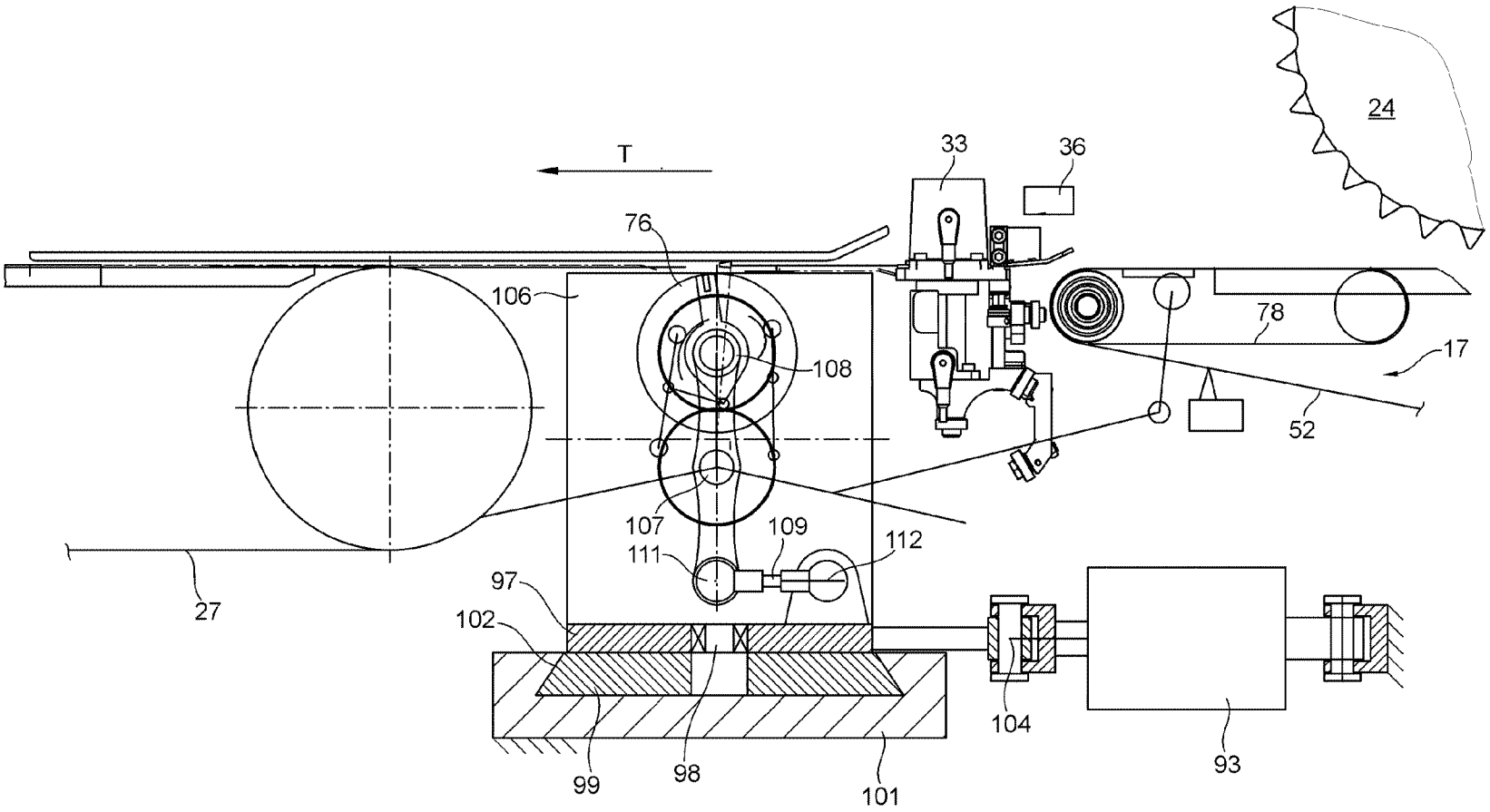
FIG. 23 a side view of a transport apparatus with a mechanical coupling element having a rocker arm.
Figure 24:
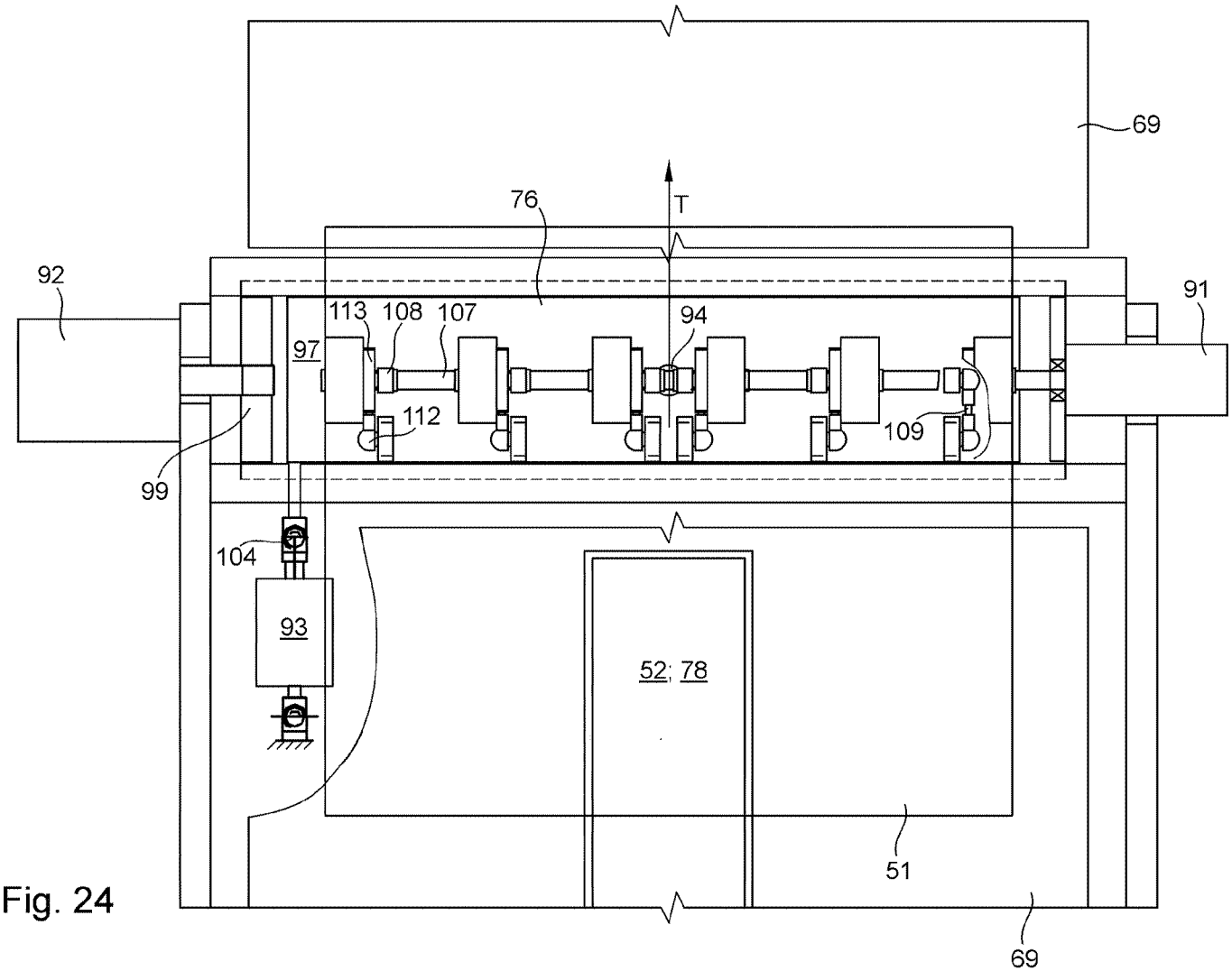
FIG. 24 a plan view of the transport apparatus shown in FIG. 23.
Figure 25:
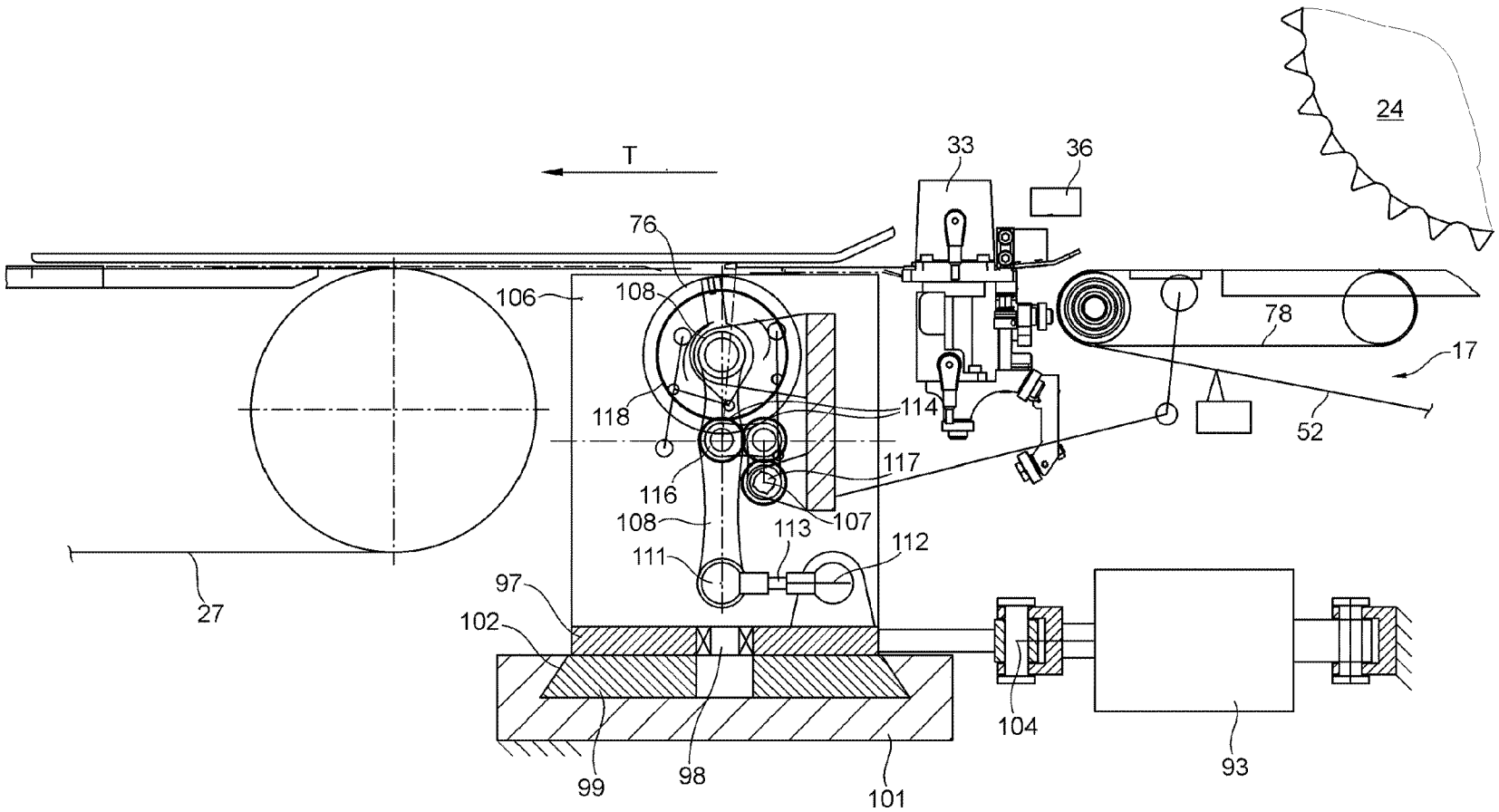
FIG. 25 a side view of a transport apparatus with a mechanical coupling element having a geared mechanical linkage.
Figure 26:
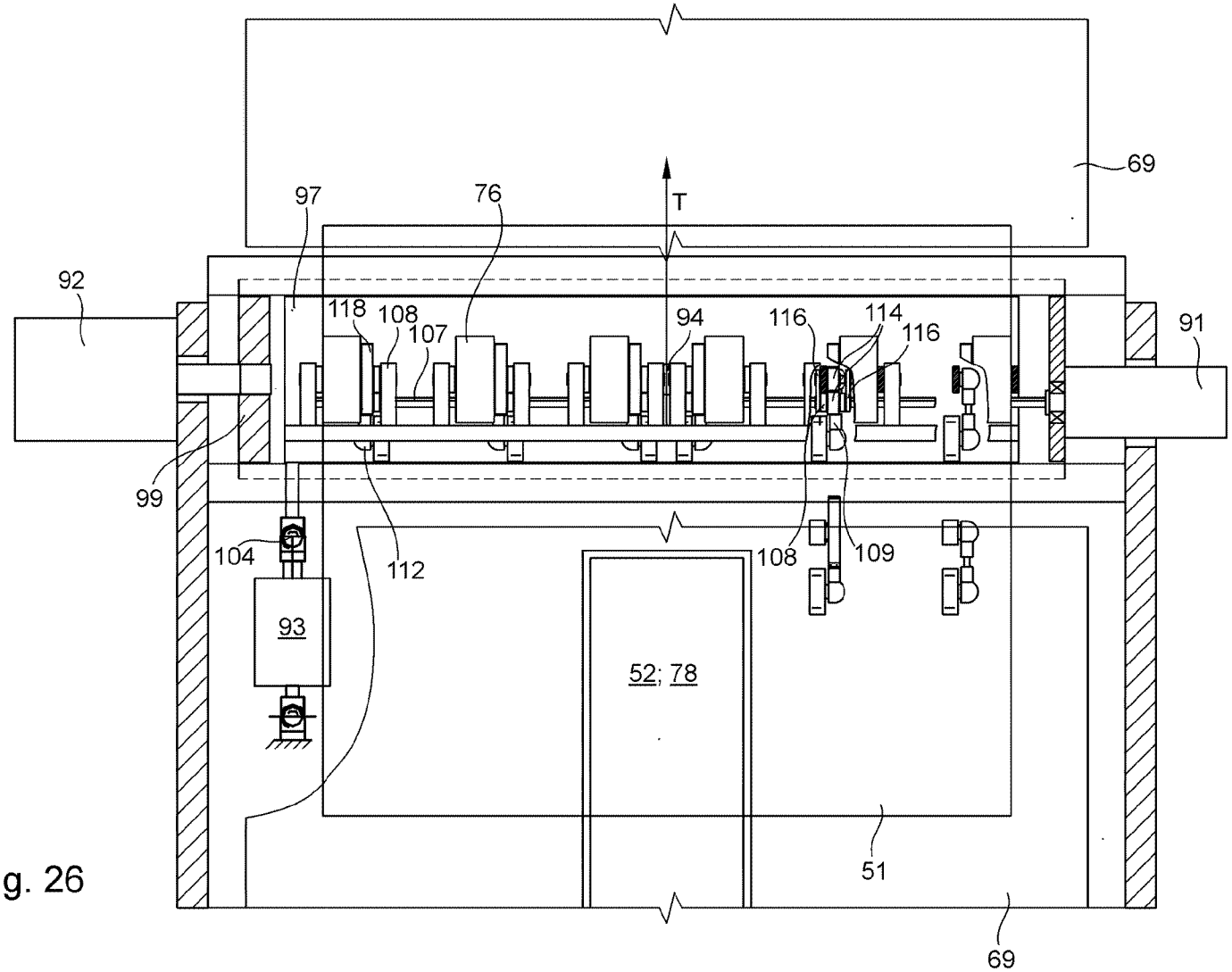
FIG. 26 a plan view of the transport apparatus shown in FIG. 25.

FIGS. 23 and 24 show an embodiment of the mechanical coupling element, e.g. in the form of a linear transmission element with rocker arms. FIGS. 25 and 26 show an embodiment of the mechanical coupling element, e.g. in the form of a linear transmission element with geared mechanical linkages. In these cases, the holding elements that hold the substrate 51 in question in a force-locking manner are each assigned either a rocker arm, according to FIGS. 23 and 24, or a geared mechanical linkage, according to FIGS. 25 and 26. Similarly to the arrangement shown in FIG. 20, the suction drum 32 shown in FIGS. 23 to 26 is mounted, e.g. in a first frame 97, this first frame 97 in turn being positioned rotatably, e.g. on a pivot joint 98 located at the machine center M, and said pivot joint 98 being connected to a second frame 99. The second frame 99 that supports the first frame 97 is in turn located in or on a third frame 101. In the exemplary embodiments shown in FIGS. 23 to 26, the first frame 97 forms the mechanical coupling element that acts on the holding elements in question, wherein drive 93, embodied, in particular, as a preferably electric servo motor, is provided for implementing the rotary movement of the mechanical coupling element about pivot axis 94, which is perpendicular to transport plane 29. When actuated by the control unit, drive 93 preferably acts via a joint 104 on the first frame 97 that forms the mechanical coupling element. The second frame 99 has at least two diametrically opposed frame walls 106, in which frame walls 106 a drive shaft 107 extending parallel to suction drum 32 is rotatably mounted, e.g. at both ends. A plurality of rocker arms 108 are preferably arranged on drive shaft 107, each of these rocker arms 108 being functionally connected to one of the holding elements, which are each embodied, e.g. as a suction ring 76. The rocker arms 108 in question are each connected for conjoint rotation with the drive shaft 107, so that the drive shaft 107 for each of the rocker arms 108 in question forms a fixed fulcrum. Each of the rocker arms 108 in question, driven by drive shaft 107, thus acts, optionally via a drive pinion 113, at one of its ends, e.g. its upper end, on one of the holding elements. On the other side, each of these rocker arms 108 is connected at its other end, e.g. its lower end, preferably via a coupler 109, which is mounted at both ends on additional joints 111; 112, each embodied, e.g. as a spherical joint, to the first frame 97 in such a way that the angular position of the rocker arm 108 that is connected to the drive shaft 107 is or at least can be adjusted by means of drive 93.

The embodiment variants according to FIGS. 25 and 26 is very similar to the embodiment variant according to FIGS. 23 and 24, and therefore, the same components are labeled by the same reference signs. The embodiment variant according to FIGS. 25 and 26 differs from the embodiment variant according to FIGS. 23 and 24 in that a pair of coupling gears 114 is provided, which are coupled to one another via a gear coupling 116, wherein a drive pinion 117 introduces torque into the pair of coupling gears 114, and an output pinion 118 transfers the torque introduced into the pair of coupling gears 114 to the holding element in question for the purpose of adjusting its angular position. The pair of coupling gears 114, together with drive pinion 117 and output pinion 118, form a geared mechanical linkage.

FIG. 27 shows a further press assembly having a plurality of generally different processing stations for the sequential processing of a plurality of sheet-type substrates. The flat substrates, each of which has a front side and a back side, are gripped in a feeder 01, e.g. by a suction head 41, and are transferred individually by means of a rocking gripper 13 to a transfer drum 14, and from there to a rotating impression cylinder 119, wherein this impression cylinder 119 picks up at least one of these substrates or also a plurality of substrates, e.g. two or three arranged one behind the other in the circumferential direction, on its lateral surface. Each of the substrates to be transported is held on the lateral surface of impression cylinder 119 by means of at least one holding element, embodied, e.g. as a gripper. In particular, flexible and/or thin substrates having a thickness of, e.g. up to 0.1 mm or a maximum of 0.2 mm can also be held, e.g. by means of suction air on the lateral surface of impression cylinder 119, wherein the positioning of such a substrate lying on the lateral surface of impression cylinder 119, in particular along the edges of said substrate, is supported, e.g. by blown air directed in particular radially onto the lateral surface of the impression cylinder 119. Thrown onto impression cylinder 119 in its direction of rotation, which in FIG. 27 is indicated by a rotation direction arrow, and proceeding from transfer drum 14, which is thrown onto said impression cylinder 119, is first, a first primer application unit 02 for priming the front side, and downstream of this first primer application unit 02 a second primer application unit 126 for priming the back side of the same sheet-type substrate, wherein the second primer application unit 126 primes the back side of the substrate in question, e.g. indirectly, in particular by re-transferring the primer applied by this second primer application unit 126 to the lateral surface of impression cylinder 119 from this lateral surface to the back side of the substrate in question. The front side and/or the back side of the substrate in question can be primed over the entire surface or over part of the surface, as required. Impression cylinder 119 transfers a substrate that has been primed on both sides to a first transport apparatus, which includes at least one pulling element and in particular is endlessly revolving, e.g. to a first chain conveyor 16, wherein the first chain conveyor 16 transports this substrate to a first non-impact printing unit 06, and this first non-impact printing unit 06 prints on at least a portion of the front side of the substrate in question. The first non-impact printing unit 06 transfers the substrate that has been imprinted on the front side to a second transport apparatus, which includes at least one pulling element and in particular is endlessly revolving, e.g. a second chain conveyor 21, wherein this second chain conveyor 21 receives the substrate in question, e.g. in the area of its first sprocket wheel 81 (FIG. 10). In the area of the second sprocket wheel 24 of this second chain conveyor 21, for example, a second non-impact printing unit 127 is provided, wherein this second non-impact printing unit 127 prints on at least a portion of the back side of the substrate in question, which was previously imprinted on the front side. The first non-impact printing unit 06 and the second non-impact printing unit 127 are thus arranged in succession in transport direction T of the respective sheet-type substrate, at different positions on the transport path of the substrate in question. The substrate, which has now been printed on both sides, is then delivered, e.g. to a stack in a delivery unit 12.

The press assembly for processing the substrate in question on both sides, shown in FIG. 27 or 28, includes in each case a plurality of dryers 121; 122; 123; 124, preferably four, more specifically a first dryer 121 for drying the primer applied to the front of the substrate in question, and a second dryer 122 for drying the primer applied to the back of the substrate in question. Additionally provided are a third dryer 123 for drying the substrate in question that has been printed on its front side by the first non-impact printing unit 06, and a fourth dryer 124 for drying the substrate in question that has been printed on its back side by the second non-impact printing unit 127. Dryers 121; 122; 123; 124, which are, e.g. identical in construction, are embodied for drying the substrate in question, e.g. by irradiating it with infrared or ultraviolet radiation, the type of radiation being dependent in particular on whether the printing ink or ink applied to the substrate in question is water-based or UV-curing. Transport direction T of the substrate in question being transported through the press assembly is indicated in FIG. 27 by arrows in each case. The first non-impact printing unit 06 and the second non-impact printing unit 127 are each embodied, e.g. as at least one inkjet printing unit. In the operating area of the first non-impact printing unit 06, a third transport apparatus 128 is located, which receives the substrate in question, which has been primed on both sides, from the first transport apparatus having at least one pulling element, transports it to the second transport apparatus having at least one pulling element, and delivers it to this second transport apparatus. The third transport apparatus 128, which transports the substrate in question within the operating area of the first non-impact printing unit 06, is embodied, e.g. as a transport cylinder (FIG. 27) or in particular as an endlessly revolving transport belt (FIG. 28), wherein in the case of the transport cylinder, the preferably multiple inkjet printing devices of the first non-impact printing unit 06 are each arranged radially relative to this transport cylinder, and wherein in the case of the transport belt, the preferably multiple inkjet printing devices of the first non-impact printing unit 06 are arranged, in particular, side by side horizontally, parallel to this transport belt. The transport belt is embodied, e.g. as a suction belt 52 having at least one suction chamber 58; 59 (FIG. 13).

The third transport apparatus 128, which transports the substrate in question within the operating area of the first non-impact printing unit 06, and the second transport apparatus, which transports the substrate in question within the operating area of the second non-impact printing unit 127 and which includes at least one pulling element, preferably each include an independent drive 129; 131, wherein each of these independent drives 129; 131 is embodied, e.g. as a preferably electrically powered motor that is or at least can be controlled with regard to its respective rotational speed and/or angular position, wherein the printing of the substrate in question on its front side by the first non-impact printing unit 06 and on its back side by the second non-impact printing unit 127 is or at least can be synchronized by means of these independent drives 129; 131 that influence the movement pattern of each of the transport apparatuses in question.

In a preferred embodiment, the first dryer 121 for drying the primer applied to the front side of the substrate in question is located, e.g. in the area of impression cylinder 119 (FIG. 27) or in the area of a side, in particular a tight span of the first transport apparatus having at least one pulling element (FIG. 28). The second dryer 122 for drying the primer applied to the back side of the substrate in question is preferably located in the area of a side, in particular the tight span of the first transport apparatus having at least one pulling element. The third dryer 123 for drying the substrate in question that has been printed on the front side by the first non-impact printing unit 06 is located, e.g. in the area of the side situated upstream of the second non-impact printing unit 127 in transport direction T of the substrate in question, in particular the tight span of the second transport apparatus having at least one pulling element, or is situated in the area of the third transport apparatus 128, which is itself situated in the operating area of the first non-impact printing unit 06 and cooperates with the same. The fourth dryer 124 for drying the substrate that has been printed on its back side by the second non-impact printing unit 127 is located, e.g. in the area of the span of the second transport apparatus having at least one pulling element, which is situated downstream of the second non-impact printing unit 127 in transport direction T of the substrate in question. When one of the dryers 121; 122; 123; 124 is located in a span of one of the transport apparatuses, the length of its drying path determines the minimum length of the span in question.

The first transport apparatus, which receives substrates from impression cylinder 119 and which includes at least one pulling element, and the second transport apparatus, which transports the substrates within the operating area of the second non-impact printing unit 127 and which includes at least one pulling element, each transport the substrates by means of gripper carriages 23, wherein these gripper carriages 23 are arranged successively with preferably fixed, in particular equidistant spacing, wherein each of these gripper carriages 23 is equipped with controlled or at least controllable holding means 79 (FIG. 15) for holding a substrate, in particular grippers. Each of these gripper carriages 23 is moved in transport direction T of the substrate in question by the relevant at least one pulling element of the transport apparatus in question. The gripper carriages 23 are each driven in transport direction T of the substrate in question, e.g. by a precision drive, the precision drive in question being embodied, e.g. in the form of a linear drive system, wherein the precision drive in question positions the gripper carriage 23 in question, and thus the substrate in question being held, in particular in a force-locking manner, by the gripper carriage 23 in question, with an accuracy of less than ±1 mm, preferably less than ±0.5 mm, in particular less than ±0.1 mm, in a position along the transport path that is specified, e.g. with respect to one of the non-impact printing units 06; 127.

In a particularly advantageous embodiment of the transport apparatus in question having gripper carriages 23, a plurality of belts are preferably located, at least lengthwise along transport direction T of the substrate in question, between immediately successive gripper carriages 23, wherein the substrate in question being held by the gripper carriage 23 in question rests with at least a portion of its surface on these belts, which are preferably arranged parallel to one another, for the purpose of stabilizing said substrate during its transport. Belts that are located between successive gripper carriages 23 are arranged, in particular spring-loaded, lengthwise along transport direction T of the substrate in question or are made of an elastic material.

In a further preferred embodiment, the gripper carriages 23 are guided, at least in the operating area of the first non-impact printing unit 06 and/or in the operating area of the second non-impact printing unit 127, by means of at least one guide element 71 situated along the movement path of the gripper carriage 23 in question, in each case for the purpose of stabilizing the movement path of said gripper carriages (FIGS. 17 to 19). Moreover, to produce guidance that maintains registration and/or is true to register in particular or at least in the operating area of the first non-impact printing unit 06 and/or in the operating area of the second non-impact printing unit 127, a catch mechanism, for example, is provided for the gripper carriage 23 in question, wherein this catch mechanism includes, e.g. at least one fork that is or at least can be moved in transport direction T of the substrate in question, wherein the gripper carriage 23 in question is held, e.g. at its two ends located transversely to transport direction T of the gripper carriage 23 in question, in the respective fork and is guided by said fork along its movement path, in particular maintaining registration and/or true to register. Furthermore, to align the substrate in question so as to maintain registration and/or register, in particular or at least in or immediately upstream of the operating area of the first non-impact printing unit 06 and/or in or immediately upstream of the operating area of the second non-impact printing unit 127, an adjusting device, for example, in particular a lateral positioning device, is provided. The substrate in question is aligned, maintaining registration and/or true to register, e.g. with the aid of sensors 33; 36 that sense said substrate, as described, for example, in conjunction with FIG. 11.

The press assembly shown in FIG. 27 or 28 can also be described as a press assembly for the sequential processing of a plurality of sheet-type substrates, each of which has a front side and a back side, wherein a first non-impact printing unit 06 and a second non-impact printing unit 127, as well as a first primer application unit 02 and a second primer application unit 126 are provided, wherein in each case the first primer application unit 02 is arranged for priming the front side and the second primer application unit 126 is arranged for priming the back side of the same sheet-type substrate, and wherein the first non-impact printing unit 06 is arranged for printing on the front side of said substrate that has been primed by the first primer application unit 02, and the second non-impact printing unit 127 is arranged for printing on the back side of said substrate that has been primed by the second primer application unit 126. In addition, a first dryer 121 for drying the primer applied to the front side of the substrate in question is provided upstream of the first non-impact printing unit 06 in transport direction T of the substrate in question, and a second dryer 122 for drying the primer applied to the back side of the substrate in question is provided upstream of the second non-impact printing unit 127 in transport direction T of the substrate in question, and a third dryer 123 for drying the substrate in question that has been printed on its front side by the first non-impact printing unit 06 is provided downstream of the first non-impact printing unit 06 in transport direction T of the substrate in question, and a fourth dryer 124 for drying the substrate in question that has been printed on its back side by the second non-impact printing unit 127 is provided downstream of the second non-impact printing unit 127 in transport direction T of the substrate in question. The second primer application unit 126 can be located either upstream or downstream of the second non-impact printing unit 127 in transport direction T of the substrate in question. The first dryer 121 for drying the primer applied to the front side of the substrate in question, and/or the second dryer 122 for drying the primer applied to the back side of the substrate in question, and/or the third dryer 123 for drying the substrate in question that has been printed on its front side by the first non-impact printing unit 06, and/or the fourth dryer 124 for drying the substrate in question that has been printed on its back side by the second non-impact printing unit 127 are each embodied, e.g. as a dryer for drying the primed and/or printed substrate in question using hot air and/or by irradiating it with infrared or ultraviolet radiation, wherein the dryer 121; 122; 123; 124 for drying the primed and/or printed substrate in question by irradiating it with infrared or ultraviolet radiation is preferably embodied as an LED dryer, i.e. as a dryer that uses semiconductor diodes. In addition, at least one transport apparatus for transporting the substrate in question is provided, wherein this transport apparatus is embodied as a transport cylinder or as a revolving transport belt or as a chain conveyor. The at least one transport apparatus for transporting the substrate in question has at least one holding element, wherein the at least one holding element is configured for holding the substrate in question by means of a force closure or a form closure.

Figure 29:
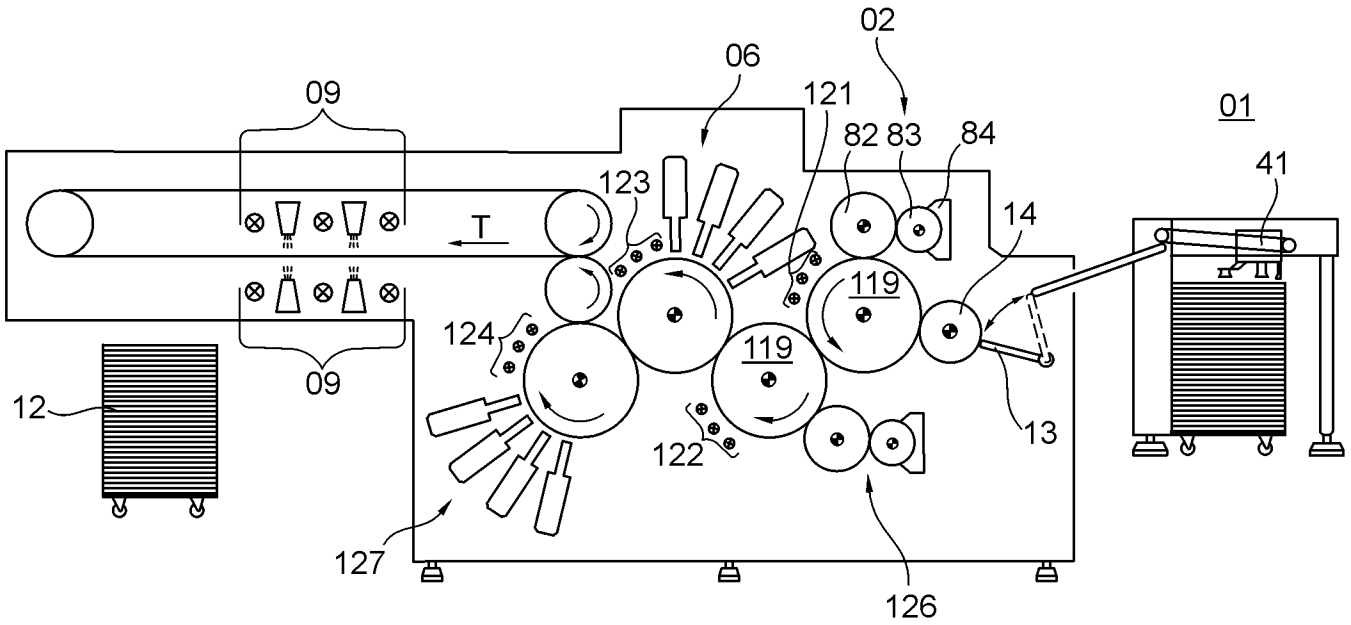
FIG. 29 yet another press assembly for the two-sided sequential processing of a plurality of sheet-type substrates.

FIG. 29 shows yet another advantageous press assembly for the sequential processing of a plurality of sheet-type substrates, each having a front side and a back side. This press assembly, preferably embodied as a printing press, in particular as a sheet-fed printing press, has at least a first printing cylinder and a second printing cylinder. In each case, on the periphery of the first printing cylinder, at least one first non-impact printing unit 06 for printing on the front side of the substrate in question, and in the direction of rotation of the first printing cylinder, downstream of the first non-impact printing unit 06, a dryer 123 for drying the front side of the substrate in question that has been printed by the first non-impact printing unit 06 are provided, and in each case on the periphery of the second printing cylinder, at least one second non-impact printing unit 127 for printing on the back side of the substrate in question, and in the direction of rotation of the second printing cylinder, downstream of the second non-impact printing unit 127, a dryer 124 for drying the back side of the substrate in question that has been printed by the second non-impact printing unit 127 are provided. The first non-impact printing unit 06 and the second non-impact printing unit 127 are each embodied, e.g. as at least one inkjet printing unit. The first non-impact printing unit 06 and/or the second non-impact printing unit 127, for example, each print with a plurality of printing inks, e.g. four, in particular the printing inks yellow, magenta, cyan, and black, wherein a specific inkjet printing device is preferably provided for each of these printing inks with respect to the non-impact printing device 06; 127 in question.

In the press assembly according to FIG. 29, the first printing cylinder and the second printing cylinder are arranged so as to form a common roller nip, wherein in this common roller nip, the first printing cylinder transfers the substrate in question that has been printed and dried on the front side directly to the second printing cylinder. In the preferred embodiment of this press assembly, a first primer application unit 02 and a second primer application unit 126 are additionally provided, wherein the first primer application unit 02 is located for priming the front side and the second primer application unit 126 is located for priming the back side of the same sheet-type substrate, wherein the first non-impact printing unit 06 is located for printing on the front side of said substrate that has been primed by the first primer application unit 02, and the second non-impact printing unit 127 is located for printing on the back side of said substrate that has been primed by the second primer application unit 126. The first primer application unit 02 and the second primer application unit 126 each have, e.g. an impression cylinder 119, wherein these two impression cylinders 119 are arranged so as to form a common roller nip, and wherein in this common roller nip, the impression cylinder 119 that has the first primer application unit 02 transfers the substrate in question directly to the impression cylinder 119 that has the second primer application unit 126. The impression cylinder 119 that has the second primer application unit 126 and the first printing cylinder that has the first non-impact printing unit 06 are arranged so as to form a common roller nip, wherein the impression cylinder 119 that has the second primer application unit 126 transfers the substrate in question directly to the first printing cylinder 119 that has the first non-impact printing unit 06.

On the periphery of the impression cylinder 119 that has the first primer application unit 02, generally immediately downstream of the first primer application unit 02, e.g. a dryer 121 for drying the front side of the substrate in question, which has been primed by this first primer application unit 02, is provided, and/or on the periphery of the impression cylinder 119 that has the second primer application unit 126, generally immediately downstream of the second primer application unit 126, e.g. a dryer 122 for drying the back side of the substrate in question, which has been primed by this second primer application unit 126, is provided. The dryer 121 for drying the primer applied to the front side of the substrate in question, and/or the dryer 122 for drying the primer applied to the back side of the substrate in question, and/or the dryer 123 for drying the substrate in question that has been printed on its front side by the first non-impact printing unit 06, and/or the dryer 124 for drying the substrate in question that has been printed on its back side by the second non-impact printing unit 127 is or are each embodied as a dryer that dries the primed and/or printed substrate in question by means of hot air and/or by irradiating it with infrared or ultraviolet radiation. In a particularly preferred embodiment, the dryer 121; 122; 123; 124 for drying the primed and/or printed substrate in question by irradiating it with infrared or ultraviolet radiation is embodied as an LED dryer, i.e. as a dryer that generates the infrared or ultraviolet radiation by means of semiconductor diodes.

Moreover, in the press assembly according to FIG. 29, the first printing cylinder and the second printing cylinder, and the impression cylinder 119 that has the first primer application unit 02, and the impression cylinder 119 that has the second primer application unit 126 are preferably connected to one another in each case in a single drive train composed of gear wheels, i.e. in a gear train, and are driven collectively in terms of their respective rotation by a single drive, wherein this drive is preferably embodied in particular as a speed-controlled and/or position-controlled electric motor. The first printing cylinder and the second printing cylinder and the impression cylinder 119 having the first primer application unit 02 and the impression cylinder 119 having the second primer application unit 126 are each embodied, e.g. as multiple sized, i.e. a plurality of substrates, e.g. two or three or four, are or at least can be arranged one behind the other in the circumferential direction on the lateral surface of each. Each of the substrates to be transported is held in a force-locking and/or a form-locking manner on the lateral surface of the first printing cylinder and/or of the second printing cylinder and/or of the impression cylinder 119 having the first primer application unit 02 and/or of the impression cylinder 119 having the second primer application unit 126, in each case by means of at least one holding element embodied, e.g. as a gripper. In particular, flexible and/or thin substrates having a thickness of, e.g. up to 0.1 mm or a maximum of 0.2 mm can be held in a force-locking manner, e.g. by suction air, on the lateral surface of the cylinder in question, wherein the positioning of such a substrate lying on the lateral surface of the cylinder in question, in particular along the edges of this substrate, is supported, e.g. by blown air directed in particular radially onto the lateral surface of the cylinder in question.

Finally, the substrate in question that has been printed on both sides, after being transported through the second printing cylinder, is preferably transported by means of a transport apparatus, e.g. to a delivery unit 12, where it is placed on a stack in the delivery unit 12. The transport apparatus that follows the second printing cylinder is embodied, e.g. as a chain conveyor, wherein the substrate in question is dried once again, preferably on both sides, during its transport through this transport apparatus, by means of at least one dryer 09, before being placed in delivery unit 12. In some production lines, it may be desirable to print on the substrate in question, which has been printed on its front side by the first non-impact printing unit 06 and/or has been printed on its back side by the second non-impact printing unit 127, on one side or both sides with additional printing inks, in particular special inks, and/or, e.g. to finish the surface of said substrate by an application of varnish. In this latter case, following the second printing cylinder, upstream of the transport apparatus for transporting the substrate in question to the delivery unit 12, at least one additional printing cylinder, e.g. a third, or preferably at least one additional cylinder pair composed of a third printing cylinder and a fourth printing cylinder is provided, on which at least one additional, e.g. third and/or fourth printing cylinder, in the same way as on the first printing cylinder and/or on the second printing cylinder, an additional printing unit, in particular an additional non-impact printing unit, or at least one varnishing unit 08, each optionally with an additional dryer, are again arranged. All of these printing cylinders arranged in a row then form in the press assembly in question a continuous transport path for the substrate in question, wherein this substrate is then transferred in each case from one printing cylinder to the next. The substrate in question can be processed, in particular printed, on both sides, without the need for a turning device for this substrate in this press assembly. The proposed press assembly is therefore highly compact and inexpensive.

The press assembly shown in FIG. 29 is particularly advantageous in conjunction with UV-curing printing inks, e.g. in printing packaging for foodstuffs or cosmetics.

While preferred embodiments of a method and apparatus for arranging sheets in a shingled position, in accordance with the present invention, are set forth fully and completely hereinabove, it will be apparent to one of ordinary skill in the art that various changes could be made, without departing from the true spirit and scope of the present invention, which is accordingly to be limited only by the appended claims.

The invention claimed is:

1. A method for arranging sheets in a shingled position in a transfer unit located between a first processing station (01; 02; 03; 04; 06; 07; 08; 09; 11; 12) and a second processing station (01; 02; 03; 04; 06; 07; 08; 09; 11; 12) located downstream of the first processing station (01; 02; 03; 04; 06; 07; 08; 09; 11; 12) in the transport direction (T) of the sheets, wherein the sheets to be shingled are transported from the first processing station (01; 02; 03; 04; 06; 07; 08; 09; 11; 12) to the transfer unit, in a transport plane (29) and lying individually in succession, and wherein the trailing edge in the transport direction (T) of each of the sheets coming from the first processing station (01; 02; 03; 04; 06; 07; 08; 09; 11; 12) is raised relative to the transport plane (29) solely by means of blown air, and a subsequent sheet is pushed underneath the trailing edge of the sheet preceding it in each case, characterized in that additional blown air is blown from above onto the sheets to be transported to the transfer unit, at an acute angle that is formed with the transport plane (29) and in a direction opposite the transport direction (T) of the sheets, wherein the operating width, directed orthogonally to the transport direction (T) of the sheets, of the blown air acting counter to the force of gravity in the direction of the transport plane (29), and the operating width of the additional blown air directed opposite the transport direction (T) of the sheets are each adjusted based on the width of the sheet, directed orthogonally to the transport direction (T) of the sheets.

2. The method according to claim 1, characterized in that the additional blown air directed opposite the transport direction (T) of the sheets emerges from a guide surface that forms a convergent acute angle with the transport plane (29) of the sheets.

3. The method according to claim 1, characterized in that the blown air acting counter to the force of gravity in the direction of the transport plane (29) is pulsed.

4. The method according to claim 1, characterized in that each of the sheets to be transported from the first processing station (01; 02; 03; 04; 06; 07; 08; 09; 11; 12) to the second processing station (01; 02; 03; 04; 06; 07; 08; 09; 11; 12) downstream is held in the transport plane (29) by means of suction air.

5. The method according to claim 4, characterized in that the suction air used for holding the sheets to be transported from the first processing station (01; 02; 03; 04; 06; 07; 08; 09; 11; 12) to the second processing station (01; 02; 03; 04; 06; 07; 08; 09; 11; 12) downstream in the transport plane (29) is pulsed, and/or in that the operating width for the suction air used for holding the sheets to be transported from the first processing station (01; 02; 03; 04; 06; 07; 08; 09; 11; 12) to the second processing station (01; 02; 03; 04; 06; 07; 08; 09; 11; 12) downstream in the transport plane (29) is adjusted based on the width of the sheet, directed orthogonally to the transport direction (T) of the sheets.

6. The method according to claim 1, characterized in that the sheets are transported individually, spaced from one another, through the first processing station (04) at a first transport speed, wherein sheets that are transferred from the first processing station (04) to a second processing station (06) are transported in said second processing station at a second transport speed, wherein the second transport speed used in the second processing station (06) is lower than the first transport speed used in the first processing station (04).

7. The method according to claim 1, characterized in that a suction drum (32) is used as the transfer unit, to enable the adjustment of the transport speed of each of the sheets that are to be transferred from the first processing station (04) to the second processing station (06).

8. The method according to claim 7, characterized in that the sheets that are fed from the first processing station (04) to the suction drum (32) in succession, each at the first transport speed, are each braked by their leading edge being pushed up against at least one stop (34) formed on the periphery of the suction drum (32).

9. An apparatus for arranging sheets in a shingled position in a transfer unit located between a first processing station (01; 02; 03; 04; 06; 07; 08; 09; 11; 12) and a second processing station (01; 02; 03; 04; 06; 07; 08; 09; 11; 12) located downstream of the first processing station (01; 02; 03; 04; 06; 07; 08; 09; 11; 12) in the transport direction (T)

of the sheets, wherein a transport belt (38) for transporting the sheets to be shingled is provided, wherein the transport belt (38) transports the sheets to be shingled from the first processing station (01; 02; 03; 04; 06; 07; 08; 09; 11; 12) to the transfer unit, in a transport plane (29) and lying individually in succession, wherein nozzles for emitting blown air are provided, and wherein the nozzles are arranged so as to raise the trailing edge in the transport direction (T) of each of the sheets coming from the first processing station (01; 02; 03; 04; 06; 07; 08; 09; 11; 12) relative to the transport plane (29), solely by means of the blown air, and so as to push a subsequent sheet underneath the trailing edge of the sheet preceding it in each case, characterized in that a guide surface in which additional nozzles are located is provided, wherein these additional nozzles blow additional blown air, at an acute angle formed with the transport plane (29) and opposite the transport direction (T) of the sheets, from above onto the sheets to be transported to the transfer unit, wherein the operating width, directed orthogonally to the transport direction (T) of the sheets, of the blown air acting counter to the force of gravity in the direction of the transport plane (29) and/or the operating width of the additional blown air directed opposite the transport direction (T) of the sheets are each adjusted based on the width of the sheet, directed orthogonally to the transport direction (T) of the sheets.

10. The apparatus according to claim 9, characterized in that the guide surface, from the nozzles of which the additional blown air directed opposite the transport direction (T) of the sheets is emitted, forms a convergent acute angle with the transport plane (29) of the sheets.

11. The apparatus according to claim 9, characterized in that the blown air acting counter to the force of gravity in the direction of the transport plane (29) is pulsed by a control unit.

12. The apparatus according to claim 9, characterized in that each of the sheets to be transported from the first processing station (01; 02; 03; 04; 06; 07; 08; 09; 11; 12) to the second processing station (01; 02; 03; 04; 06; 07; 08; 09; 11; 12) downstream is held in the transport plane (29) by means of suction air.

13. The apparatus according to claim 12, characterized in that the suction air used for holding the sheets to be transported from the first processing station (01; 02; 03; 04; 06; 07; 08; 09; 11; 12) to the second processing station (01; 02; 03; 04; 06; 07; 08; 09; 11; 12) downstream in the transport plane (29) is pulsed by the control unit, and/or in that the operating width for the suction air used for holding the sheets to be transported from the first processing station (01; 02; 03; 04; 06; 07; 08; 09; 11; 12) to the second processing station (01; 02; 03; 04; 06; 07; 08; 09; 11; 12) downstream in the transport plane (29) is adjusted by the control unit, in each case based on the width of the sheet directed orthogonally to the transport direction (T) of the sheets.

14. The apparatus according to claim 9, characterized in that the transfer unit includes a suction drum (32).

15. The apparatus according to claim 9, characterized in that the suction drum (32) has at least one stop (34) on its periphery, wherein the sheets that are fed from the first processing station (04) to the suction drum (32) in succession, each at a first transport speed, are each braked by the leading edge thereof striking the at least one stop (34).

* * * * *